US008158054B2

(12) United States Patent
Iwasaki et al.

(10) Patent No.: US 8,158,054 B2
(45) Date of Patent: Apr. 17, 2012

(54) METHOD AND SYSTEM FOR PRODUCING METALLIC IRON NUGGETS

(75) Inventors: Iwao Iwasaki, Grand Rapids, MN (US); Michael J. Lalich, Duluth, MN (US); Robert C. Beaudin, Duluth, MN (US); Richard F. Kiesel, Hibbing, MN (US); Andrew J. Lindgren, Grand Rapids, MN (US); Rodney L. Bleifuss, Grand Rapids, MN (US)

(73) Assignee: Nu-Iron Technology, LLC, Charlotte, NC (US)

( * ) Notice: Subject to any disclaimer, the term of this patent is extended or adjusted under 35 U.S.C. 154(b) by 0 days.

(21) Appl. No.: 12/639,584

(22) Filed: Dec. 16, 2009

(65) Prior Publication Data

US 2010/0164150 A1 Jul. 1, 2010

Related U.S. Application Data

(62) Division of application No. 11/296,198, filed on Dec. 7, 2005, now Pat. No. 7,695,544.

(60) Provisional application No. 60/633,886, filed on Dec. 7, 2004.

(51) Int. Cl.
*C21C 7/00* (2006.01)
*F27B 3/00* (2006.01)

(52) U.S. Cl. ..... 266/216; 432/195; 75/484

(58) Field of Classification Search ..... 266/216, 266/176, 160; 75/503, 484, 474, 477; 432/195, 432/138, 103, 105

See application file for complete search history.

(56) References Cited

U.S. PATENT DOCUMENTS

| | | | |
|---|---|---|---|
| 768,551 | A | 8/1904 | Baxeees De Alzugakay |
| 1,848,710 | A | 3/1932 | Gustafsson |
| 2,072,072 | A | 2/1937 | Hartgen |
| 2,711,952 | A | 6/1955 | West |
| 3,317,308 | A | 5/1967 | Andre |
| 3,443,931 | A | 5/1969 | Ahrendt |

(Continued)

FOREIGN PATENT DOCUMENTS

| | | |
|---|---|---|
| DE | 19543074 | 5/1997 |

(Continued)

OTHER PUBLICATIONS

A Laboratory Study Relating to the Production and Property of Pig Iron Nuggets, Anameric, et al., SME Annual Meeting, Feb. 2004, Denver, CO.

(Continued)

*Primary Examiner* — Scott Kastler
*Assistant Examiner* — Michael Aboagye
(74) *Attorney, Agent, or Firm* — Hahn, Loeser & Parks LLP; Arland T. Stein

(57) ABSTRACT

Method and system for producing metallic nuggets includes providing reducible mixture (e.g., reducible micro-agglomerates; reducing material and reducible iron bearing material; reducible mixture including additives such as a fluxing agent; compacts, etc.) on at least a portion of a hearth material layer. In one embodiment, a plurality of channel openings extend at least partially through a layer of the reducible mixture to define a plurality of nugget forming reducible material regions. Such channel openings may be at least partially filled with nugget separation fill material (e.g., carbonaceous material). Thermally treating the layer of reducible mixture results in formation of one or more metallic iron nuggets. In other embodiments, various compositions of the reducible mixture and the formation of the reducible mixture provide one or more beneficial characteristics.

8 Claims, 50 Drawing Sheets

U.S. PATENT DOCUMENTS

| | | | | |
|---|---|---|---|---|
| 3,751,241 | A | 8/1973 | Sloughfy | |
| 3,802,865 | A | 4/1974 | Ohkubo et al. | |
| 3,807,986 | A | 4/1974 | Funk et al. | |
| 3,910,786 | A | 10/1975 | Bleifuss et al. | |
| 3,953,196 | A | 4/1976 | Obenchain | |
| 4,013,456 | A | 3/1977 | Bergsoe | |
| 4,160,663 | A | 7/1979 | Hsieh | |
| 4,231,797 | A | 11/1980 | Fujita et al. | |
| 4,239,530 | A | 12/1980 | Goksel | |
| 4,372,779 | A | 2/1983 | Sugiyama et al. | |
| 4,528,029 | A | 7/1985 | Goksel | |
| 4,676,741 | A | 6/1987 | Pargeter | |
| 4,747,872 | A | 5/1988 | Viramontes-Brown | |
| 4,874,428 | A | 10/1989 | Niedringhaus | |
| 5,186,741 | A | 2/1993 | Kotraba | |
| 5,368,631 | A | 11/1994 | Rossborough | |
| 5,585,521 | A | 12/1996 | Eichinger | |
| 5,637,133 | A | 6/1997 | Munnix et al. | |
| 5,730,775 | A | 3/1998 | Meissner et al. | |
| 5,873,924 | A | 2/1999 | Kinsman et al. | |
| 5,927,411 | A | 7/1999 | Sheirer | |
| 5,972,066 | A | 10/1999 | Lehtinen | |
| 6,036,744 | A | 3/2000 | Negami et al. | |
| 6,120,577 | A | 9/2000 | Koros et al. | |
| 6,126,718 | A | 10/2000 | Sawa et al. | |
| 6,129,777 | A | 10/2000 | Fuji et al. | |
| 6,135,766 | A | 10/2000 | Takeda | |
| 6,146,441 | A | 11/2000 | Innes | |
| 6,149,709 | A | 11/2000 | Uragami et al. | |
| 6,152,983 | A | 11/2000 | Kamijo et al. | |
| 6,210,462 | B1 | 4/2001 | Kikuchi et al. | |
| 6,224,820 | B1 | 5/2001 | Sawa et al. | |
| 6,241,803 | B1 | 6/2001 | Fuji | |
| 6,248,152 | B1 | 6/2001 | Takeda | |
| 6,254,665 | B1 | 7/2001 | Matsushita et al. | |
| 6,264,721 | B1 | 7/2001 | Takeda et al. | |
| 6,270,552 | B1 | 8/2001 | Takeda et al. | |
| 6,302,938 | B1 | 10/2001 | Kamijo et al. | |
| 6,319,302 | B1 | 11/2001 | Harada | |
| 6,334,883 | B1 | 1/2002 | Takenaka et al. | |
| 6,372,016 | B1 | 4/2002 | Kamikawa et al. | |
| 6,413,295 | B2 | 7/2002 | Meissner et al. | |
| 6,451,085 | B1 | 9/2002 | Kamikawa et al. | |
| 6,494,933 | B1 | 12/2002 | Saage et al. | |
| 6,503,289 | B2 | 1/2003 | Tanigaki | |
| 6,506,231 | B2 | 1/2003 | Negami et al. | |
| 6,569,223 | B2 | 5/2003 | Tanigaki et al. | |
| 6,582,490 | B2 | 6/2003 | Miller et al. | |
| 6,582,491 | B2 | 6/2003 | Hoffman | |
| 6,582,651 | B1 | 6/2003 | Cochran, Jr. et al. | |
| 6,592,647 | B2 | 7/2003 | Hino et al. | |
| 6,592,648 | B2 | 7/2003 | Lu | |
| 6,592,649 | B2 | 7/2003 | Kikuchi et al. | |
| 6,602,320 | B2 | 8/2003 | Fuji et al. | |
| 6,629,839 | B2 * | 10/2003 | Ozawa et al. | 432/195 |
| 6,630,010 | B2 | 10/2003 | Ito et al. | |
| 6,648,942 | B2 | 11/2003 | Hoffman | |
| 6,749,664 | B1 | 6/2004 | Hoffman et al. | |
| 6,790,255 | B2 * | 9/2004 | Hashimoto et al. | 75/484 |
| 6,811,759 | B2 | 11/2004 | Tsuchiya et al. | |
| 6,837,916 | B2 | 1/2005 | Kawakami et al. | |
| 6,872,074 | B2 | 3/2005 | Ishiwata et al. | |
| 7,037,356 | B2 | 5/2006 | Ibaraki et al. | |
| 7,413,592 | B2 | 8/2008 | Bleifuss et al. | |
| 7,462,219 | B2 | 12/2008 | Kikuchi et al. | |
| 7,628,839 | B2 | 12/2009 | Iwasaki et al. | |
| 7,632,335 | B2 | 12/2009 | Iwasaki et al. | |
| 7,641,712 | B2 | 1/2010 | Iwasaki et al. | |
| 7,674,314 | B2 | 3/2010 | Harada et al. | |
| 7,695,544 | B2 | 4/2010 | Iwasaki et al. | |
| 2001/0037703 | A1 * | 11/2001 | Fuji et al. | 75/483 |
| 2002/0053307 | A1 | 5/2002 | Ishiwata et al. | |
| 2004/0076539 | A1 | 4/2004 | Ito et al. | |
| 2004/0154436 | A1 | 8/2004 | Ito et al. | |
| 2004/0173054 | A1 | 9/2004 | Tsuge et al. | |
| 2004/0201140 | A1 | 10/2004 | Ibaraki et al. | |
| 2006/0070495 | A1 | 4/2006 | Ito et al. | |
| 2006/0169103 | A1 | 8/2006 | Ito et al. | |
| 2006/0248981 | A1 | 11/2006 | Ito et al. | |

FOREIGN PATENT DOCUMENTS

| | | |
|---|---|---|
| EP | 0044669 | 1/1982 |
| EP | 0916742 | 5/1999 |
| GB | 1138695 | 1/1969 |
| JP | 11-335712 | 12/1999 |
| JP | 2000-045008 | 2/2000 |
| WO | 97/33135 | 9/1997 |
| WO | 98/59079 | 12/1998 |
| WO | 2006 061790 A1 | 6/2006 |

OTHER PUBLICATIONS

A New Process to Produce Iron Directly from Fine Ore and Coal, Kobayashi, et al., I & SM, pp. 19-22, Sep. 2001.

Bench Scale Test of a New Ironmaking Process with Mixture of Iron Ore Concentrate and Pulverized Coal, Gou, et al., 1992 ISIJ International, vol. 32, No. 6, pp. 733-740.

Building of a Mathematical Model for the Reduction of Iron Ore in Ore/Coal Composites, Sun, et al., 1999 ISIJ International, vol. 39, No. 2, pp. 130-138.

Development of the Fastmet® as a New Direct Reduction Process, Miyagawa, et al.l, 1998 ICSTI/Ironmaking Conference Proceedings, pp. 877-881.

Direct reduction down under: the New Zealand story, Iron and Steel International, Bold, et al., vol. 50, 3 pp. 145 and 147-52 (Jun. 1977).

Direct Reduced Iron Production Processing, Tanigaki, et al., Kobelco Technology Review No. 23, Apr. 2000, pp. 3-6.

Fastmet®: Proven Process for Steel Mill Waste Recovery, James M. McClelland, Jr. P.E., 2000 Midrex Technologies, Inc.

Fundamentals and Practicality of the Development of a New and Better Ironmaking Process, Lu, AISTech 2004 Proceeding, vol. I, pp. 347-361.

Investigation into the Role of the Boudouard Reaction in Self-Reducing Iron Oxide and Carbon Briquettes, Moon, et al., Metallurgical and materials Transactions B, vol. 37B, Apr. 2006.

Kinetic Model for the Uniform Conversion of Self Reducing Iron Oxide and Carbon Briquettes, Moon, et al., ISIJ International, vol. 43 (2003), No. 8, pp. 1136-1142.

Kinetics and Mechanism of Reactions in Iron Ore/Coal Composites, Huang, et al, 1993, ISIJ International, vol. 33, No. 10, pp. 1055-1061.

Lessons Learned from INMETCO, pp. 1-7 plus Figs. 1-8; Presented by Richard Hanewald; Oct. 25-27, 1999; Charlotte Marriott City Center, Charlotte, NC.

Mathematical Modeling of Reactions in Iron Ore/Coal Composites, Sun, et al., ISIJ International, vol. 3 (1993), No. 10, pp. 1062-1069.

Mechanisms of Pig-iron Making from Magnetite Ore Pellets Containing Coal at Low Temperature, Nagata, et al., ISIJ International, vol. 41 (2001), No. 11, pp. 1316-1323.

New Coal-based Process to Produce High Quality DRI for the EAF, Sawa, et al, ISIJ international, vol. 41 (2001), Supplement, pp. S17-S21.

New Ironmaking Technology for High Quality Iron Products, Sawa, et al., Kawasaki Steel Corp., CAMP-ISIJ vol. 13 (2000), p. 986.

Not All RHF's Are Created Equal: A Rotary Hearth Furnace Primer, James M. McClelland, Jr., P.E., 2002, Midrex Technologies, Inc.

Pig Iron Nuggets: How Good Are They?, Anameric, et al., 2007 AISTech Conference, May 1-10, 2007.

Single-Step Ironmaking from Ore to Improve Energy Efficiency, Kawatra, et al., Dept. of Chemical Engineering, Oct. 2005.

The Microstructure of the Pig Iron Nuggets, Anameric, et al., ISIJ International, vol. 47 (2007), No. 1, pp. 53-61.

* cited by examiner

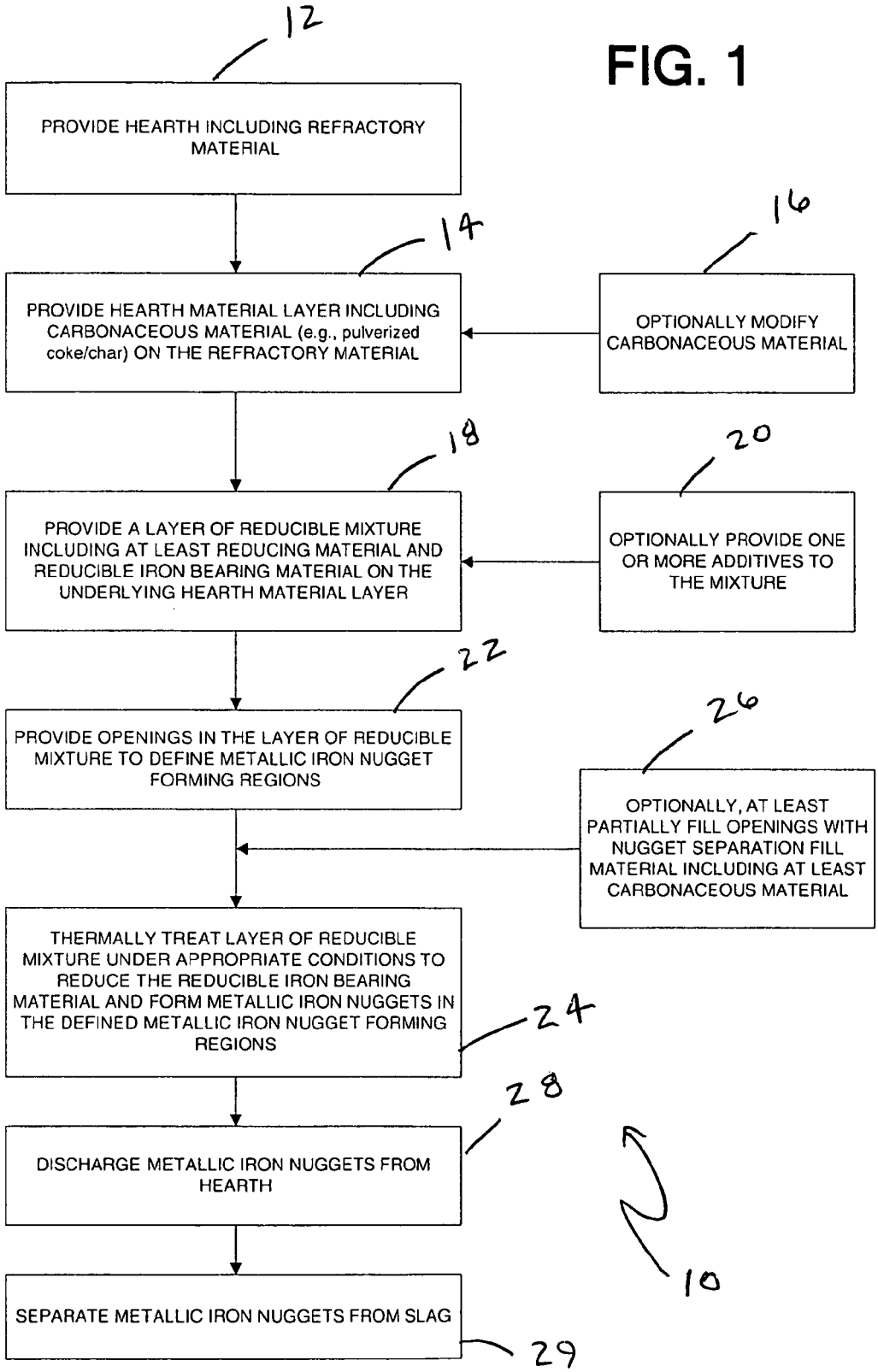
FIG. 1
12
PROVIDE HEARTH INCLUDING REFRACTORY MATERIAL
14
PROVIDE HEARTH MATERIAL LAYER INCLUDING CARBONACEOUS MATERIAL (e.g., pulverized coke/char) ON THE REFRACTORY MATERIAL
16
OPTIONALLY MODIFY CARBONACEOUS MATERIAL
18
PROVIDE A LAYER OF REDUCIBLE MIXTURE INCLUDING AT LEAST REDUCING MATERIAL AND REDUCIBLE IRON BEARING MATERIAL ON THE UNDERLYING HEARTH MATERIAL LAYER
20
OPTIONALLY PROVIDE ONE OR MORE ADDITIVES TO THE MIXTURE
22
PROVIDE OPENINGS IN THE LAYER OF REDUCIBLE MIXTURE TO DEFINE METALLIC IRON NUGGET FORMING REGIONS
26
OPTIONALLY, AT LEAST PARTIALLY FILL OPENINGS WITH NUGGET SEPARATION FILL MATERIAL INCLUDING AT LEAST CARBONACEOUS MATERIAL
THERMALLY TREAT LAYER OF REDUCIBLE MIXTURE UNDER APPROPRIATE CONDITIONS TO REDUCE THE REDUCIBLE IRON BEARING MATERIAL AND FORM METALLIC IRON NUGGETS IN THE DEFINED METALLIC IRON NUGGET FORMING REGIONS
24
28
DISCHARGE METALLIC IRON NUGGETS FROM HEARTH
10
SEPARATE METALLIC IRON NUGGETS FROM SLAG
29

Fig. 13A Fig. 13B
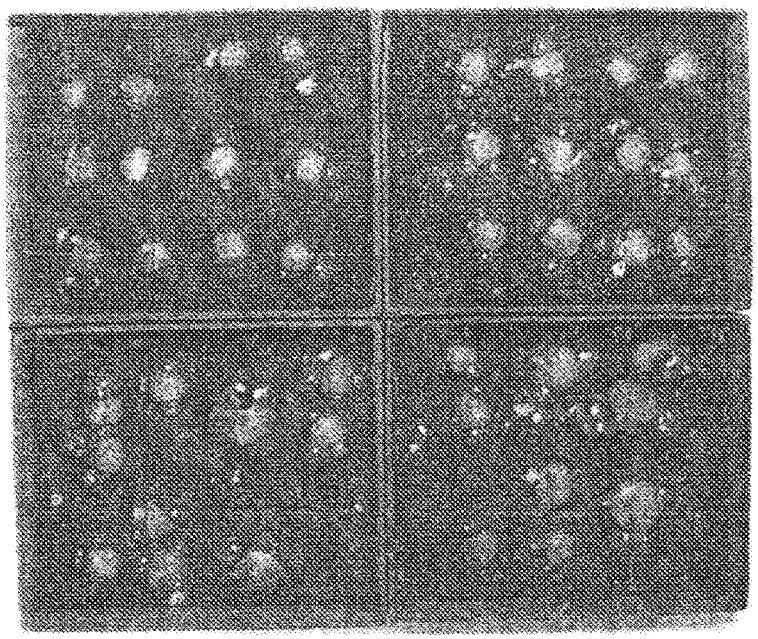
Fig. 13C Fig. 13D
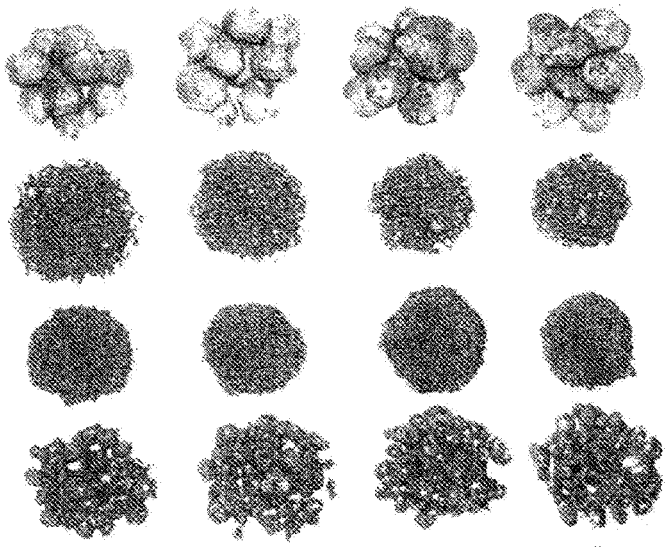
Figs. 14A 14B 14C 14D

| | Hearth material | % micro nuggets |
|---|---|---|
| 12 balls | Coke | 0.4 |
| 36 balls | Coke | 0.8 |
| 12 elongated domes | Coke | 13.9 |
| | $Al_2O_3$ | 3.7 |
| | (50:50) coke-$Al_2O_3$ | 6.2 |
| | $Al(OH)_3$-coated coke (6%) | 3.9 |
| | $Ca(OH)_2$-coated coke (12%) | 14.2 |

FIG. 16

| | Fusion point, °C | $SiO_2$ | $Al_2O_3$ | CaO | C/S | B/A |
|---|---|---|---|---|---|---|
| A | 1310 | 41 | 11.5 | 47.5 | 1.16 | 0.90 |
| L | 1385<br>~1400 | 42 | 6 | 52 | 1.24 | 1.08 |

| %$CaF_2$ | Slag Comp. | Weight distribution, % | | | |
|---|---|---|---|---|---|
| | | Nuggets | Micro nuggets | -20 mesh mag. | Slag |
| 0 | $L_{0.5}$ | 67.6<br>**89.2*** | 8.2<br>**10.8** | 4.6 | 19.6 |
| 0.25 | $L_{0.5}CF_{0.25}$ | 76.5<br>**98.1** | 1.5<br>**1.9** | 2.5 | 19.5 |
| 0.5 | $L_{0.5}CF_{0.5}$ | 78.1<br>**99.4** | 0.5<br>**0.6** | 1.5 | 19.9 |
| 0.75 | $L_{0.5}CF_{0.75}$ | 76.6<br>**97.9** | 1.7<br>**2.1** | 1.2 | 20.5 |
| 1 | $L_{0.5}CF_1$ | 77.5<br>**98.9** | 0.8<br>**1.1** | 1.7 | 20.0 |
| 1.25 | $L_{0.5}CF_{1.25}$ | 76.6<br>**99.4** | 0.5<br>**0.6** | 1.7 | 21.2 |
| 1.5 | $L_{0.5}CF_{1.5}$ | 75.9<br>**99.1** | 0.7<br>**0.9** | 2.0 | 21.4 |
| 1.75 | $L_{0.5}CF_{1.75}$ | 76.1<br>**99.5** | 0.4<br>**0.5** | 1.2 | 22.3 |
| 2 | $L_{0.5}CF_2$ | 74.8<br>**98.7** | 1.0<br>**1.3** | 1.9 | 22.3 |

* Numbers in bold represent relative amounts of nuggets and micro nuggets.

FIG. 22

| $CaF_2$ added, % | Temp. °C | % micro nuggets generated | | | | |
|---|---|---|---|---|---|---|
| | | L | $L_{0.5}$ | $L_1^+$ | $L_{1.5}^+$ | $L_2^+$ |
| 0 | 1400 | 8.8 | 5.3 ,10.8 | 7.4**, 21.5 | 22.2** | 26.6** |
| 0.5 | | | 0.6 | 1.4 | 0.6 | 1.7 |
| 1 | | 0.5 | 1.1, 1.2 | 0.8 , 0.2 | 0.6 | 0.5 |
| 2 | | | 1.3 | 0.3 | 1.3 | 0.9 |
| 4 | | | | 0.2 | 2.2 | 2.4 |
| 0 | 1350 | | 17.9 | 26.7*** | 16.5*** | ---**** |
| 0.5 | | | | 1.4 | 0.7** | 2.2** |
| 1 | | 1.6 | 2.5 , 0.9 | 2.8, 1.4 3.9' | 0.6 | 0.4 |
| 2 | | | | 1.3 | 1.1 | 1.4 |
| 4 | | | | 1.6 | 1.8 | 2.6 |
| 0 | 1325 | | | --- | --- | --- |
| 0.5 | | | | --- | --- | --- |
| 1 | | | | 1.2** 5.5 6.0 | 0.0* | 8.7** |
| 2 | | | | 0.4** | 0.7* | 9.5* |
| 4 | | | | 1.4** | 3.1** | 2.2** |

+ Fluorspar instead of $CaF_2$ used.
* Nearly fused.
** Not quite fused.
*** Partially fused.
**** Reduced, but not coalesced.

FIG. 23

| Fluorspar Added, % | Slag Comp. | $L_1$ | | $L_{1.5}$ | | $L_2$ | |
|---|---|---|---|---|---|---|---|
| | | %C | %S | %C | %S | %C | %S |
| 0 | $L_m$ | 2.84 | 0.072 | 2.26 | 0.058 | 2.13 | 0.050 |
| 0.5 | $L_mFS_{0.5}$ | 3.27 | 0.060 | 3.06 | 0.055 | 2.60 | 0.048 |
| 1 | $L_mFS_1$ | 3.36 | 0.058 | 3.63 | 0.041 | 3.25 | 0.038 |
| 2 | $L_mFS_2$ | 3.67 | 0.043 | 3.86 | 0.021 | 3.73 | 0.015 |
| 4 | $L_mFS_4$ | 3.77 | 0.030 | 4.22 | 0.013 | 4.12 | 0.009 |

FIG. 24

| $Na_2CO_3$ added, % | Slag Comp. | %S in iron nuggets | | | | |
|---|---|---|---|---|---|---|
| | | L | $L_{0.5}$ | $L_1$** | $L_{1.5}$** | $L_2$** |
| 0* | $L_m$ | 0.084 | 0.081 | 0.072 | 0.058 | 0.050 |
| 2* | $L_mSC_2$ | --- | 0.031 | --- | --- | --- |
| 0 | $L_mCF_1$ | 0.083 | 0.074 | 0.064 | 0.041 | 0.038 |
| 0.25 | $L_mCF_1SC_{0.25}$ | 0.069 | 0.053 | 0.045 | --- | --- |
| 0.5 | $L_mCF_1SC_{0.5}$ | 0.058 | 0.050 | 0.038 | 0.028 | 0.032 |
| 1 | $L_m$ $CF_1SC_1$ | 0.043 | 0.043 | 0.030 | 0.029 | 0.029 |
| 2 | $L_m$ $CF_1SC_2$ | 0.043 | 0.024 | 0.020 | 0.021 | 0.018 |

* No $CaF_2$ added
** Fluorspar instead of chemical $CaF_2$ used.
m % additional lime over Composition L.

FIG. 26

| Temp. °C | %C | %S |
|---|---|---|
| 1400 | 3.25 | 0.029 |
| 1350 | 2.89 | 0.022 |
| 1325* | 2.28 | 0.013 |

* Nearly fused.

FIG. 27

| Velocity m/s | Diameter, mm | 6.00 | 5.00 | 4.00 | 3.00 | 2.00 | 1.00 | 0.50 | 0.40 | 0.30 | 0.20 | 0.15 | 0.10 | 0.05 |
|---|---|---|---|---|---|---|---|---|---|---|---|---|---|---|
| 0.05 | | 9.75 | 8.24 | 6.70 | 5.11 | 3.48 | 1.78 | 0.91 | 0.73 | 0.55 | 0.37 | 0.28 | 0.18 | 0.09 |
| 0.1 | | 12.88 | 10.95 | 8.96 | 6.90 | 4.74 | 2.46 | 1.26 | 1.01 | 0.77 | 0.51 | 0.39 | 0.26 | 0.13 |
| 0.2 | | 16.60 | 14.21 | 11.72 | 9.11 | 6.34 | 3.35 | 1.74 | 1.40 | 1.06 | 0.72 | 0.54 | 0.36 | 0.18 |
| 0.3 | | 19.00 | 16.34 | 13.55 | 10.60 | 7.44 | 3.98 | 2.09 | 1.69 | 1.28 | 0.87 | 0.66 | 0.44 | 0.22 |
| 0.4 | | 20.79 | 17.94 | 14.93 | 11.74 | 8.29 | 4.48 | 2.37 | 1.92 | 1.46 | 0.99 | 0.75 | 0.51 | 0.26 |
| 0.5 | | 22.23 | 19.22 | 16.04 | 12.66 | 8.99 | 4.90 | 2.61 | 2.12 | 1.62 | 1.10 | 0.83 | 0.56 | 0.29 |
| 0.75 | | 24.91 | 21.63 | 18.15 | 14.41 | 10.33 | 5.72 | 3.09 | 2.52 | 1.93 | 1.32 | 1.01 | 0.68 | 0.35 |
| 1 | | 26.86 | 23.39 | 19.69 | 15.72 | 11.34 | 6.36 | 3.46 | 2.83 | 2.18 | 1.50 | 1.14 | 0.78 | 0.40 |
| 1.5 | | 29.69 | 25.93 | 21.93 | 17.61 | 12.83 | 7.31 | 4.05 | 3.33 | 2.57 | 1.78 | 1.36 | 0.93 | 0.48 |
| 2 | | 31.73 | 27.78 | 23.56 | 19.00 | 13.93 | 8.02 | 4.49 | 3.71 | 2.88 | 2.00 | 1.54 | 1.06 | 0.55 |
| 2.5 | | 33.34 | 29.23 | 24.85 | 20.09 | 14.79 | 8.59 | 4.86 | 4.02 | 3.13 | 2.19 | 1.69 | 1.17 | 0.61 |
| 3 | | 34.66 | 30.43 | 25.91 | 20.99 | 15.51 | 9.07 | 5.17 | 4.29 | 3.35 | 2.35 | 1.82 | 1.26 | 0.66 |
| 3.5 | | 35.80 | 31.46 | 26.81 | 21.76 | 16.12 | 9.49 | 5.44 | 4.52 | 3.54 | 2.49 | 1.93 | 1.34 | 0.71 |
| 4 | | 36.79 | 32.35 | 27.60 | 22.43 | 16.66 | 9.85 | 5.67 | 4.72 | 3.71 | 2.62 | 2.04 | 1.42 | 0.75 |

FIG. 30

| | Analysis basis | Volatile matter | Fixed carbon | Ash | Sulfur | % moisture | Btu/lb |
|---|---|---|---|---|---|---|---|
| Anthracite* | As received | 4.72 | 83.66 | 10.51 | 0.55 | 1.11 | 12,832 |
| | Dry basis | 4.77 | 84.60 | 10.63 | 0.56 | — | 12,976 |
| Low volatile bituminous I* | As received | 17.49 | 73.73 | 7.01 | 0.72 | 1.77 | 14,191 |
| | Dry basis | 17.81 | 75.05 | 7.14 | 0.73 | — | 14,447 |
| Low volatile bituminous II* | As received | 18.56 | 75.39 | 6.07 | 1.03 | 2.27 | 14,309 |
| | Dry basis | 19.34 | 77.14 | 6.21 | 1.06 | — | 14,642 |
| Low volatile bituminous III* | As received | 17.76 | 70.63 | 4.81 | 0.72 | 6.80 | 13,980 |
| | Dry basis | 19.06 | 75.78 | 5.16 | 0.77 | — | 15,000 |
| Low volatile bituminous IV* | As received | 18.56 | 71.84 | 5.53 | 0.85 | 4.07 | 14,089 |
| | Dry basis | 19.34 | 74.90 | 5.76 | 0.89 | — | 14,686 |
| Medium volatile bituminous I* | As received | 22.24 | 66.10 | 9.97 | 0.42 | 1.69 | 13,546 |
| | Dry basis | 22.62 | 67.24 | 10.14 | 0.42 | — | 13,779 |
| Medium volatile bituminous II* | As received | 21.55 | 72.20 | 4.98 | 0.64 | 1.27 | 14,817 |
| | Dry basis | 21.83 | 73.12 | 5.05 | 0.64 | — | 15,008 |
| Medium volatile bituminous III* | As received | 21.64 | 67.67 | 9.90 | 0.40 | 0.79 | 13,816 |
| | Dry basis | 21.81 | 68.21 | 9.98 | 0.40 | — | 13,925 |

FIG. 32A

| | Analysis basis | Volatile matter | Fixed carbon | Ash | Sulfur | % moisture | Btu/lb |
|---|---|---|---|---|---|---|---|
| Medium volatile bituminous IV* | As received | 22.81 | 67.40 | 9.37 | 0.47 | 0.42 | 13,960 |
| | Dry basis | 22.90 | 67.69 | 9.41 | 0.47 | — | 14,019 |
| High volatile bituminous I* | As received | 31.52 | 60.98 | 5.52 | 0.93 | 1.98 | 14,309 |
| | Dry basis | 32.16 | 62.20 | 5.64 | 0.95 | — | 14,598 |
| High volatile bituminous II* | As received | 35.43 | 51.21 | 7.09 | 1.72 | 6.27 | 12,962 |
| | Dry basis | 37.80 | 54.64 | 7.56 | 1.83 | — | 13,829/ |
| Sub-bituminous* | As received | 39.99 | 41.71 | 5.20 | 0.47 | 13.10 | 10,742 |
| | Dry basis | 46.02 | 47.99 | 5.99 | 0.54 | — | 12,361 |
| Coke* | As received | 1.38 | 89.48 | 8.96 | 0.47 | 0.18 | 12,905 |
| | Dry basis | 1.38 | 89.64 | 8.98 | 0.47 | — | 12,929 |
| Graphite | As received | 0.87 | 98.90 | 0.11 | 0.01 | 0.12 | 14,047 |
| | Dry basis | 0.87 | 99.02 | 0.11 | 0.01 | — | 14,063 |
| Sub-bituminous Char I* | As received | 10.26 | 66.13 | 22.10 | 0.13 | 1.51 | 10,619 |
| | Dry basis | 10.41 | 67.15 | 22.44 | 0.13 | — | 10,782 |
| Sub-bituminous Char II | As received | 1.43 | 73.94 | 24.19 | 0.17 | 0.44 | 11,200 |
| | Dry basis | 1.44 | 74.26 | 24.30 | 0.17 | — | 11,249 |

FIG. 32B

| | Analysis basis | Volatile matter | Fixed carbon | Ash | Sulfur | % moisture | Btu/lb |
|---|---|---|---|---|---|---|---|
| **Sub-bituminous Char III*** | As received | 10.10 | 77.87 | 7.38 | 0.12 | 4.65 | 13,142 |
| | Dry basis | 10.59 | 81.67 | 7.74 | 0.13 | — | 13,782 |
| **Sub-bituminous Char IV** | As received | 9.04 | 79.87 | 8.60 | 0.29 | 2.49 | 12,614 |
| | Dry basis | 9.27 | 81.98 | 8.82 | 0.30 | — | 12,937 |

FIG. 32C

| | $SiO_2$ | $Al_2O_3$ | CaO | MgO | $Fe_2O_3$ |
|---|---|---|---|---|---|
| Anthracite | 51.99 | 30.64 | 2.06 | 1.36 | 9.21 |
| Low volatile bituminous I | 47.29 | 25.34 | 6.69 | 1.49 | 11.09 |
| Low volatile bituminous II | 49.69 | 25.25 | 5.98 | 1.04 | 11.84 |
| Low volatile bituminous III | 34.50 | 22.79 | 11.70 | 2.11 | 16.95 |
| Low volatile bituminous IV | 50.39 | 33.59 | 2.44 | 1.05 | 8.69 |
| Medium volatile bituminous I | 55.30 | 30.91 | 3.97 | 0.52 | 5.18 |
| Medium volatile bituminous II | 47.56 | 32.38 | 4.76 | 1.55 | 7.25 |
| Medium volatile bituminous III | 58.34 | 26.99 | 2.15 | 0.43 | 7.89 |
| Medium volatile bituminous IV | 57.44 | 27.65 | 1.97 | 0.54 | 6.80 |
| High volatile bituminous I | 53.91 | 30.11 | 2.77 | 1.20 | 8.72 |
| High volatile bituminous II | 48.41 | 22.58 | 3.90 | 1.06 | 19.91 |
| Sub-bituminous | 37.61 | 13.64 | 14.36 | 3.77 | |
| Sub-bituminous Char I | 35.46 | 11.70 | 32.04 | 11.93 | 5.06 |
| Sub-bituminous Char III | 15.76 | 19.70 | 36.17 | 6.99 | 6.87 |

FIG. 32D

| | Fe | FeO | $SiO_2$ | $Al_2O_3$ | CaO | MgO |
|---|---|---|---|---|---|---|
| **Magnetic conc. I** | 67.2 | | 5.74 | 0.18 | 0.31 | 0.45 |
| **Magnetic conc. II** | 67.6 | | 5.28 | 0.10 | 0.41 | 0.28 |
| **Magnetic conc. III** | 67.8 | | 5.24 | 0.085 | 0.24 | 0.29 |
| **Flotation conc. I** | 69.4 | | 3.31 | 0.38 | 0.17 | 0.19 |
| **Flotation conc. II** | 70.3 | | 2.13 | 0.077 | 0.10 | 0.19 |
| **Flotation conc. III** | 68.8 | | 3.63 | 0.19 | 0.48 | 0.28 |
| **Pellet plant waste** | 62.6 | 2.16 | 6.58 | 0.63 | 3.20 | 1.15 |
| **Pellet screened fines** | 63.1 | | 4.72 | 0.25 | 3.52 | 1.15 |

FIG. 33

| | $SiO_2$ | $Al_2O_3$ | CaO | MgO | Fe | S | LOI |
|---|---|---|---|---|---|---|---|
| $Al(OH)_3$ I | — | 29.94 | — | — | — | — | — |
| $Al(OH)_3$ II | — | 55.90 | — | — | — | — | — |
| Bauxite | 2.53 | 57.35 | 0.09 | 0.04 | 7.2 | — | — |
| Bentonite | 63.46 | 25.70 | 4.53 | 1.40 | 2.26 | — | — |
| $Ca(OH)_2$ | — | — | 75.7 | — | — | — | — |
| Lime hydrate | 0.71 | 0.65 | 76.67 | 1.12 | — | — | 30.84 |
| Limestone | 0.70 | 0.27 | 47.90 | 0.95 | 0.10 | — | 43.99 |
| Burnt dolomite | 0.60 | 0.24 | 49.57 | 35.76 | 0.20 | — | — |
| Portland cement | 19.61 | 4.63 | 66.65 | 3.32 | 1.77 | 0.90 | — |

FIG. 34

| | Time Min. | $\%O_2$ | $\%CO_2$ | %CO |
|---|---|---|---|---|
| **Heat-up period, no pallets** | | | | |
| Zone 1 (1750°F (954°C))(1) | | 0.4(3)<br>**1.1**(4) | 10.8<br>--- | 0.5<br>**0.8** |
| Zone 2 (2100°F (1149°C)) | | 2.5<br>**2.5** | 10.0<br>--- | 0.0<br>**0.0** |
| Zone 3 (2600°F (1427°C)) | | 0.4<br>**0.9** | 10.7<br>--- | 0.5<br>**0.7** |
| **-10 mesh coke hearth layer (4 pallets with coke breeze 3rd and 4th pallets at center in each zone)** | | | | |
| Zone 1 (1750°F (954°C))(1) | | 0.4<br>**0.4** | 10.1<br>--- | 1.1<br>**2.2** |
| Zone 2 (2100°F (1149°C)) | | 0.4<br>**0.5** | 10.3<br>--- | 2.1<br>**3.8** |
| Zone 3 (2600°F (1427°C)) | 0(2)<br>5<br>7<br>11<br>18<br>20 | **0.0**<br>0.4<br>**1.6**<br>0.4<br>**1.8**<br>0.5 | ---<br>10.6<br>---<br>10.1<br>---<br>9.8 | **3.8**<br>3.1<br>**3.7**<br>3.5<br>**4.1**<br>4.0 |

(1) Burners operated with sub-stoichiometric amount of air.
Temperature set at (1000°F (538°C))
(2) Timer started after the temperature reached 2600°F.
(3) AGA 5000 gas analyzer (infrared sensor) used in light-faced font.
(4) Testo 350 gas analyzer (electrochemical sensor) used in bold-faced font.

FIG. 36

| | LHF 14 | LHF 15 | LHF 17 |
|---|---|---|---|
| (a) Nugget analysis, % | | | |
| C | 2.92 | 2.70 | 3.15 |
| S | 0.203 | 0.266 | 0.152 |
| (b) Slag basicity | | | |
| $CaO/SiO_2$ | 1.48 | 1.53 | 1.71 |
| $\frac{CaO+MgO}{SiO_2+Al2O_3}$ | 1.35 | 1.38 | 1.53 |
| (S)/[S] | 0.64 | 0.64 | 1.40 |
| (c) Slag analysis, %* | | | |
| $Fe_T$ | 6.3 | 6.7 | 6.0 |
| FeO | 6.70 | 7.18 | 6.31 |
| $SiO_2$ | 35.01 | 34.03 | 32.24 |
| $Al_2O_3$ | 5.11 | 5.24 | 5.18 |
| CaO | 51.90 | 52.18 | 55.27 |
| MgO | 2.36 | 2.01 | 1.89 |
| S | 0.129 | 0.169 | 0.213 |

FIG. 38

| Slag comp. (coal, %stoich.) | Nuggets | | Slag | | |
|---|---|---|---|---|---|
| | %C | %S | %Fe | %FeO | %S |
| **LHF 14** (2600°F) | | | | | |
| $L_{1.5}FS_1$ (115%) | 2.92 | 0.203 | 6.3 | 6.70 | 0.129 |
| **LHF 15** (2600°F) | | | | | |
| $L_{1.5}FS_1$ (115%) | 2.70 | 0.266 | 6.7 | 7.18 | 0.169 |
| **LHF 17** (2600°F) | | | | | |
| $L_{1.5}FS_2$ (115%) | 3.15 | 0.152 | 6.0 | 6.31 | 0.213 |
| **LHF 21** (2625°F) | | | | | |
| $L_{1.5}FS_{1.5}$ (115%) | 2.98 | 0.213 | 6.5 | 6.66 | 0.17 |
| $L_{1.5}FS_{1.5}$ (120%) | 3.06 | 0.215 | 6.3 | 6.41 | 0.17 |
| $L_{1.5}FS_2$ (115%) | 3.63 | 0.114 | 3.2 | 2.75 | 0.28 |
| $L_{1.5}FS_2$ (120%) | 3.24 | 0.195 | 4.1 | 3.83 | 0.31 |
| **LHF 22** (2625°F) | | | | | |
| $L_{1.5}FS_1SC_1$(120%) | 3.05 | 0.169 | 4.2 | 4.06 | 0.21 |
| $L_{1.5}FS_2SC_1$(125%) | 3.22 | 0.162 | 2.8 | 2.27 | 0.31 |
| $L_{1.5}FS_2SC_2$(125%) | 3.49 | 0.117 | 3.0 | 2.51 | 0.33 |

FIG. 39

| Test No. | Zone 3 Temp. °F | Zone 3 Time, min** | Zone 3 %CO |
|---|---|---|---|
| 16 | 2600 | 40 | 2.9 → 3.8 |
| 17 | 2600 | 20 | 3.1 → 4.0 |
| 18* | 2600 | 30 | 1.6 → 3.9 |
| 19 | 2600 | 20 | 1.6 → 2.9 |
| 20 | 2625 | 25 | 1.3 → 2.7 |
| 21 | 2625 | 25 | 1.4 → 3.0 |
| 22 | 2625 | 25 | 0.9 → 3.0 |

* $O_2$ concentrations high and the products were unsatisfactory.
** In Zone 2, the pallets were kept at 2100°F for 5 minutes, except for Test 22, in which the time at 2100°F was 3 minutes.

FIG. 40

| Slag comp. | Test No. | Zone 3 Temp., °F | Coal % stoich. | % micro nuggets |
|---|---|---|---|---|
| $L_{1.5}FS_1$ | 15 | 2600 | 105 | 10.6 |
| | 14 | 2600 | 110 | 10.6 |
| | 14 | 2600 | 115 | 17.1 |
| | 15 | 2600 | 115 | 12.6 |
| | 14 | 2600 | 120 | 15.0 |
| | 14 | 2600 | 125 | 16.2 |
| $L_{1.5}FS_{1.5}$ | 21 | 2625 | 115 | 12.7 |
| | 21 | 2625 | 120 | 8.6 |
| $L_{1.5}FS_2$ | 17 | 2600 | 105 | 12.0 |
| | 17 | 2600 | 110 | 12.3 |
| | 17 | 2600 | 115 | 11.9 |
| | 21 | 2625 | 115 | 10.3 |
| | 21 | 2625 | 120 | 8.7 |
| $L_{1.5}FS_3$ | 17 | 2600 | 115 | 12.4 |

FIG. 41

METHOD AND SYSTEM FOR PRODUCING METALLIC IRON NUGGETS

CROSS-REFERENCE TO RELATED APPLICATIONS

This application is a divisional of and claims the benefit of U.S. application Ser. No. 11/296,198, filed Dec. 7, 2005, now U.S. Pat. No. 7,695,544 which claims priority from provisional application Ser. No. 60/633,886, filed Dec. 7, 2004, the disclosures both of which are incorporated herein by reference.

GOVERNMENT INTERESTS

The present invention was made with support by the Economic Development Administration, Grant No. 06-69-04501. The United States government has certain rights in the invention.

BACKGROUND OF THE INVENTION

The present invention relates to the reduction of metal bearing material (e.g., the reduction of iron bearing material such as iron ore).

Many different iron ore reduction processes have been described and/or used in the past. The processes may be traditionally classified into direct reduction processes and smelting reduction processes. Generally, direct reduction processes convert iron ores into a solid state metallic form with, for example, use of shaft furnaces (e.g., natural gas-based shaft furnaces), whereas smelting reduction converts iron ores into molten hot metal without the use of blast furnaces.

Many of the conventional reduction processes for production of direct reduced iron (DRI) are either gas-based processes or coal-based processes. For example, in the gas-based process, direct reduction of iron oxide (e.g., iron ores or iron oxide pellets) employs the use of a reducing gas (e.g., reformed natural gas) to reduce the iron oxide and obtain DRI. Methods of making DRI have employed the use of materials that include carbon (e.g., coal, charcoal, etc.) as a reducing agent. For example, coal-based methods include the SL-RN method described in, for example, the reference entitled "Direct reduction down under: the New Zealand story", D. A. Bold, et al., Iron Steel International, Vol. 50, 3, pp. 145 and 147-52 (1977), or the FASTMET® method described in, for example, the reference entitled "Development of FASTMET® as a New Direct Reduction Process," by Miyagawa et al., 1998 ICSTI/IRONMAKING Conference Proceedings, pp. 877-881.

Another reduction process in between gas-based or coal-based direct reduction processing and smelting reduction processing may be referred to as fusion reduction. Fusion reduction processes have been described in, for example, the reference entitled "A new process to produce iron directly from fine ore and coal," by Kobayashi et al., I&SM, pp. 19-22 (September 2001), and, for example, in the reference entitled "New coal-based process, Hi-QIP, to produce high quality DRI for the EAF," by Sawa et al., ISIJ International, Vol. 41 (2001), Supplement, pp. S17-S21. Such fusion reduction processes, generally, for example, involve the following generalized processing steps: feed preparation, drying, furnace loading, preheating, reduction, fusion/melting, cooling, product discharge, and product separation.

Various types of hearth furnaces have been described and/or used for direct reduction processing. One type of hearth furnace, referred to as a rotary hearth furnace (RHF), has been used as a furnace for coal-based production. For example, in one embodiment, the rotary hearth furnace has an annular hearth partitioned into a preheating zone, a reduction zone, a fusion zone, and a cooling zone, located along the supply side and the discharge side of the furnace. The annular hearth is supported in the furnace so as to move rotationally. In operation, for example, raw material comprising a mixture, for example, of iron ore and reduction material is charged onto the annular hearth and provided to the preheat zone.

After preheating, through rotation, the iron ore mixture on the hearth is moved to the reduction zone where the iron ore is reduced in the presence of reduction material into reduced and fused iron (e.g., metallic iron nuggets) with use of one or more heat sources (e.g., gas burners). The reduced and fused product, after completion of the reduction process, is cooled in the cooling zone on the rotating hearth for preventing oxidation and facilitating discharge from the furnace.

Various rotary hearth furnaces for use in direct reduction processes have been described. For example, one or more embodiments of such furnaces are described in U.S. Pat. No. 6,126,718 to Sawa et al., issued 3 Oct. 2000 and entitled "Method of Producing a Reduced Metal, and Traveling Hearth Furnace for Producing Same." Further, for example, other types of hearth furnaces have also been described. For example, a paired straight hearth (PSH) furnace is described in U.S. Pat. No. 6,257,879B1 to Lu et al., issued 10 Jul. 2001, entitled "Paired straight hearth (PSH) furnaces for metal oxide reduction," as well as a linear hearth furnace (LHF) described in U.S. Provisional Patent Application No. 60/558,197, filed 31 Mar. 2004 and entitled, "Linear hearth furnace system and methods regarding same."

Natural gas-based direct reduced iron accounts for over 90% of the world's production. Coal-based processes are generally used to produce the remaining amount of direct reduced iron. However, in many geographical regions, the use of coal may be more desirable because coal prices may be more stable than natural gas prices. Further, many geographical regions are far away from steel mills which use the processed product. Therefore, shipment of iron units in the form of metallized iron nuggets produced by a coal-based fusion reduction process may be more desirable than use of a smelting reduction process.

Generally, metallic iron nuggets are characterized by high grade, essentially 100% metal (e.g., about 96% to about 97% metallic Fe). Such metallic iron nuggets are desirable in many circumstances, for example, at least relative to taconite pellets, which may contain 30% oxygen and 5% gangue. Metallic iron nuggets are low in gangue because silicon dioxide has been removed as slag. As such, with metallic iron nuggets, there is less weight to transport. Further, unlike conventional direct reduced iron, metallic iron nuggets have low oxidation rates because they are solid metal and have little or no porosity. In addition, generally, such metallic iron nuggets are just as easy to handle as iron ore pellets.

One exemplary metallic iron nugget fusion process for producing metallic iron nuggets is referred to as ITmk3. For example, in such a process, dried balls formed using iron ore, coal, and a binder, are fed to furnace (e.g., a rotary hearth furnace). As the temperature increases in the furnace, the iron ore concentrate is reduced and fuses when the temperature reaches between 1450° C. to 1500° C. The resulting products are cooled and then discharged. The cooled products generally include pellet-sized metallic iron nuggets and slag which are broken apart and separated. For example, such metallic iron nuggets produced in such a process are typically about one-quarter to three-eighths inch in size and are reportedly analyzed to include about 96 percent to about 97 percent metallic Fe and about 2.5 percent to about 3.5 percent carbon. For example, one or more embodiments of such a method are described in U.S. Pat. No. 6,036,744 to Negami et al., entitled "Method and apparatus for making metallic iron," issued 14 Mar. 2000 and U.S. Pat. No. 6,506,231 to Negami et al., entitled "Method and apparatus for making metallic iron," issued 14 Jan. 2003.

Further, another metallic iron nugget process has also been reportedly used for producing metallic iron. For example, in this process, a pulverized anthracite layer is spread over a hearth and a regular pattern of dimples is made therein. Then, a layer of iron ore and coal mixture is placed and heated to 1500° C. The iron ore is reduced to metallic iron, fused, and collected in the dimples as iron pebbles and slag. Then, the iron pebbles and slag are broken apart and separated. One or more embodiments of such a process are described in U.S. Pat. No. 6,270,552 to Takeda et al., entitled "Rotary hearth furnace for reducing oxides, and method of operating the furnace," issued 7 Aug. 2001. Further, for example, various embodiments of this process (referred to as the Hi-QIP process) which utilize the formation of cup-like depressions in a solid reducing material to obtain a reduced metal are described in U.S. Pat. No. 6,126,718 to Sawa et al.

Such metallic iron nugget formation processes, therefore, involve mixing of iron-bearing materials and pulverized coal (e.g., a carbonaceous reductant). For example, either with or without forming balls, iron ore/coal mixture is fed to a hearth furnace (e.g., a rotary hearth furnace) and heated to a temperature reportedly 1450° C. to approximately 1500° C. to form fused direct reduced iron (i.e., metallic iron nuggets) and slag. Metallic iron and slag can then be separated, for example, with use of mild mechanical action and magnetic separation techniques.

Other reduction processes for producing reduced iron are described in, for example, U.S. Pat. No. 6,210,462 to Kikuchi et al., entitled "Method and apparatus for making metallic iron," issued 3 Apr. 2001 and U.S. Patent Application No. US2001/0037703 A1 to Fuji et al., entitled "Method for producing reduced iron," published 8 Nov. 2001. For example, U.S. Pat. No. 6,210,462 to Kikuchi et al. describes a method where preliminary molding of balls is not required to form metallic iron.

However, there are various concerns regarding such iron nugget processes. For example, one major concern of one or more of such processes involves the prevention of slag from reacting with the hearth refractory during such processing. Such a concern may be resolved by placing a layer of pulverized coke or other carbonaceous material on the hearth refractory to prevent the penetration of slag from reacting with the hearth refractory.

Another concern with regard to such metallic iron nugget production processes is that very high temperatures are necessary to complete the process. For example, as reported, such temperatures are in the range of 1450° C. to about 1500° C. This is generally considered fairly high when compared to taconite pelletization carried out at temperatures in the range of about 1288° C. to about 1316° C. Such high temperatures adversely affect furnace refractories, maintenance costs, and energy requirements.

Yet another problem is that sulfur is a major undesirable impurity in steel. However, carbonaceous reductants utilized in metallic iron nugget formation processes generally include sulfur resulting in such an impurity in the nuggets formed.

Further, at least in ITmk3 processes, a prior ball formation process utilizing a binder is employed. For example, iron ore is mixed with pulverized coal and a binder, balled, and then heated. Such a preprocessing (e.g., ball forming) step which utilizes binders adds undesirable cost to a metallic iron nugget production process.

Still further, various steel production processes prefer certain size nuggets. For example, furnace operations that employ conventional scrap charging practices appear to be better fed with large-sized iron nuggets. Other operations that employ direct injection systems for iron materials indicate that a combination of sizes may be important for their operations.

A previously described metallic iron nugget production method that starts with balled feed uses balled iron ore with a maximum size of approximately three-quarter inch diameter dried balls. These balls shrink to iron nuggets of about three-eighths inch in size through losses of oxygen from iron during the reduction process, by the loss of coal by gasification, with loss of weight due to slagging of gangue and ash, and with loss of porosity. Nuggets of such size, in many circumstances, may not provide the advantages associated with larger nuggets that are desirable in certain furnace operations.

SUMMARY OF THE INVENTION

The methods and systems according to the present invention provide for one more various advantages in the reduction processes, e.g., production of metallic iron nuggets. For example, such methods and systems may provide for controlling iron nugget size (e.g., using mounds of feed mixture with channels filled at least partially with carbonaceous material), may provide for control of micro-nugget formation (e.g., with the treatment of hearth material layers), may provide for control of sulfur in the iron nuggets (e.g., with the addition of a fluxing agent to the feed mixture), etc.

One embodiment of a method for use in production of metallic iron nuggets according to the present invention includes providing a hearth including refractory material and providing a hearth material layer on the refractory material (e.g., the hearth material layer includes at least carbonaceous material or carbonaceous material coated with $Al(OH)_3$, $CaF_2$ or the combination of $Ca(OH)_3$ and $CaF_2$). A layer of a reducible mixture is provided on at least a portion of the hearth material layer (e.g., the reducible mixture includes at least reducing material and reducible iron bearing material). A plurality of channel openings extend at least partially into the layer of the reducible mixture to define a plurality of nugget forming reducible material regions (e.g., one or more of the plurality of nugget forming reducible material regions may include a mound of the reducible mixture that includes at least one curved or sloped portion, such as a dome-shaped mound or a pyramid-shaped mound of the reducible mixture). The plurality of channel openings are at least partially filled with nugget separation fill material (e.g., the nugget separation fill material includes at least carbonaceous material). The layer of reducible mixture is thermally treated to form one or more metallic iron nuggets (e.g., metallic iron nuggets that include a maximum length across the maximum cross-section that is greater than about 0.25 inches and less than about 4.0 inches) in one or more of the plurality of the nugget forming reducible material regions (e.g., form a single metallic iron nugget in each of one or more of the plurality of the nugget forming reducible material regions).

In various embodiments, the layer of a reducible mixture may be a layer of reducible micro-agglomerates (e.g., where at least 50 percent of the layer of reducible mixture comprises micro-agglomerates having a average size of about 2 millimeters or less), or may be a layer of compacts (e.g., briquettes, half-briquettes, compacted mounds, compaction profiles formed in layer of reducible material, etc.).

Yet further, the layer of a reducible mixture on the hearth material layer may include multiple layers where the average size of the reducible micro-agglomerates of at least one provided layer is different relative to the average size of micro-agglomerates previously provided (e.g., the average size of the reducible micro-agglomerates of at least one of the provided layers is less than the average size of micro-agglomerates of a first layer provided on the hearth material layer).

In addition, a stoichiometric amount of reducing material is the amount necessary for complete metallization and formation of metallic iron nuggets from a predetermined quantity of reducible iron bearing material. In one or more embodiments of the method providing the layer of a reducible mixture on the hearth material layer may include providing a first layer of reducible mixture on the hearth material layer that includes a predetermined quantity of reducible iron bearing material and between about 70 percent and about 90 percent of said stoichiometric amount of reducing material necessary for complete metallization thereof, and providing one or more additional layers of reducible mixture that includes a predetermined quantity of reducible iron bearing material and between about 105 percent and about 140 percent of said stoichiometric amount of reducing material necessary for complete metallization thereof.

In yet another embodiment of the method, thermally treating the layer of reducible mixture includes thermally treating the layer of reducible mixture at a temperature less than 1450 degrees centigrade such that the reducible mixture in the nugget forming reducible material regions is caused to shrink and separate from other adjacent nugget forming reducible material regions. More preferably, the temperature is less than 1400° C.; even more preferably, the temperature is below 1390° C.; even more preferably, the temperature is below 1375° C.; and most preferably, the temperature is below 1350° C.

Yet further, in one or more embodiments of the method, the reducible mixture may further include at least one additive selected from the group consisting of calcium oxide, one or more compounds capable of producing calcium oxide upon thermal decomposition thereof (e.g., limestone), sodium oxide, and one or more compounds capable of producing sodium oxide upon thermal decomposition thereof. In addition, in one or more embodiments, the reducible mixture may include soda ash, $Na_2CO_3$, $NaHCO_3$, NaOH, borax, NaF, and/or aluminum smelting industry slag. Still further, one or more embodiments of the reducible mixture may include at least one fluxing agent selected from the group consisting of fluorspar, $CaF_2$, borax, NaF, and aluminum smelting industry slag.

Another method for use in production of metallic iron nuggets according to the present invention includes providing a hearth that includes refractory material and providing a hearth material layer on the refractory material (e.g., the hearth material layer may include at least carbonaceous material). A layer of reducible micro-agglomerates is provided on at least a portion of the hearth material layer, where at least 50 percent of the layer of reducible micro-agglomerates comprise micro-agglomerates having a average size of about 2 millimeters or less. The reducible micro-agglomerates are formed from at least reducing material and reducible iron bearing material. The layer of reducible micro-agglomerates is thermally treated to form one or more metallic iron nuggets.

In one or more embodiments of the method, the layer of reducible micro-agglomerates is provided by a first layer of reducible micro-agglomerates on the hearth material layer and by providing one or more additional layers of reducible micro-agglomerates on the first layer. The average size of the reducible micro-agglomerates of at least one of the provided additional layers is different relative to the average size of micro-agglomerates previously provided (e.g., the average size of the reducible micro-agglomerates of at least one of the provided additional layers is less than the average size of micro-agglomerates of the first layer).

Further, in one or more embodiments of the method, the first layer of reducible micro-agglomerates on the hearth material layer includes a predetermined quantity of reducible iron bearing material and between about 70 percent and about 90 percent of said stoichiometric amount of reducing material necessary for complete metallization thereof, and the provided additional layers of reducible micro-agglomerates include a predetermined quantity of reducible iron bearing material and between about 105 percent and about 140 percent of said stoichiometric amount of reducing material necessary for complete metallization thereof.

Yet further, in one or more embodiments of the method, providing the layer of reducible micro-agglomerates includes forming the reducible micro-agglomerates using at least water, reducing material, reducible iron bearing material, and one or more additives selected from the group consisting of calcium oxide, one or more compounds capable of producing calcium oxide upon thermal decomposition thereof, sodium oxide, and one or more compounds capable of producing sodium oxide upon thermal decomposition thereof. Further, the reducible micro-agglomerates may include at least one additive selected from the group consisting of soda ash, $Na_2CO_3$, $NaHCO_3$, NaOH, borax, NaF, and aluminum smelting industry slag or at least one fluxing agent selected from the group consisting of fluorspar, $CaF_2$, borax, NaF, and aluminum smelting industry slag.

In one preferred embodiment, a method for use in production of metallic iron nuggets comprising the steps of: providing a hearth comprising refractory material; providing a hearth material layer on the refractory material, the hearth material layer comprising at least carbonaceous material coated with one of $Al(OH)_3$, $CaF_2$ or the combination of $Ca(OH)_3$ and $CaF_2$; providing a layer of a reducible mixture on at least a portion of the hearth material layer, at least a portion of the reducible mixture comprising at least reducing material and reducible iron bearing material; the reducible mixture comprising at least one additive selected from the group consisting of calcium oxide, one or more compounds capable of producing calcium oxide upon thermal decomposition thereof, sodium oxide, and one or more compounds capable of producing sodium oxide upon thermal decomposition thereof; forming a plurality of channel openings extending at least partially into the layer of the reducible mixture to define a plurality of nugget forming reducible material regions having a density less than about 2.4; at least partially filling the plurality of channel openings with nugget separation fill material comprising at least carbonaceous material; and thermally treating the layer of reducible mixture at a temperature of less than 1450° C. to form one or more metallic iron nuggets in one or more of the plurality of the nugget forming reducible material regions is provided.

Yet another method for use in production of metallic iron nuggets according to the present invention includes providing a hearth that includes refractory material and providing a hearth material layer on at least a portion of the refractory material (e.g., the hearth material layer may include at least carbonaceous material). A reducible mixture is provided on at least a portion of the hearth material layer (e.g., the reducible mixture includes at least reducing material and reducible iron bearing material). A stoichiometric amount of reducing material is the amount necessary for complete metallization and formation of metallic iron nuggets from a predetermined quantity of reducible iron bearing material. In one embodiment, providing the reducible mixture on the hearth material layer includes providing a first portion of reducible mixture on the hearth material layer that includes a predetermined quantity of reducible iron bearing material and between about 70 percent and about 90 percent of said stoichiometric amount of reducing material necessary for complete metallization thereof, and providing one or more additional portions of reducible mixture that comprise a predetermined quantity of reducible iron bearing material and between about 105 percent and about 140 percent of said stoichiometric amount of reducing material necessary for complete metallization thereof. The reducible mixture is then thermally treated to form one or more metallic iron nuggets. For certain applications, the hearth layer might not be used, or the hearth layer might not contain any carbonaceous material.

In one embodiment of the method, a plurality of channel openings extend at least partially into the reducible mixture and define a plurality of nugget forming reducible material regions, and further where the channel openings are at least partially filled with nugget separation fill material.

In yet another embodiment of the method, providing the first portion of a reducible mixture on the hearth material layer includes providing a first layer of reducible micro-agglomerates on the hearth material layer and where providing one or more additional portions includes providing one or more additional layers of reducible micro-agglomerates on the first layer, where the average size of the reducible micro-agglomerates of at least one of the provided additional layers is different relative to the average size of micro-agglomerates previously provided.

In another embodiment, providing reducible mixture on the hearth material layer includes providing compacts of the reducible mixture. For example, a first portion of each of one or more compacts includes a predetermined quantity of reducible iron bearing material and between about 70 percent and about 90 percent of said stoichiometric amount of reducing material necessary for complete metallization thereof, and one or more additional portions of each of one or more of compacts includes a predetermined quantity of reducible iron bearing material and between about 105 percent and about 140 percent of said stoichiometric amount of reducing material necessary for complete metallization thereof.

Yet further, in another embodiment of the method, the compacts may include at least one of briquettes (e.g., three layer briquettes), half-briquettes (e.g., two layers of compacted reducible mixture, balls, compacted mounds of the reducible mixture comprising at least one curved or sloped portion, compacted dome-shaped mounds of the reducible mixture, and compacted pyramid-shaped mounds of the reducible mixture. The reducible mixture may even be multilayered balls of reducible mixture. In one embodiment, the mounds have a density of about 1.9-2, the balls have a density of about 2.1 and briquettes have a density of about 2.1. In one embodiment, the reducible material has a density less than about 2.4. In a preferred embodiment, the reducible material has a density between about 1.4 and 2.2.

Still further, yet another method for use in production of metallic iron nuggets is described herein. The method includes providing a hearth that includes refractory material and providing a hearth material layer on at least a portion of the refractory material. The hearth material layer includes at least carbonaceous material. Reducible mixture is provided on at least a portion of the hearth material layer. The reducible mixture includes: reducing material; reducible iron bearing material; one or more additives selected from the group consisting of calcium oxide, one or more compounds capable of producing calcium oxide upon thermal decomposition thereof, sodium oxide, and one or more compounds capable of producing sodium oxide upon thermal decomposition thereof; and at least one fluxing agent selected from the group consisting of fluorspar, $CaF_2$, borax, NaF, and aluminum smelting industry slag. The reducible mixture is thermally treated (e.g., at a temperature less than about 1450 degrees centigrade) to form one or more metallic iron nuggets.

In one or more embodiments of the method, the reducible mixture may include at least one additive selected from the group consisting of calcium oxide and limestone. In other embodiments of the method, the reducible mixture may include at least one additive selected from the group consisting of soda ash, $Na_2CO_3$, $NaHCO_3$, NaOH, borax, NaF, and aluminum smelting industry slag. Yet further, the hearth material layer may include carbonaceous material coated with $Al(OH)_3$, $CaF_2$ or the combination of $Ca(OH)_3$ and $CaF_2$.

Yet further, in one or more embodiments of the method, the reducible mixture may include one or more mounds of reducible mixture including at least one curved or sloped portion; may include reducible micro-agglomerates or multiple layers thereof having different composition; may include compacts such as one of briquettes, half-briquettes, balls, compacted mounds of the reducible mixture comprising at least one curved or sloped portion, compacted dome-shaped mounds of the reducible mixture, and compacted pyramid-shaped mounds of the reducible mixture; or may include balls (e.g., dried balls) or multiple layered balls.

A system for use in production of metallic iron nuggets is also described herein. For example, one embodiment of a system according to the present invention may include a hearth comprising refractory material for receiving a hearth material layer thereon (e.g., the hearth material layer may include at least carbonaceous material) and a charging apparatus operable to provide a layer of a reducible mixture on at least a portion of the hearth material layer. The reducible mixture may include at least reducing material and reducible iron bearing material. The system further includes a channel definition device operable to create a plurality of channel openings that extend at least partially through the layer of the reducible mixture to define a plurality of nugget forming reducible material regions and a channel fill apparatus operable to at least partially fill the plurality of channel openings with nugget separation fill material (e.g., the nugget separation fill material may include at least carbonaceous material). A furnace is also provided that is operable to thermally treat the layer of reducible mixture to form one or more metallic iron nuggets in one or more of the plurality of the nugget forming reducible material regions.

In one or more embodiments of the system, the channel definition device may be operable to create mounds of the reducible mixture that include at least one curved or sloped portion (e.g., create dome-shaped mounds or pyramid-shaped mounds of the reducible mixture).

In still yet another method for use in production of metallic iron nuggets, the method includes providing a hearth including refractory material and providing a hearth material layer (e.g., at least carbonaceous material) on at least a portion of the refractory material. Reducible mixture is provided on at least a portion of the hearth material layer. The reducible mixture includes at least reducing material and reducible iron bearing material. A stoichiometric amount of reducing material is the amount necessary for complete metallization and formation of metallic iron nuggets from a predetermined quantity of reducible iron bearing material. At least a portion of the reducible mixture includes the predetermined quantity of reducible iron bearing material and between about 70 percent and about 90 percent of said stoichiometric amount of reducing material necessary for complete metallization thereof. The method further includes thermally treating the reducible mixture to form one or more metallic iron nuggets.

In one embodiment of the method, providing reducible mixture on at least a portion of the hearth material layer includes providing one or more layers of reducible mixture on the hearth material layer. A plurality of channel openings are defined that extend at least partially into the layer of the reducible mixture and define a plurality of nugget forming reducible material regions. Further, the channel openings are at least partially filled with nugget separation fill material (e.g., carbonaceous material).

Yet further, in one or more embodiments of the method, the reducible mixture may include one or more mounds of reducible mixture including at least one curved or sloped portion; may include reducible micro-agglomerates or multiple layers thereof having different composition; may include compacts such as one of briquettes (e.g., single or multiple layer briquettes), partial-briquettes, balls, compacted mounds of the reducible mixture comprising at least one curved or sloped portion, compacted dome-shaped mounds of the reducible mixture, and compacted pyramid-shaped mounds of the reducible mixture; or may include balls (e.g., dried balls) or multiple layered balls.

Yet further, in one or more embodiments of the method, reducible mixture may include one or more additives selected from the group consisting of calcium oxide, one or more compounds capable of producing calcium oxide upon thermal decomposition thereof, sodium oxide, and one or more compounds capable of producing sodium oxide upon thermal decomposition thereof. Further, the reducible mixture may include at least one additive selected from the group consisting of soda ash, $Na_2CO_3$, $NaHCO_3$, NaOH, borax, NaF, and aluminum smelting industry slag or at least one fluxing agent selected from the group consisting of fluorspar, $CaF_2$, borax, NaF, and aluminum smelting industry slag.

Yet further, one embodiment of the method may include providing compacts, and yet further providing additional reducing material adjacent at least a portion of the compacts.

In a further embodiment of the invention, a reducible mixture comprising: reducing material; reducible iron bearing material; one or more additives selected from the group consisting of calcium oxide, one or more compounds capable of producing calcium oxide upon thermal decomposition thereof, sodium oxide, and one or more compounds capable of producing sodium oxide upon thermal decomposition thereof; and at least one fluxing agent selected from the group consisting of fluorspar, $CaF_2$, borax, NaF, and aluminum smelting industry slag is provided.

The above summary of the present invention is not intended to describe each embodiment or every implementation of the present invention. Advantages, together with a more complete understanding of the invention, will become apparent and appreciated by referring to the following detailed description and claims taken in conjunction with the accompanying drawings.

BRIEF DESCRIPTION OF THE DRAWINGS

FIG. 1 shows a block diagram of one or more general embodiments of a metallic iron nugget process according to the present invention.

FIGS. 11A-11B show preformed balls of reducible mixture for use in one or more embodiments of a metallic iron nugget process, wherein FIG. 11A shows a multi-layered ball of reducible mixture and further wherein FIG. 11B shows a cross-section of the multiple layered ball having layers of different compositions.

FIGS. 11C-11D show exemplary embodiments of formation tools for use in providing compacts (e.g., briquettes) of reducible mixture for use in one or more embodiments of a metallic iron nugget process, wherein FIG. 11C shows formation of three layer compacts, and further wherein FIG. 11D shows formation of two layer compacts.

FIGS. 11E-11F show exemplary embodiments of other formation tools for use in providing compacts (e.g., briquettes) of reducible mixture for use in one or more embodiments of a metallic iron nugget process, wherein FIG. 11E shows formation of two layer compacts, and further wherein FIG. 11F shows formation of three layer compacts.

FIG. 12A shows the mold, FIG. 12B shows a 12-segment channel pattern formed by the mold of FIG. 12A, and FIG.

12C shows a 12-segment channel pattern with grooves at least partially filled with pulverized nugget separation fill material (e.g., coke).

FIGS. 13A-13D show the effect of nugget separation fill material in channels according to one or more exemplary embodiments of a metallic iron nugget process according to the present invention.

FIGS. 14A-14D and FIGS. 15A-15D illustrate the effect of nugget separation fill material (e.g., coke) levels in channels according to one or more exemplary embodiments of a metallic iron nugget process according to the present invention.

FIG. 16 shows a table of the relative amounts of micro-nuggets generated in various metallic iron nugget processes for use in describing the treatment of the hearth material layer in one or more exemplary embodiments of a metallic iron nugget process such as that described generally in FIG. 1.

Figure 17:
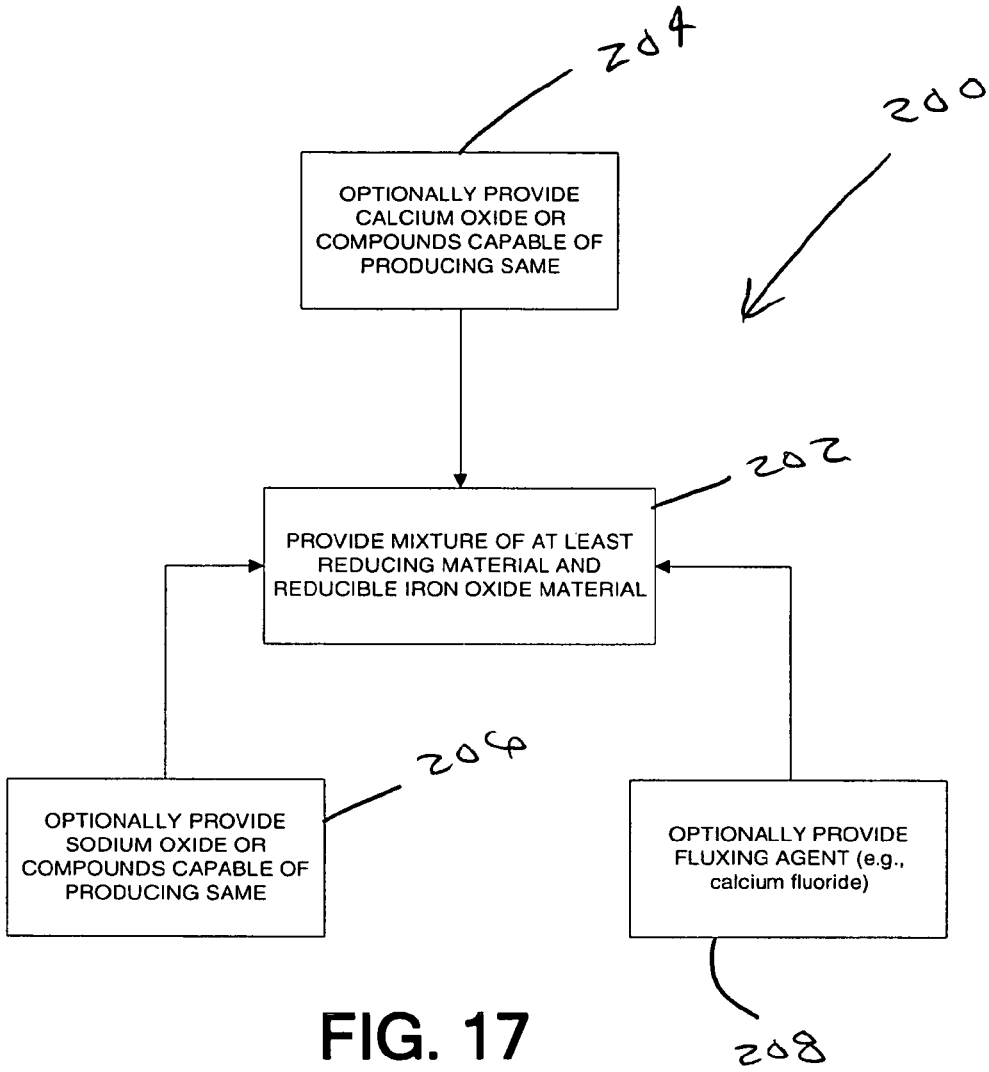

FIG. 17 shows a block diagram of one exemplary embodiment of a reducible mixture provision method for use in a metallic iron nugget process such as that shown generally in FIG. 1, and/or for use in other processes that form metallic iron nuggets.

Figure 18:
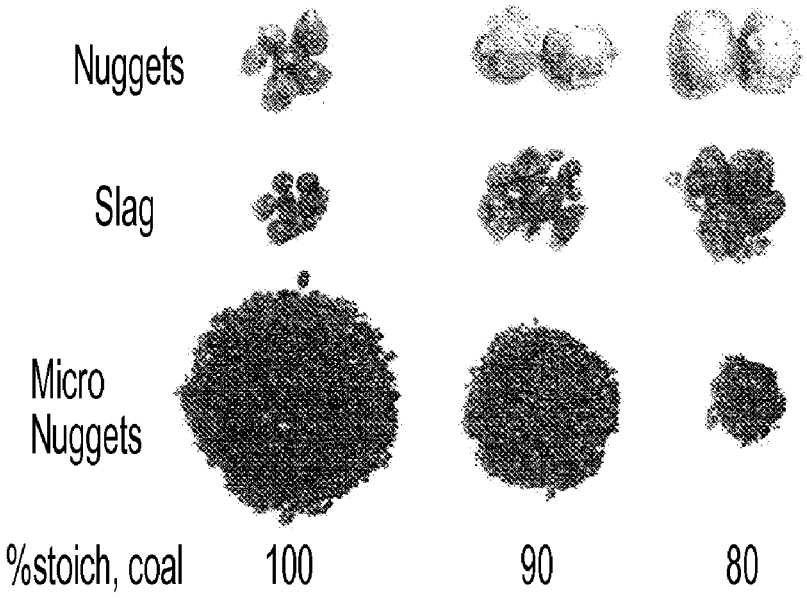
Figure 19:
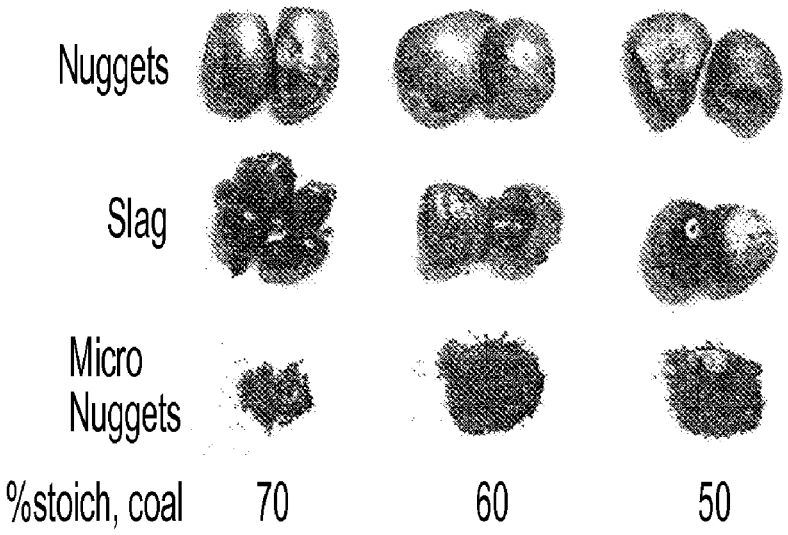

FIGS. 18-19 show the effect of use of various coal addition levels on one or more exemplary embodiments of a metallic iron nugget process such as that shown generally in FIG. 1 according to the present invention, and/or for use in other processes that form metallic iron nuggets.

Figure 20A:
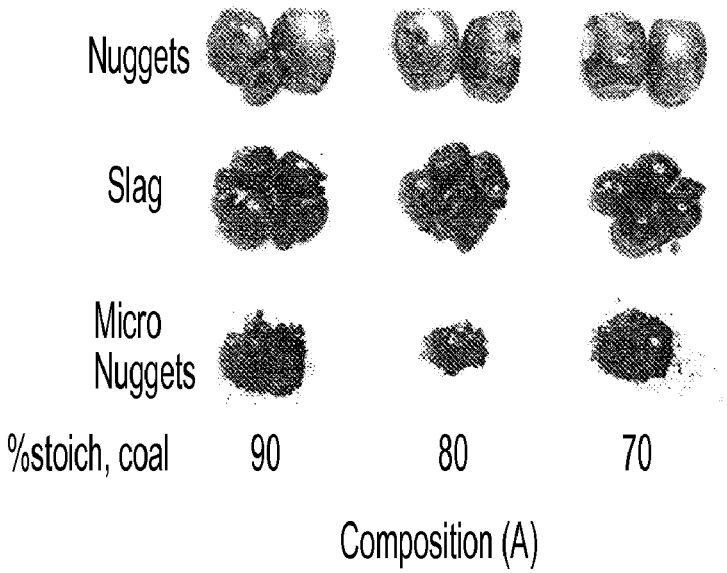
Figure 20B:
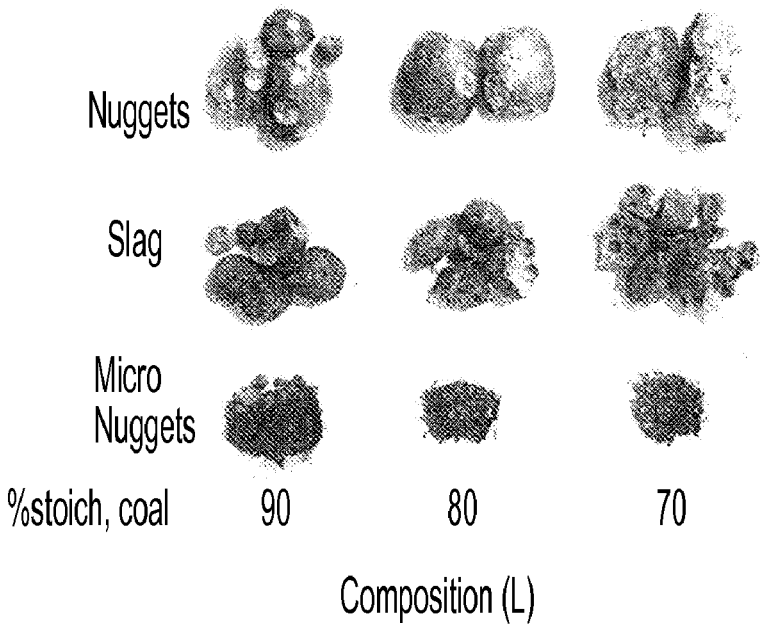

FIGS. 20A-20B show illustrations for use in describing the effect of various coal addition levels on a metallic iron nugget process such as that shown generally in FIG. 1 according to the present invention, and/or for use in other processes that form metallic iron nuggets.

Figures 21A, 21B:
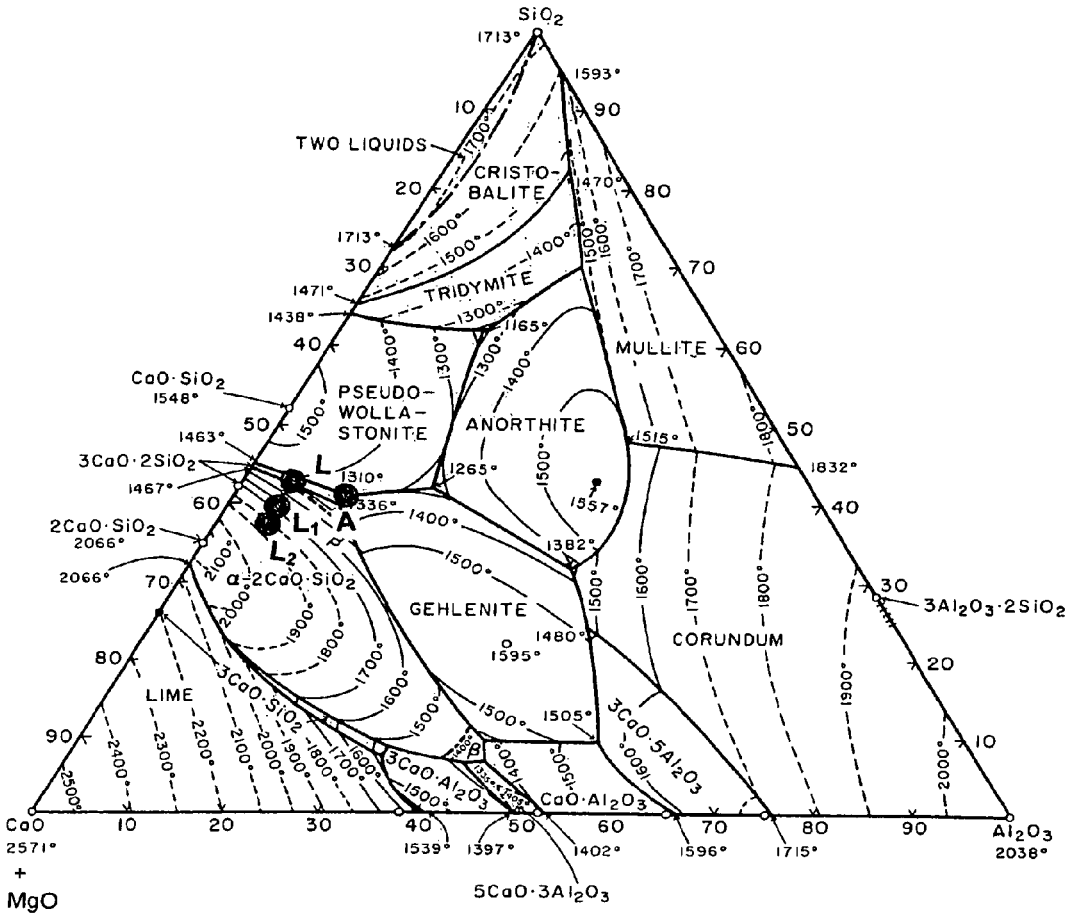

FIGS. 21A-21B show a $CaO—SiO_2—Al_2O_3$ phase diagram and a table, respectively, showing various slag compositions for use in describing the use of one or more additives to a reducible mixture in a metallic iron nugget process such as that shown generally in FIG. 1, and/or for use in other processes that form metallic iron nuggets.

FIGS. 22-24 show tables for use in describing the effect of adding calcium fluoride or fluorspar to a reducible mixture in a metallic iron nugget process such as that shown generally in FIG. 1, and/or for use in other processes that form metallic iron nuggets.

FIGS. 25-27 show an illustration, a table, and another table, respectively, for use in showing the effect of $Na_2CO_3$ and $CaF_2$ additives to a reducible mixture with respect to control of sulfur levels in one or more exemplary embodiments of a metallic iron nugget process such as that shown generally in FIG. 1, and/or for use in other processes that form metallic iron nuggets.

Figure 28:
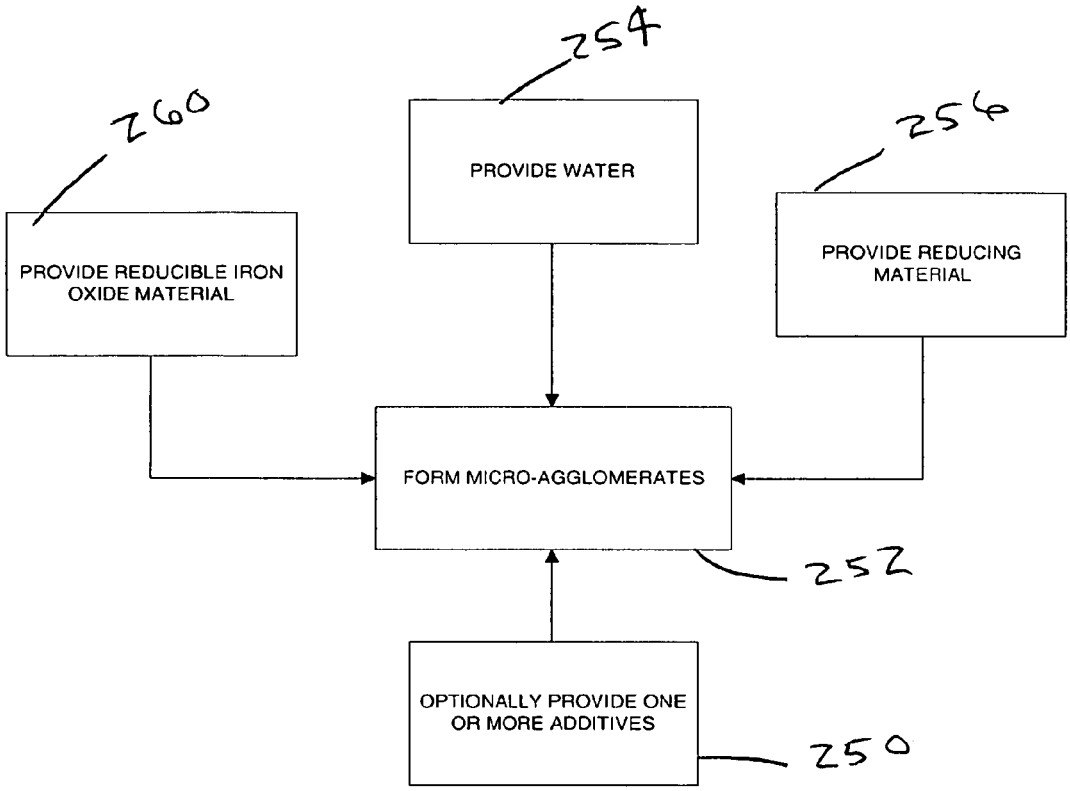

FIG. 28 shows a block diagram of one embodiment of a micro-agglomerate formation process for use in providing a reducible mixture for a metallic iron nugget process such as that shown generally in FIG. 1, and/or for use in other processes that form metallic iron nuggets.

Figure 29:
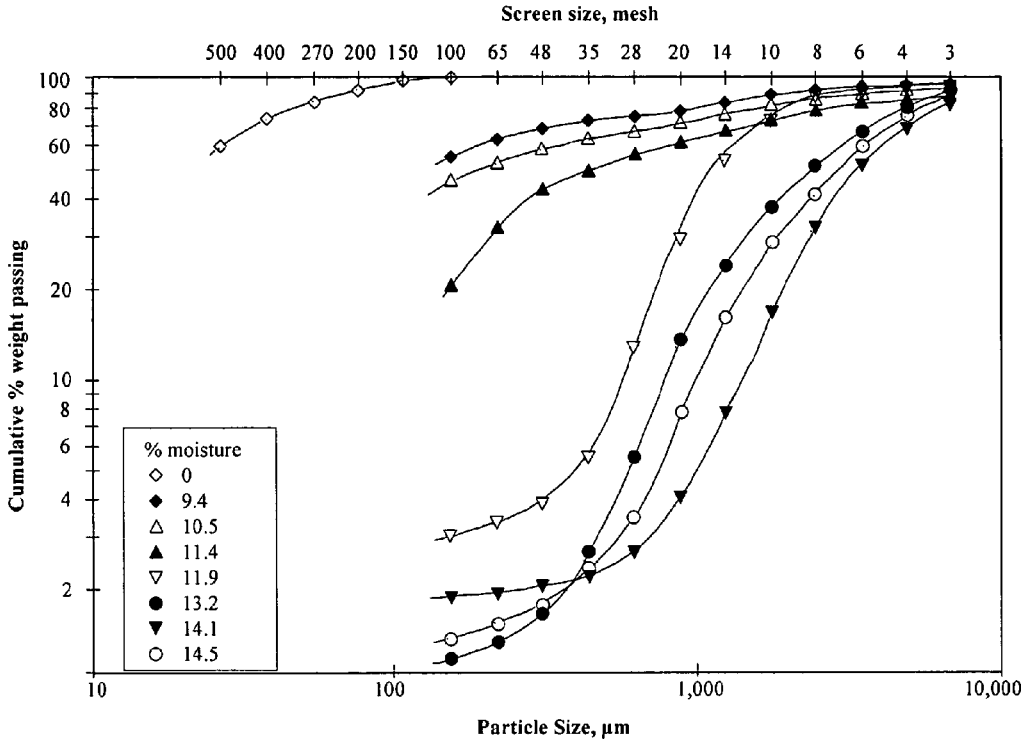

FIG. 29 is a graph showing the effect of moisture content on size distribution of micro-agglomerates such as those formed according to the process of FIG. 28.

FIG. 30 shows a table describing the terminal velocities of micro-agglomerates such as those formed according to the process shown in FIG. 28 as functions of size and air velocity.

Figure 31A:
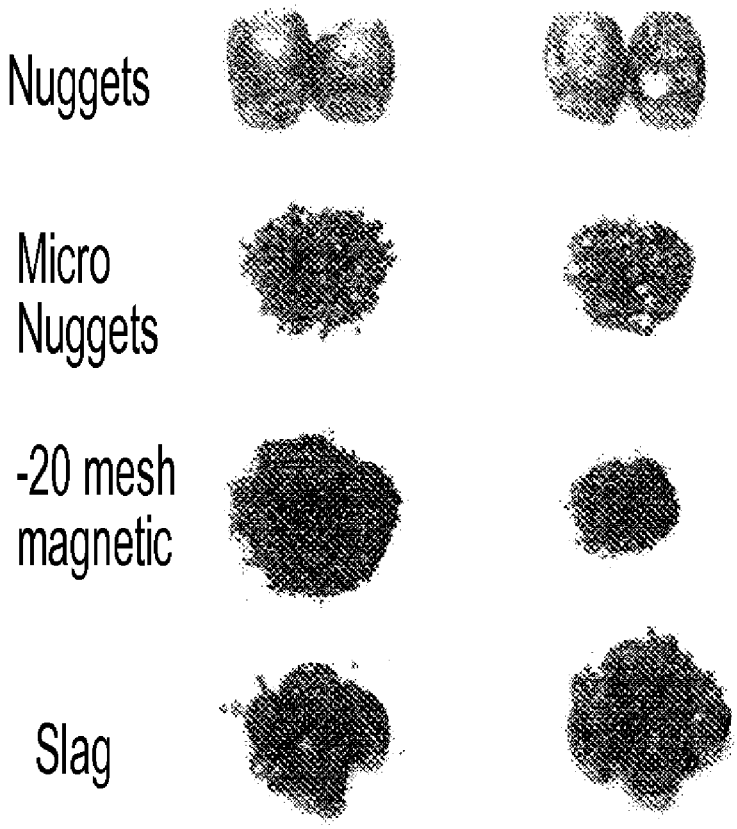

FIGS. 31A-31B show illustrations of the effect of using micro-agglomerated reducible mixture in one or more embodiments of a metallic iron nugget process such as that described generally in FIG. 1.

FIGS. 32A-32C shows tables giving the analysis of various carbonaceous reductant materials that may be used in one or more embodiments of a metallic iron nugget process such as that described generally in FIG. 1, and/or for use in other processes that form metallic iron nuggets.

FIG. 32D shows a table giving ash analysis of various carbonaceous reductant materials that may be used in one or more embodiments of a metallic iron nugget process such as that described generally in FIG. 1, and/or for use in other processes that form metallic iron nuggets.

FIG. 33 shows a table giving chemical compositions of one or more iron ores that may be used in one or more embodiments of a metallic iron nugget process such as that described generally in FIG. 1, and/or for use in other processes that form metallic iron nuggets.

FIG. 34 shows a table giving chemical compositions of one or more additives that may be used in one or more embodiments of a metallic iron nugget process such as that described generally in FIG. 1, and/or for use in other processes that form metallic iron nuggets.

Figure 2A:
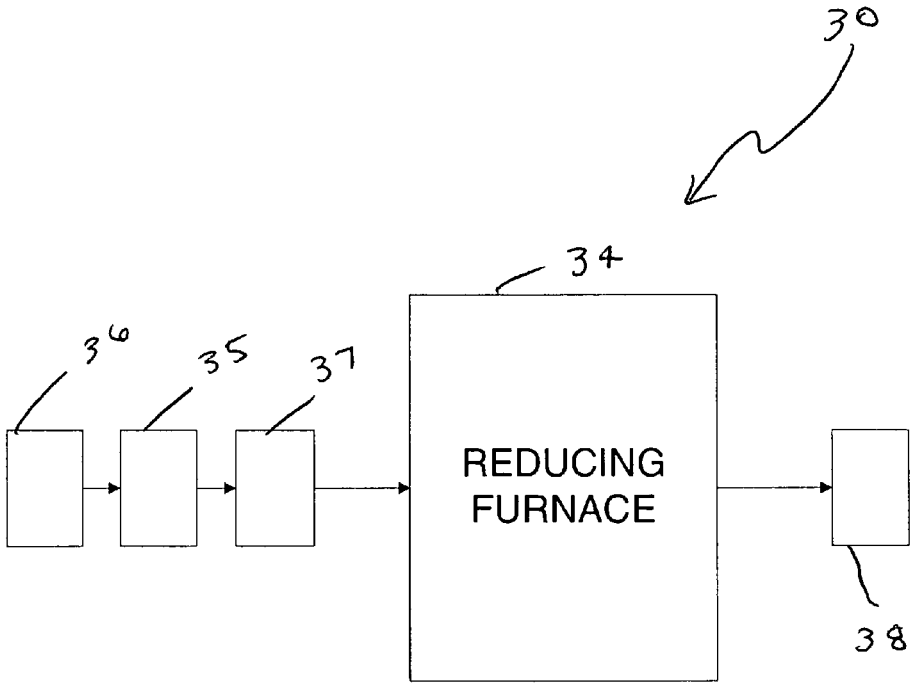
FIG. 2A is a generalized block diagram of a furnace system for implementing a metallic iron nugget process such as that shown generally in FIG. 1 according to the present invention.
Figure 2B:
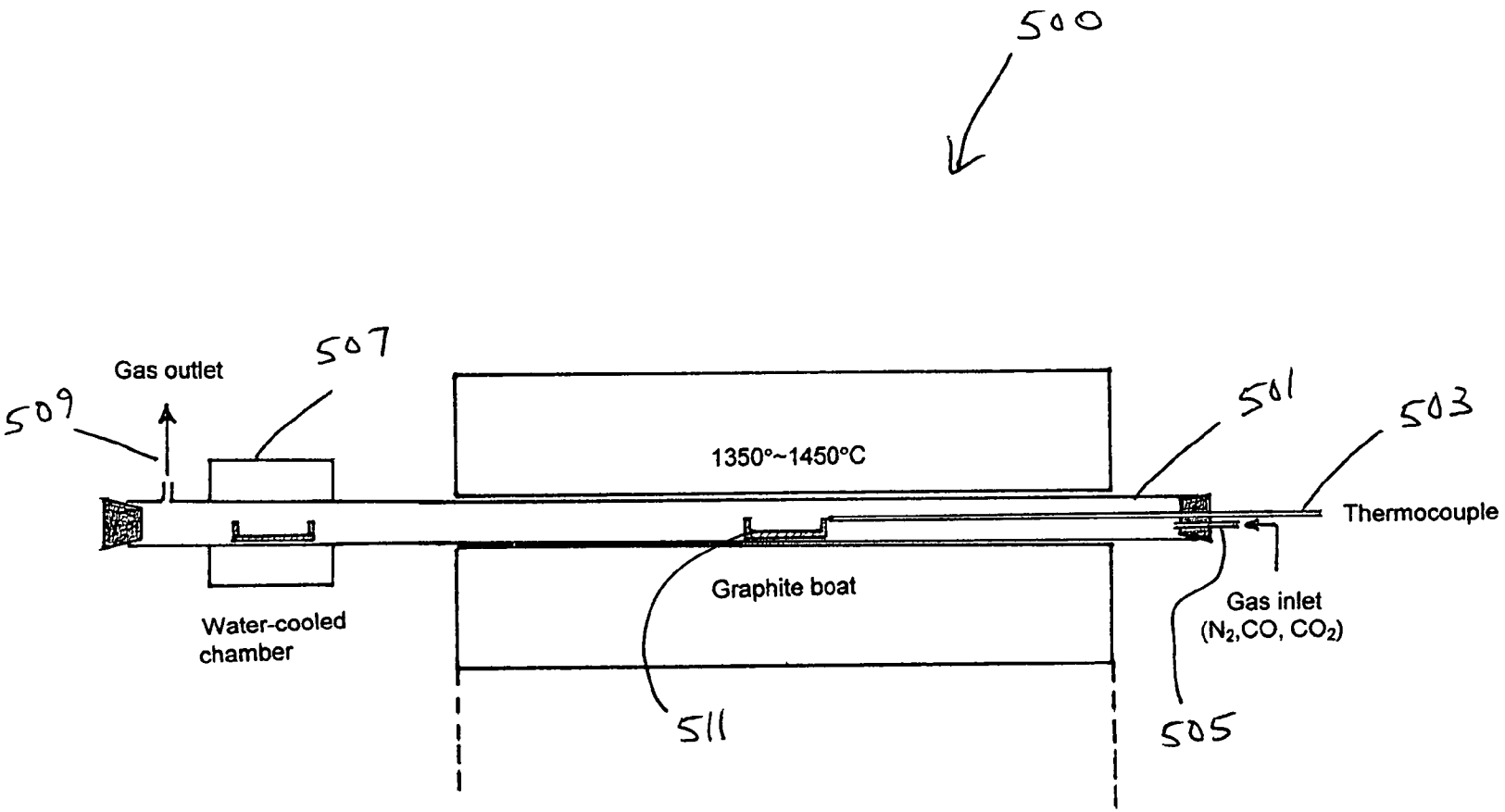
FIGS. 2B-2D are diagrams of two laboratory furnaces (e.g., a tube furnace and a box-type furnace, respectively) and a linear hearth furnace that may be used to carry out one or more processes described herein, such as processing employed in one or more examples described herein.
Figure 2C:
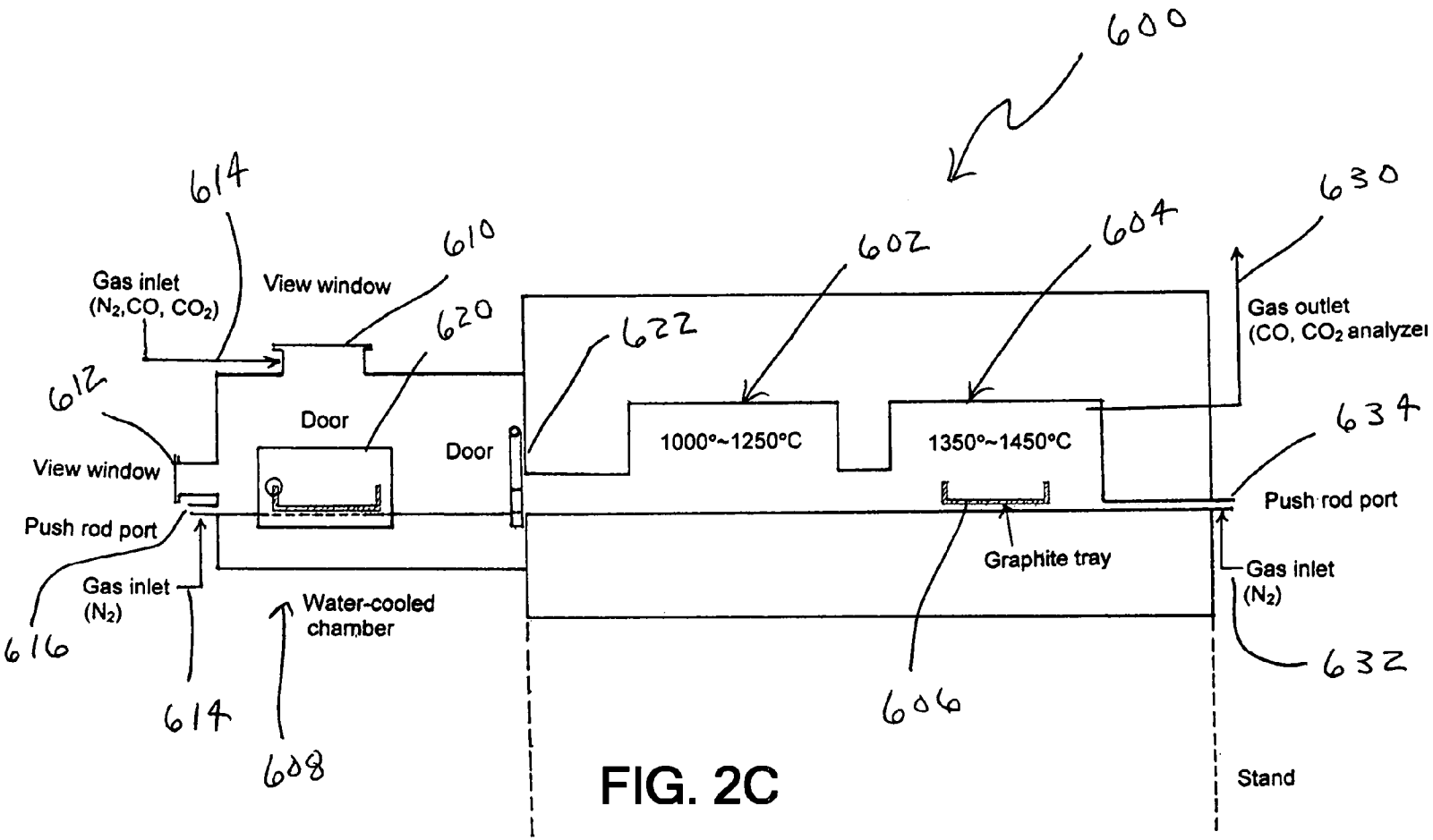
Figure 2D:
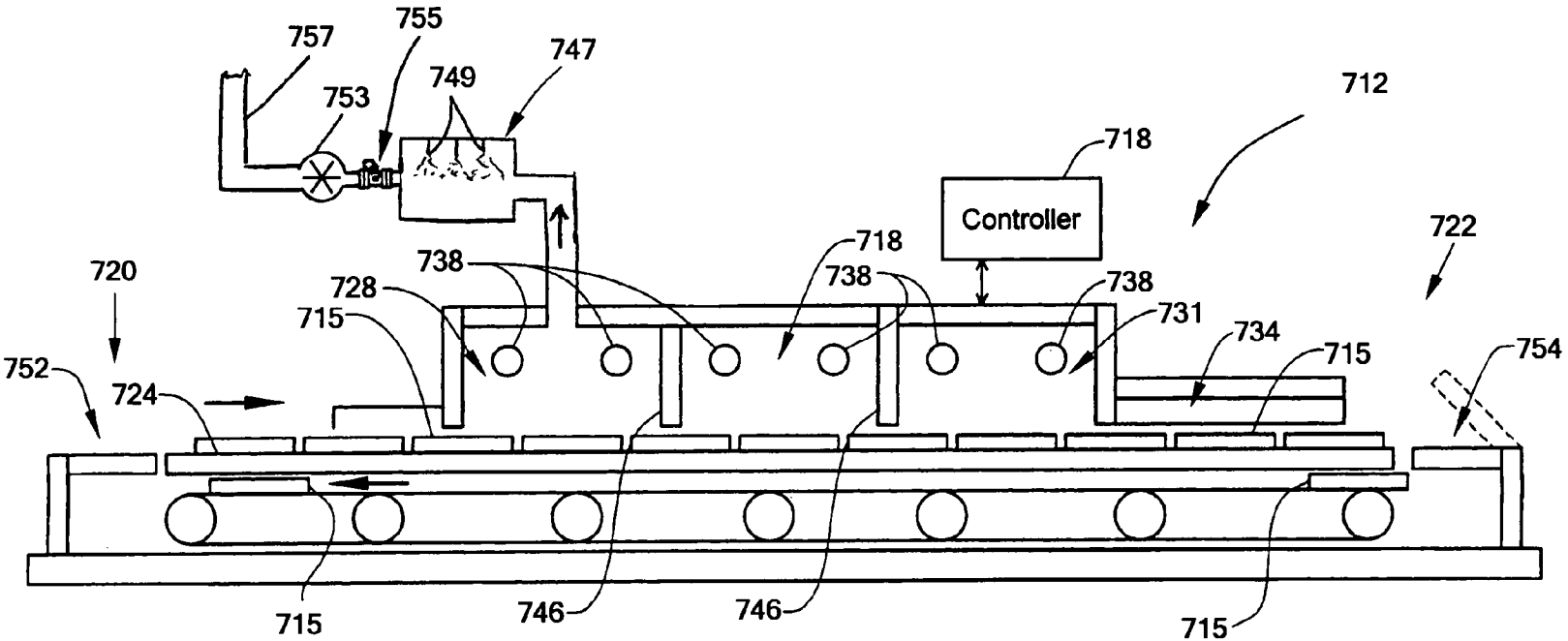
Figure 35A:
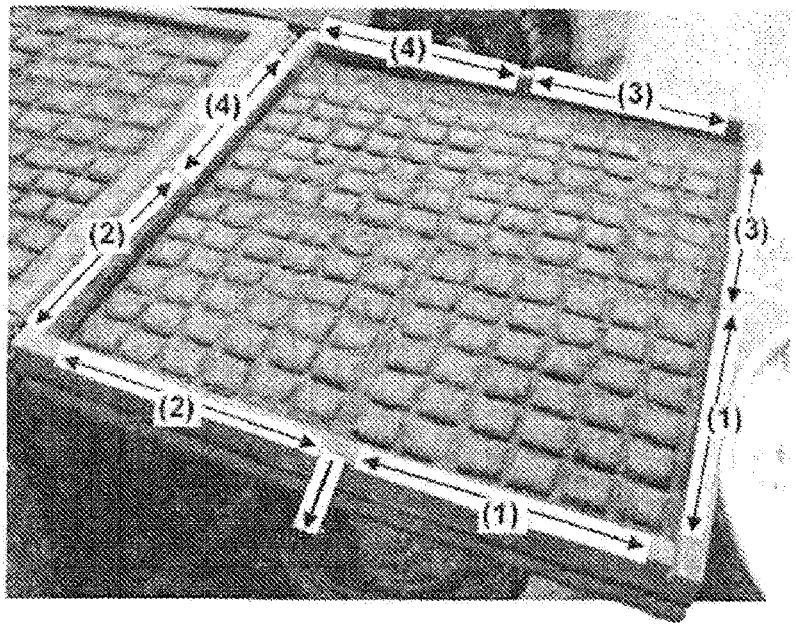
Figure 35B:
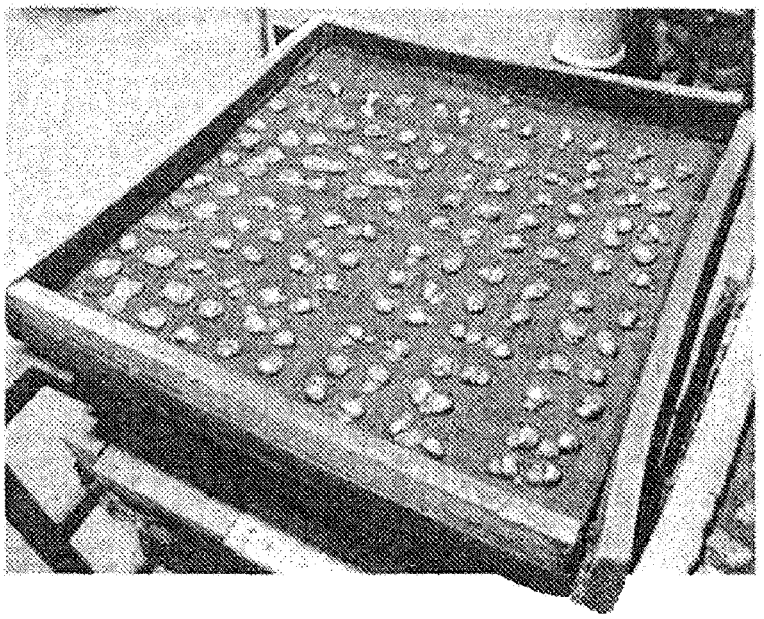

FIGS. 35A and 35B show a pallet with an arrangement of different feed mixtures therein for use in describing one or more tests employing a linear hearth furnace such as that shown in FIG. 2D, and the resulting product from a typical test.

FIG. 36 is a table showing analytical results of furnace gases for use in describing one or more tests employing a linear hearth furnace such as that shown in FIG. 2D.

Figure 37:
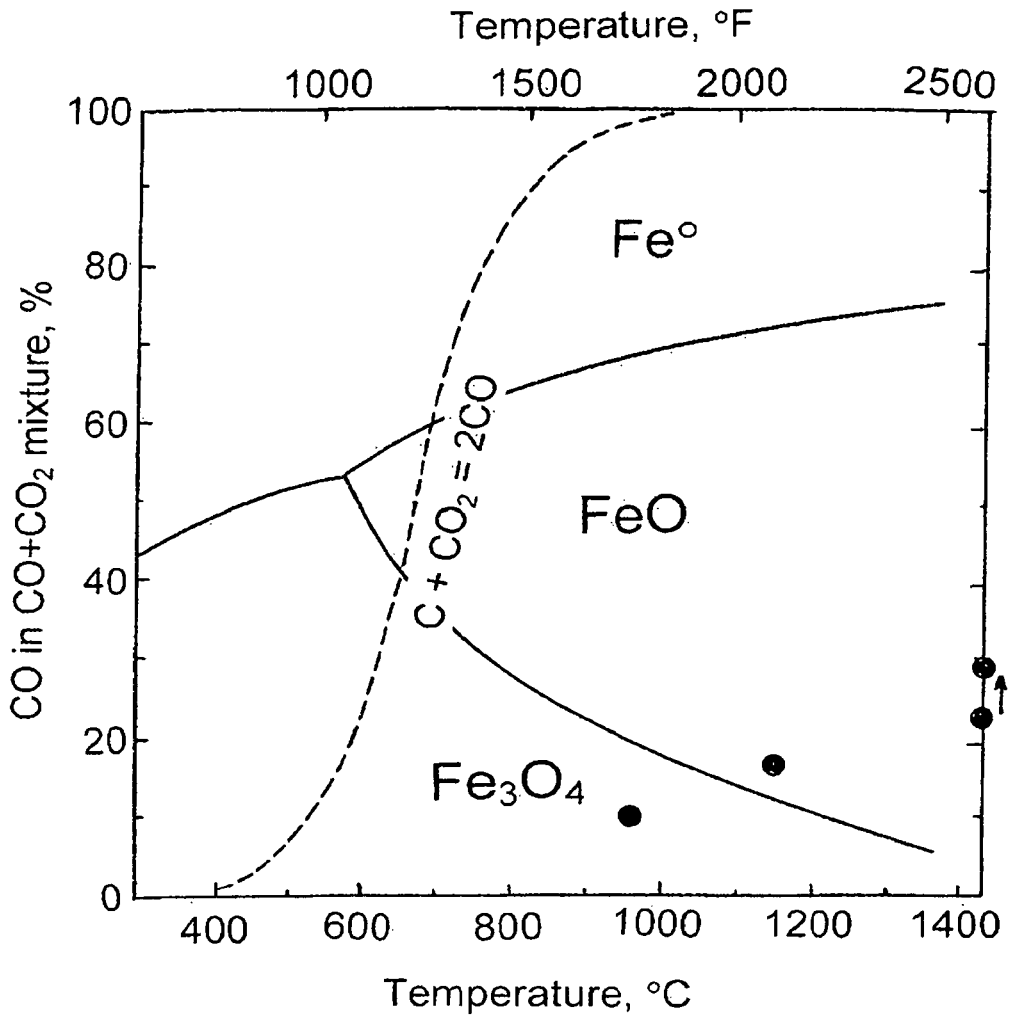

FIG. 37 is a graph showing concentrations of CO in various zones of a linear hearth furnace such as that shown in FIG. 2D for use in describing one or more tests employing such a furnace.

FIG. 38 is a table showing the effect of slag composition on a reduction process for use in describing one or more tests employing a linear hearth furnace such as that shown in FIG. 2D.

FIG. 39 is a table showing analytical results of iron nuggets and slag for use in describing one or more tests employing a linear hearth furnace such as that shown in FIG. 2D.

FIG. 40 is a table showing the effect of temperature on a reduction process for use in describing one or more tests employing a linear hearth furnace such as that shown in FIG. 2D.

FIG. 41 is a table showing the effects of coal and fluorspar additions, and also furnace temperature, on micro-nugget formation in reduction process for use in describing one or more tests employing a linear hearth furnace such as that shown in FIG. 2D.

DETAILED DESCRIPTION OF THE EMBODIMENTS

One or more embodiments of the present invention shall generally be described with reference to FIGS. 1-4. Various other embodiments of the present invention and examples supporting such various embodiments shall then be described with reference to FIGS. 5-41.

It will be apparent to one skilled in the art that elements or process steps from one or more embodiments described herein may be used in combination with elements or process steps from one or more other embodiments described herein, and that the present invention is not limited to the specific embodiments provided herein but only as set forth in the accompanying claims. For example, and not to be considered as limiting to the present invention, the addition of one or more additives (e.g., fluorspar) to the reducible mixture may be used in combination with the provision of the reducible mixture as micro-agglomerates, the nugget separation fill material in the channels may be used in combination with provision of the reducible mixture as micro-agglomerates, the molding process for forming the channels and mounds of reducible mixture may be used in combination with nugget separation fill material in the channels and/or with provision of the reducible mixture as micro-agglomerates, etc.

Further, various metallic iron nugget processes are known and/or have been described in one or more references. For example, such processes include the ITmk3 process as presented in, for example, U.S. Pat. No. 6,036,744 to Negami et al. and/or U.S. Pat. No. 6,506,231 to Negami et al.; the Hi-QIP process as presented in, for example, U.S. Pat. No. 6,270,552 to Takeda et al. and/or U.S. Pat. No. 6,126,718 to Sawa et al.; or other metallic nugget processes as described in, for example, U.S. Pat. No. 6,210,462 to Kikuchi et al., U.S. Patent Application No. US2001/0037703 A1 to Fuji et al., and U.S. Pat. No. 6,210,462 to Kikuchi et al. One or more embodiments described herein may be used in combination with elements and/or process steps from one or more embodiments of such metallic nugget processes. For example, and not to be considered as limiting to the present invention, the addition of one or more additives (e.g., fluorspar) to the reducible mixture and/or any reducible mixture described herein may be used in combination with the provision of the reducible mixture as a preformed ball, as the reducible mixture used to fill dimples in a pulverized carbonaceous layer, as part of one or more compacts (e.g., briquettes), or may be used in one or more other various molding techniques as part of such metallic iron nugget formation processes. As such, the concepts and techniques described in one or more embodiments herein are not limited to use with only the metallic iron nugget process described generally herein with reference to FIG. 1, but may be applicable to various other processes as well.

FIG. 1 shows a block diagram of one or more generalized illustrative embodiments of a metallic iron nugget process 10 according to the present invention. The metallic iron nugget process 10 shown in the block diagram shall be described with further reference to a more detailed embodiment shown in FIGS. 3A-3E and FIG. 4. One skilled in the art will recognize that one or more of the process steps described with reference to the metallic iron nugget process 10 may be optional. For example, blocks 16, 20, and 26 are labeled as being optionally provided. However, other process steps described therein, for example, the provision of channel openings as described with reference to block 22, may also be optional in one or more embodiments. As such, it will be recognized that the metallic iron nugget process 10 is a generalized illustrative embodiment and the present invention is not limited to any specific process embodiments described herein, but only as described in the accompanying claims.

The present invention as will be described in further detail herein may be used, for example, to provide one or more of the following benefits or features. For example, the present invention may be used to control the metallic iron nugget size as described herein. Conventional dried balls as feed mixtures lead to iron nuggets of small sizes in the order of ⅜ inches. Use of the mounds of reducible mixture (e.g., trapezoidal and dome-shaped mounds with channels filled partially with carbonaceous material) can increase the iron nugget size to as large as 4 inches across. Various shapes of mounds (e.g., trapezoidal mounds) may require a longer time to form fully fused iron nuggets than dome-shaped mounds of equal size.

Further, for example, micro-agglomeration may be used to minimize dust losses in feeding furnaces (e.g., rotary or linear hearth furnaces); micro-agglomerates may be placed in layers over a hearth layer with respect to size, feed composition (e.g., stoichiometric percentage of coal may vary), etc.; and compaction of feed mixtures after placing them on a hearth layer (or, in one or more embodiments, compaction before placement on the hearth, such as, to form briquettes including one or more layers) may be desirable in view of the high $CO_2$ and highly turbulent furnace gas atmospheres, particularly in a linear hearth furnace as described herein.

Yet further, for example, the present invention may be used to control micro-nugget formation. As described herein, use of excess coal beyond the stoichiometric requirement for metallization of a reducible feed mixture, and use of excess lime beyond a predetermined slag composition (e.g., a Slag Composition (L)) for the feed mixture, has led to an increased amount of micro-nuggets.

As described further herein, for example, Slag Composition (L), as shown on the $CaO—SiO_2—Al_2O_3$ phase diagram of FIG. 21A and the table of FIG. 21B, is located in the low fusion temperature trough thereof. Further, other slag compositions are shown on the $CaO—SiO_2—Al_2O_3$ phase diagram of FIG. 21A which indicates the slag compositions of (A), (L), ($L_1$), and ($L_2$). However, the present invention is not limited to any particular slag composition. For simplicity, the description herein uses the defined Slag Composition (L) in many instances, and abbreviations relating thereto, to define the general inventive concepts.

The slag compositions are abbreviated by indicating the amounts of additional lime used in percent as a suffix, for example, ($L_1$) and ($L_2$) which represents that 1% and 2% by weight of lime was added to the feed mixture, respectively, over that of Slag Composition (L). In other words, the feed mixture includes an additional 1% and 2% by weight of lime, respectively, than the feed mixture at Slag Composition (L). Further, for example, the slag compositions are further abbreviated herein to indicate the existence of other elements or compounds in the feed mixture. For example, the amount of chemical $CaF_2$ (abbreviated to CF) added in percent is indicated as a suffix, for example, ($L_{0.5}CF_{0.25}$) represents that the feed mixture includes 0.25% by weight of $CaF_2$ with Slag Composition of ($L_{0.5}$).

The use of hearth layers, including coke-alumina mixtures as well as $Al(OH)_3$-coated coke, may be used to reduce such micro-nugget formation as described herein. Further, for example, addition of certain additives, such as fluorspar to the feed mixture may reduce the amount of micro-nuggets produced during processing of the feed mixture.

Still further, for example, as described herein, the present invention may be used to control the amount of sulfur in iron nuggets produced according to the present invention. It is common practice in the steel industry to increase the basicity of slag by adding lime to slag under reducing atmosphere for removing sulfur from metallic iron, for example, in blast furnaces. Increasing lime from Slag Composition (L) to ($L_{1.5}$) and ($L_2$) may lower sulfur (e.g., from 0.084% to only 0.058% and 0.050%, respectively, as described herein) but increases the fusion temperature as well as the amount of micro-nuggets generated, as described herein. The use of fluxing additives that lower the slag fusion temperature, such as fluorspar, was found to lower not only the temperature of iron nugget formation, but also to decrease sulfur in the iron nuggets, and, in particular, to be effective in decreasing the amount of micro-nuggets.

With increasing fluorspar (FS) addition, for example, sulfur in iron nuggets at Slag Compositions ($L_{1.5}FS_{0.5\sim4}$) and ($L_2FS_{0.5\sim4}$) was lowered steadily to as low as 0.013% and 0.009%, respectively, at fluorspar addition of 4%, as described further herein. The use of soda ash, particularly in combination with fluorspar, was effective in lowering sulfur in iron nuggets, but the use of soda ash tended to increase the amount of micro-nuggets also as described further herein.

Figure 3A:
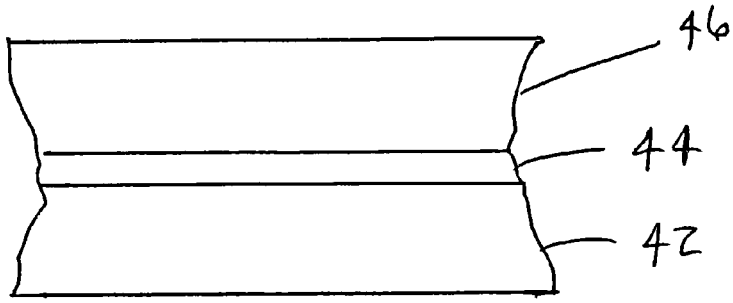
FIGS. 3A-3C are generalized cross-section views and FIGS. 3D-3E are generalized top views showing stages of one embodiment of a metallic iron nugget process such as shown generally in FIG. 1 according to the present invention.

As shown in block 12 of FIG. 1, a hearth 42 is provided (see FIG. 3A). The hearth 42, as shown in FIG. 3A, may be any hearth suitable for use with a furnace system 30 (e.g., such as that shown generally in FIG. 2A) operable for use in carrying out the metallic iron nugget process 10 as will be described further herein, or one or more other metallic nugget processes that incorporate one or more features described herein. For example, hearth 42 may be a hearth suitable for use in a rotary hearth furnace, a linear hearth furnace (e.g., such as a pallet sized for such a furnace as shown in FIG. 35A), or any other furnace system operable for implementation of metallic iron nugget process.

Generally, hearth 42 includes a refractory material upon which material to be processed (e.g., feed material) is received. For example, in one or more embodiments, the refractory material may be used to form the hearth (e.g., the hearth may be a container formed of a refractory material) and/or the hearth may include, for example, a supporting substructure that carries a refractory material (e.g., a refractory lined hearth).

In one embodiment, for example, the supporting substructure may be formed from one or more different materials, such as, for example, stainless steel, carbon steel, or other metals, alloys, or combinations thereof that have the required high temperature characteristics for furnace processing. Further, the refractory material may be, for example, refractory board, refractory brick, ceramic brick, or a castable refractory. Yet further, for example, a combination of refractory board and refractory brick may be selected to provide maximum thermal protection for an underlying substructure.

In one embodiment of the present invention, for example, a linear hearth furnace system is used for furnace processing such as described in U.S. Provisional Patent Application No. 60/558,197 filed 31 Mar. 2004, published as US 20050229748A1, and the hearth 42 is a container such as a tray (e.g., such as shown in FIG. 35A). For example, such a container may include a relatively thin, lightweight refractory bed that is supported in a metal container (e.g., a tray). However, any suitable hearth 42 capable of providing the functionality necessary for furnace processing may be used according to the present invention.

With further reference to block 14 of FIG. 1 and FIG. 3A, a hearth material layer 44 is provided on hearth 42. The hearth material layer 44 includes at least one carbonaceous material.

As used herein, carbonaceous material refers to any carbon-containing material suitable for use as a carbonaceous reductant. For example, carbonaceous material may include coal, char, or coke. Further, for example, such carbonaceous reductants may include those listed and analyzed in the tables (in terms of % by weight) shown in FIGS. 32A-32C.

For example, as shown in FIGS. 32A-32C, one or more of anthracite, low volatile bituminous carbonaceous reductant, medium volatile bituminous carbonaceous reductant, high volatile bituminous carbonaceous reductant, sub-bituminous carbonaceous reductant, coke, graphite, and other sub-bituminous char carbonaceous reductant materials may be used for the hearth layer 44. FIG. 32D further provides an ash analysis for carbonaceous reductants shown in the tables of FIGS. 32A-32C. Some low, medium, and high volatile bituminous coals may not be suitable for use as hearth layers by themselves, but may be used as make-up materials to pulverized bituminous chars.

The hearth material layer 44 includes a thickness necessary to prevent slag from penetrating the hearth material layer 44 and contacting refractory material of hearth 42. For example, the carbonaceous material may be pulverized to an extent such that it is fine enough to prevent the slag from such penetration. As recognized by one skilled in the art, contact of slag during the metallic iron nugget process 10 produces undesirable damage to the refractory material of hearth 42 if contact is not prevented.

As shown by block 16 of FIG. 1, the carbonaceous material used as part of the hearth material layer 44 may optionally be treated, or otherwise modified, to provide one or more advantages as shall be further discussed herein. For example, the carbonaceous material of the hearth material layer 44 may be coated with aluminum hydroxide (or $CaF_2$ or the combination of $Ca(OH)_3$ and $CaF_2$) to reduce the formation of micro-nuggets as further described herein. According to one or more particularly advantageous embodiments, the hearth material layer 44 includes anthracite, coke, char, or mixtures thereof.

In one embodiment, the hearth material layer 44 has a thickness of more than 0.25 inches and less than 1.0 inch. Further, in yet another embodiment, the hearth material layer 44 has a thickness of less than 0.75 inches and more than 0.375 inches.

Further, with reference to block 18 of FIG. 1 and FIG. 3A, a layer of reducible mixture 46 is provided on the underlying hearth material layer 44. The layer of reducible mixture includes at least a reducible iron-bearing material and reducing material for the production of iron metal nuggets (e.g., other reducible materials would be used for production of other types of metallic nuggets using one or more like processes such as, for example, use of nickel-bearing laterites and garnierite ores for ferronickel nuggets).

As used herein, iron-bearing material includes any material capable of being formed into metallic iron nuggets via a metallic iron nugget process, such as process 10 described with reference to FIG. 1. For example, the iron-bearing material may include iron oxide material, iron ore concentrate, recyclable iron-bearing material, pellet plant wastes and pellet screened fines. Further, for example, such pellet plant wastes and pellet screened fines may include a substantial quantity of hematite. Yet further, for example, such iron-bearing material may include magnetite concentrates, oxidized iron ores, steel plant wastes (e.g., blast furnace dust, basic oxygen furnace (BOF) dust and mill scale), red mud from bauxite processing, titanium-bearing iron sands, manganiferous iron ores, alumina plant wastes, or nickel-bearing oxidic iron ores.

At least in one embodiment, such iron-bearing material is ground to −100 mesh or less in size for processing according to the present invention. The various examples presented herein use iron-bearing material ground to −100 mesh unless otherwise specified. However, larger size iron-bearing material may also be used. For example, pellet screened fines and pellet plant wastes are generally about 0.25 inches in nominal size. Such material may be used directly, or may be ground to −100 mesh for better contact with carbonaceous reductants during processing.

In a preferred embodiment, for compacts containing coal at 80% of the stoichiometric amount, mounds of reducible material have a density of about 1.9-2.0, balls have a density of about 2.1 and briquettes have a density of about 2.1. Further, the reducible mixture has a density of less than about 2.4. In one preferred embodiment, the density is between about 1.4 and about 2.2.

One or more of the chemical compositions of iron ore shown in the table of FIG. 33 (i.e., excluding the oxygen content) provide a suitable iron-bearing material to be processed by a metallic iron nugget process 10, such as process 10 described with reference to FIG. 1. As shown therein, three magnetic concentrates, three flotation concentrates, pellet plant waste and pellet screened fines are shown in chemical composition form.

As used herein, the reducing material used in the layer of reducible mixture 46 includes at least one carbonaceous material. For example, the reducing material may include at least one of coal, char, or coke. The amount of reducing material in the mixture of reducing material and reducible iron bearing material will depend on the stoichiometric quantity necessary for completing the reducing reaction in the furnace process being employed. As described further below, such a quantity may vary depending on the furnace used (e.g., the atmosphere in which the reducing reaction takes place). In one or more embodiments, for example, the quantity of reducing material necessary to carry out the reduction of the iron-bearing material is between about 70 percent and 90 percent of the stoichiometric quantity of reducing material theoretically necessary for carrying out the reduction. In other embodiments, the quantity of reducing material necessary to carry out the reduction of the iron-bearing material is between about 70 percent and 140 percent of the stoichiometric quantity of reducing material theoretically necessary for carrying out the reduction.

At least in one embodiment, such carbonaceous material is ground to −100 mesh or less in size for processing according to the present invention. In another embodiment, such carbonaceous material is provided in the range of −65 mesh to −100 mesh. For example, such carbonaceous material may be used at different stoichiometric levels (e.g., 80 percent, 90 percent, and 100 percent of the stoichiometric amount necessary for reduction of the iron-bearing material. However, carbonaceous material in the range of −200 mesh to −8 mesh may also be used. The use of coarser carbonaceous material (e.g., coal) may require increased amounts of coal for carrying out the reduction process. Finer ground carbonaceous material may be as effective in the reduction process, but the amount of micro-nuggets may increase, and thus be less desirable. The various examples presented herein use carbonaceous material ground to −100 mesh unless otherwise specified. However, larger size carbonaceous material may also be used. For example, carbonaceous material of about ⅛ inch (3 mm) in nominal size may be used. Such larger size material may be used directly, or may be ground to −100 mesh or less for better contact with the iron-bearing reducible material during processing. When other additives are also added to the reducible mixture, such additives if necessary are also ground to −100 mesh or less in size.

Various carbonaceous materials may be used according to the present invention in providing the reducible mixture of reducing material and reducible iron-bearing material. For example, eastern anthracite and bituminous coals may be used as the carbonaceous reductant in at least one embodiment according to the present invention. However, in some geographical regions, such as on the Iron Range in Northern Minnesota, the use of western sub-bituminous coal offers an economically attractive alternative, as such coals are more readily accessible with the transportation systems already in place, plus they are low in cost and low on sulfur. As such, western sub-bituminous coals may be used in one or more processes as described herein. Further, an alternative to the direct use of sub-bituminous coals may be to carbonize, for example, at 900° C., the sub-bituminous coal prior to its use.

In one embodiment, the reducible mixture 46 has a thickness of more than 0.25 inches and less than 2.0 inches. Further, in yet another embodiment, the reducible mixture 46 has a thickness of less than 1 inch and more than 0.5 inches. The thickness of the reducible mixture is generally limited and/or dependent upon the effective heat penetration thereof and increased surface area of the reducible mixture that allows for improved heat transfer (e.g., dome-shaped reducible mixture as described herein).

In addition to the reducing material (e.g., coal or char) and reducible iron-bearing material (e.g., iron oxide material or iron ore), various other additives may optionally be provided to the reducible mixture for one or more purposes as shown by block 20 of FIG. 1. For example, additives for controlling slag basicity, binders or other additives that provide binder functionality (e.g., lime can act as a weak binder in a micro-agglomerate configuration described herein when wetted), additives for controlling the slag fusion temperature, additives to reduce the formation of micro-nuggets, and/or additives for controlling the content of sulfur in resultant iron nuggets formed by the metallic iron nugget process 10, may be used.

For example, the additives shown in the table of FIG. 34 may be used in one or more embodiments of the layer of reducible mixture 46. The table of FIG. 34 shows the chemical compositions of various additives which include, for example, chemical compositions such as $Al(OH)_3$, bauxite, bentonite, $Ca(OH)_2$, lime hydrate, limestone, burnt dolomite, and Portland cement. However, other additives may also be used as will be described further herein, such as $CaF_2$, $Na_2CO_3$, fluorspar, soda ash, etc. One or more of such additives, separately or in combination, may provide for beneficial results when used in the metallic iron nugget process 10.

As discussed herein with reference to metallic iron nugget processes that differ in one manner or another from that described with reference to FIG. 1 (e.g., the ITmk3 process, the Hi-QIP process, etc.), the reducible mixture may include the same materials (i.e., type of composition), but the form of the reducible mixture on the hearth may be different. For example, the form that the reducible mixture takes may be a preformed ball, may fill dimples in a pulverized carbonaceous layer, may be briquettes or other type of compact (e.g., including compacted layers), etc. As such, the composition of the reducible mixture is beneficial to multiple types of metallic iron nugget process, and not just the metallic iron nugget process described generally herein with reference to FIG. 1.

Figure 3B:
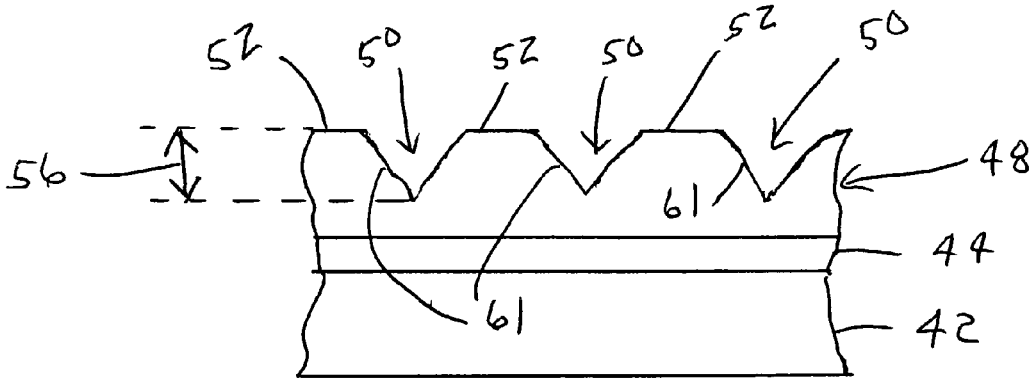
Figure 3C:
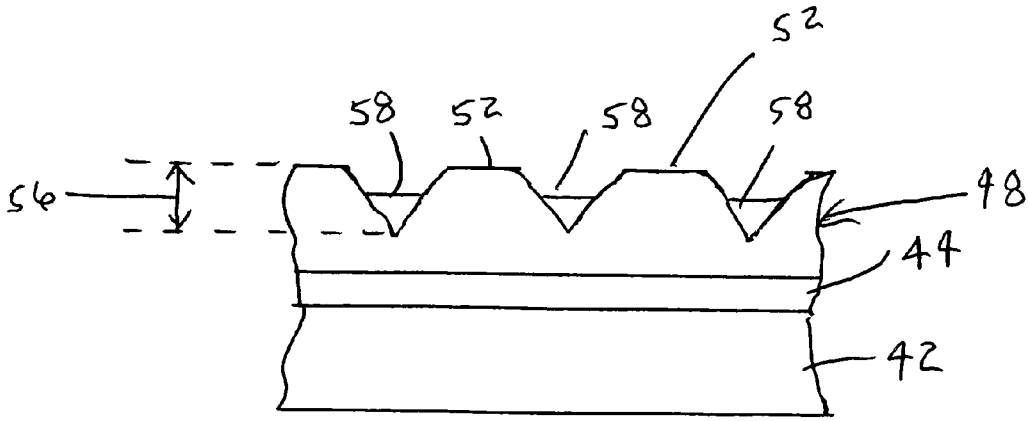
Figure 3D:
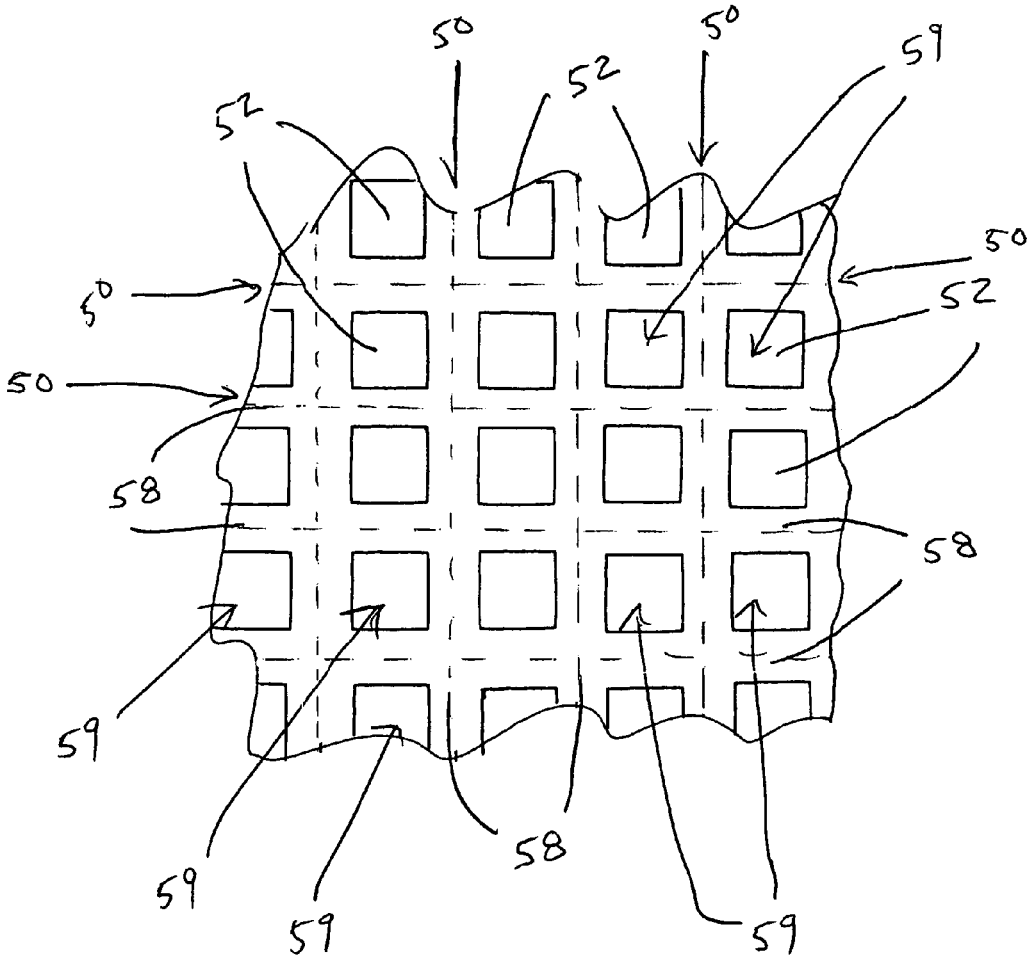

With further reference to FIG. 1, and in particular block 22 and FIG. 3B, channel openings 50 are defined, or otherwise provided, in the layer of reducible mixture 46 to define metallic iron nugget forming reducible material regions 59 as shown, for example, by the dashed line square regions in the top view of FIG. 3D. Such a channel definition process is best shown in and described with general reference to FIG. 3A-3E. The channel definition provides at least one manner of controlling metallic iron nugget size as described with reference to the various embodiments provided herein.

As shown in FIG. 3B, channels 50 are provided in the layer of reducible mixture 46 of FIG. 3A to provide the formed layer of reducible mixture 48. Such channels 50 are defined to a depth 56 in the reducible mixture 46. The depth 56 is defined as the depth extending from an upper surface of the layer of reducible mixture 46 in a direction toward hearth 42. In one or more embodiments, the depth of the channels 50 may extend only part of the distance to the hearth material layer 44. However, in one or more other embodiments, the channel depth may extend to the hearth material layer 44 (or even into the layer 44 if it is thick enough).

In the embodiment shown in FIGS. 3A-3E, the channel openings 50 defined in the layer of reducible mixture 46 are provided in a manner to form mounds 52 (see the dome shaped mound in FIG. 3B) in each nugget forming reducible material region 59 (see FIG. 3D) defined by the openings 50.

As shown in FIGS. 3B-3D, a matrix of channel openings 50 are created in the layer of reducible mixture 46. Each of the formed portions, or mounds 52, of reducible mixture includes at least one curved or sloped portion 61. For example, the mounds 52 may be formed as pyramids, truncated pyramids, round mounds, truncated round mounds, or any other suitable shape or configuration. For example, in one embodiment, any suitable shape or configuration that results in the formation of one metal nugget in each of the one or more of the nugget forming reducible material regions 59 may be used. In one or more embodiments, shapes that provide a large exposed surface area for effective heat transfer are used (e.g., dome shaped mounds similar to the shape of the nugget being formed).

Further, as would be apparent from the description herein, depending upon the shape of the formed portions, or mounds 52, channel openings 50 would have shapes or configurations associated therewith. For example, if mound 52 was a pyramid structure, a truncated pyramid structure, or a trapezoidal-shaped mound, openings 50 may be formed in a V-type configuration. One or more of such different types of channel openings are described further herein with reference to FIGS. 5A-10E.

The channel openings may be formed using any suitable channel definition tool. For example, one or more various channel definition tools are described with reference to FIGS. 8A-10E herein.

Further with reference to FIG. 1, and as optionally shown in block 26, channel openings 50 are at least partially filled with nugget separation fill material 58 as shown in FIGS. 3C-3D. The nugget separation fill material 58 includes at least carbonaceous material. For example, in one or more embodiments, the carbonaceous material includes pulverized coke or pulverized char, pulverized anthracite, or mixtures thereof.

At least in one embodiment, such pulverized material used to fill the channel openings is ground to −6 mesh or less in size for processing according to the present invention. At least in one embodiment, such pulverized material used to fill the channel openings is −20 mesh or greater. Finer pulverized material more than −20 mesh (e.g., −100 mesh) may increase the amount of micro-nugget formation. However, larger size materials may also be used. For example, carbonaceous material of about ¼ inch (6 mm) in nominal size may be used.

As shown in FIG. 3C, the depth 56 of each channel 50 is only partially filled with nugget separation fill material 58. However, such channels 50 may be completely filled and, in one or more embodiments, additional carbonaceous material may be formed as a layer over, for example, the mounds and above the filled defined channels. In at least one embodiment, at least about one-quarter of the channel depth 56 is filled with nugget separation fill material 58. Yet further, in another embodiment, less than about three-quarters of the channel depth 56 is filled with nugget separation fill material 58. With the channel openings 50 filled with at least carbonaceous material and with formation of generally uniform nugget forming reducible material regions 59, uniform-sized nuggets can be produced by the metallic iron nugget process 10. As will be recognized, the larger the nugget forming reducible material regions 59 (e.g., the larger the mounds 52 of reducible mixture), the larger the nuggets formed by process 10. In other words, nugget size can be controlled.

Figure 3E:
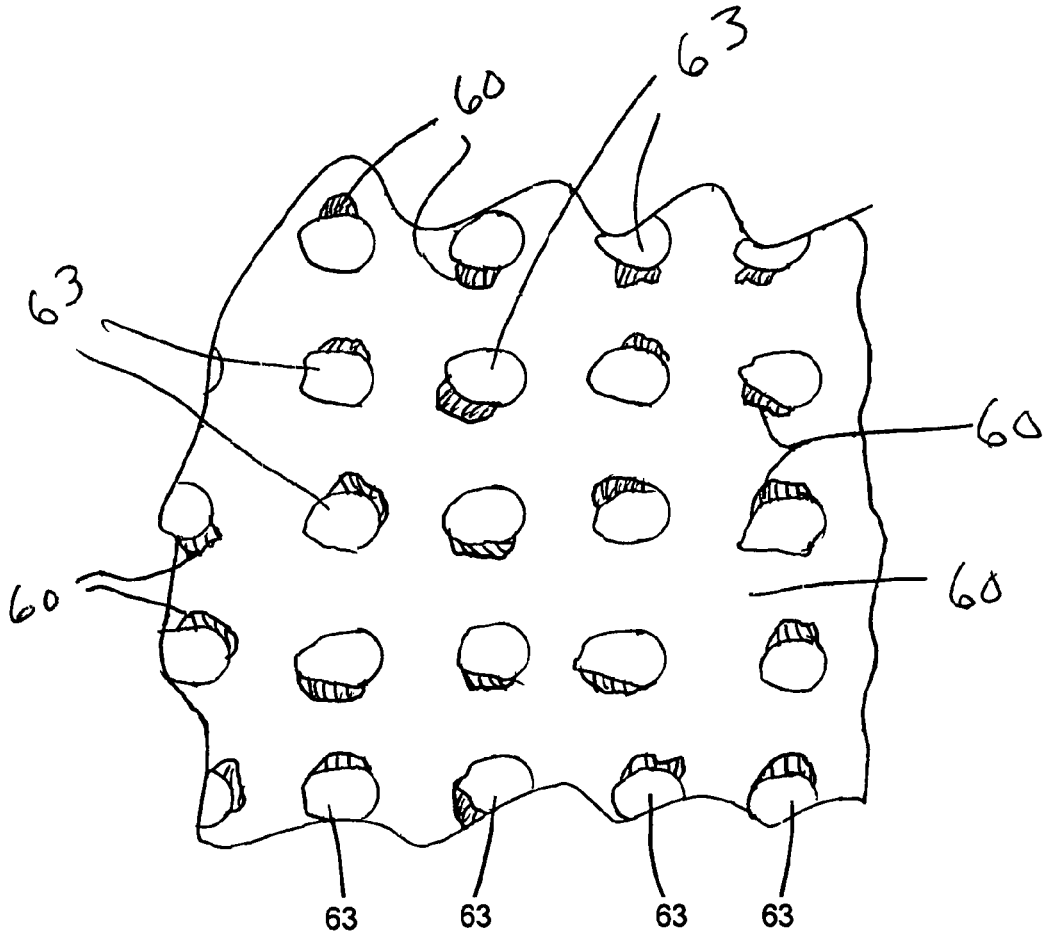

With the channel openings 50 at least partially filled with nugget separation fill material 58, a formed layer 48 of reducible mixture (e.g., mounds 52) may be thermally treated under appropriate conditions to reduce the reducible iron-bearing material and form one or more metallic iron nuggets in the one or more defined metallic iron nugget forming reducible material regions 59 as shown in block 24 of FIG. 1. For example, as shown in the embodiment of FIG. 3E, one metallic nugget 63 is formed in each of nugget forming reducible material regions 59. Such nuggets 63 are generally uniform in size as substantially the same amount of reducible mixture was formed and processed to produce each of the nuggets 63.

As further shown in FIG. 3E, resultant slag 60 on hearth material layer 44 is shown with the one or more metallic iron nuggets 63 (e.g., slag beads on hearth material layer 44 separated from the iron nuggets 63 or attached thereto). With further reference to block 28 of FIG. 1, the metallic nuggets 63 and slag 60 (e.g., attached slag beads) are discharged from hearth 42, and the discharged metallic nuggets are then separated from the slag 60 (block 29).

The mechanism of iron nugget formation during the thermal treatment (block 24) of the formed reducible mixture layer 48 is described herein with reference to FIGS. 4A-4D. FIGS. 4A-4D show the effect of time in a reducing furnace (i.e., the reducing furnace described herein referred to as the tube furnace) at a temperature of 1400° C. on nugget formation. The composition of the reducible mixture included using 5.7% silicon oxide concentrate, medium volatile bituminous coal at 80% stoichiometric requirement, and slag composition (A) formed into two separate mounds 67. Slag composition (A) can be discerned from the phase diagram of FIG. 21A and the table of FIG. 21B.

Figure 4A:
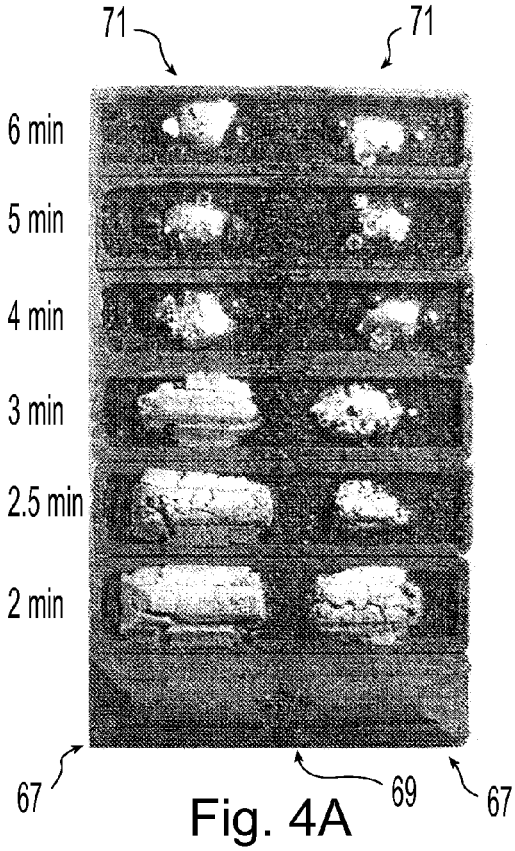
FIGS. 4A-4D show illustrations of the effect of time on metallic nugget formation in a metallic iron nugget process such as that shown generally in FIG. 1.
Figure 4B:
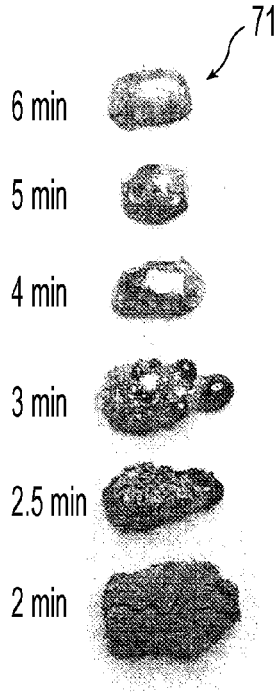
Figure 4C:
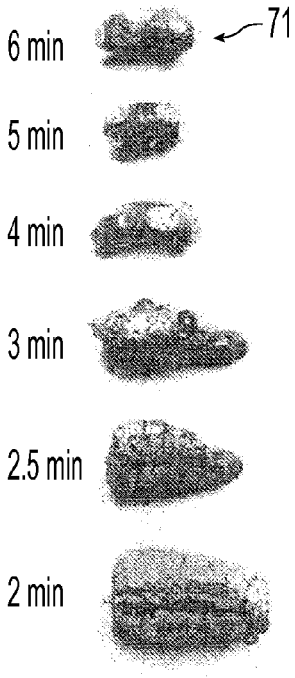
Figure 4D:
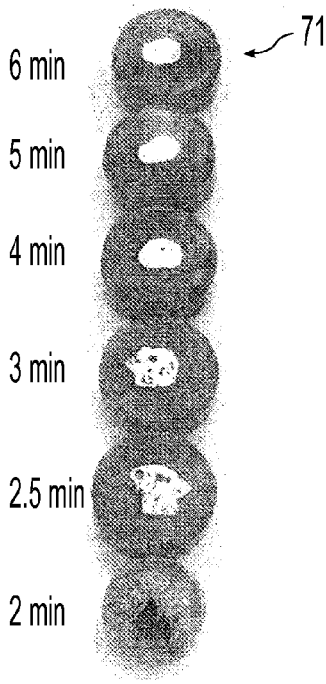

FIG. 4A shows stages of the nugget formation process with the nuggets 71 formed on a hearth, FIG. 4B provides a top view of the such nuggets, FIG. 4C provides a side view of such nuggets, and FIG. 4D provides a cross-section of such nuggets. In other words, FIGS. 4A-4D show one embodiment of a sequence of iron nugget formation involving metallic sponge iron formation, fritting of metallized particles, coagulation of fritted metallic iron particles by shrinking and squeezing out of entrained slag. Such FIGS. 4A-4D show the formation of fully fused solid iron nuggets 71 after about 5-6 minutes. The presence of the groove 69 in the reducible mixture to form mounds 67 induces iron nuggets 71 in individual islands to shrink away from each other and separate into individual nuggets.

Such a process is quite different from the mechanism proposed and described which uses dried iron ore/coal mixture balls such as described in the Background of the Invention section herein. The mechanism used with the balls is reported to involve formation of direct reduced iron by the reduction of carbon-containing balls, formation of a dense metallic iron shell on the surface of the original round shape with molten slag separated from metal, and a large void space inside, followed by melting of the iron phase and separation of slag from molten metal.

The metallic iron nugget process 10 may be carried out by a furnace system 30 as shown generally in FIG. 2A. Other types of metallic iron nugget processes may be carried out using one or more components of such a system, alone or in combination with other appropriate apparatus. The furnace system 30 generally includes a charging apparatus 36 operable to provide a layer of reducible mixture 46 on at least a portion of hearth material layer 44. The charging apparatus may include any apparatus suitable for providing a reducible mixture 46 onto a hearth material layer 44. For example, a controllable feed chute, a leveling device, a feed direction apparatus, etc., may be used to provide such feed mixture on the hearth 42.

A channel definition tool 35 is then operable (e.g., manual and/or automatic operation thereof; typically automatic in commercial units or systems) to create the plurality of channel openings 50 that extend at least partially through the layer of the reducible mixture 46 to define the plurality of nugget forming reducible material regions 59. The channel definition tool 35 may be any suitable apparatus (e.g., channel cutting device, mound forming press, etc.) for creating the channel openings 50 in the layer of reducible mixture 46 (e.g., forming the mounds 52, pressing the reducible mixture 46, cutting the openings, etc.). For example, the channel definition tool 35 may include one or more molds, cutting tools, shaping tools, drums, cylinders, bars, etc. One or more suitable channel definition tools shall be described with reference to FIGS. 8A through 10E. However, the present invention is not limited to any specific apparatus for creating the channel openings 50 in the formation of nugget forming reducible material regions 59.

The furnace system 30 further includes a channel fill apparatus 37 operable to at least partially fill the plurality of channel openings 50 with nugget separation fill material 58. Any suitable channel fill apparatus 37 for providing such separation fill material 58 into the channels 50 may be used (e.g., manual and/or automatic operation thereof). For example, a feed apparatus that limits and positions material in one or more places may be used, material may be allowed to roll down dome-shaped mounds to at least partially fill the openings, a spray device may be used to provide material in the channels, or an apparatus synchronized with a channel definition tool may be used (e.g., channels at least partially filled as the mounds are formed).

With the formed reducible material 48 provided on the hearth material layer 44 and with nugget separation fill material 58 provided to at least partially fill the plurality of channel openings 50, a reducing furnace 34 is provided to thermally treat the formed layer of reducible mixture 48 to produce one or more metallic iron nuggets 63 in one or more of the plurality of nugget forming reducible material regions 59. The reducing furnace 34 may include any suitable furnace regions or zones for providing the appropriate conditions (e.g., atmosphere and temperature) for processing the reducible mixture 46 such that one or more metallic iron nuggets 63 are formed. For example, a rotary hearth furnace, a linear hearth furnace, or any other furnace capable of performing the thermal treatment of the reducible mixture 46 may be used.

Further as shown in FIG. 2A, the furnace system 30 includes a discharge apparatus 38 used to remove the metallic nuggets 63 and the slag formed during processing by the furnace system 30 and discharge such components (e.g., nuggets 63 and slag) from the system 30. The discharge apparatus 38 may include any number of various discharge techniques including gravity-type discharge (e.g., tilting of a tray including the nuggets and slag) or techniques using a screw discharge device or a rake discharge device. One will recognize that any number of different types of discharge apparatus 38 may be suitable for providing such discharge of the nuggets 63 (e.g., iron nugget 63 and slag bead 60 aggregates), and the present invention is not limited to any particular configuration thereof. Further, a separation apparatus may then be used to separate the metallic iron nuggets 63 from the slag beads 60. For example, any method of breaking the iron nugget and slag bead aggregates may be used, such as, for example, tumbling in a drum, screening, a hammer mill, etc. However, any suitable separation apparatus may be used (e.g., a magnetic separation apparatus).

One or more different reducing furnaces may be used according to the present invention depending on the application of the present invention. For example, in one or more embodiments herein, laboratory furnaces were used to perform the thermal treatment. One will recognize that from the laboratory furnaces, scaling to mass production level can be performed and the present invention contemplates such scaling. As such, one will recognize that various types of apparatus described herein may be used in larger scale processes, or production equipment necessary to perform such processes at a larger scale may be used.

In the absence of any other information of the furnace gas composition of iron nugget processes, most of the laboratory tests described herein were carried out in an atmosphere of 67.7% $N_2$ and 33.3% CO, assuming that $CO_2$ in a natural gas-fired burner gas would be converted rapidly to CO in the presence of carbonaceous reductants and hearth layer materials by the Boudouard (or carbon solution) reaction ($CO_2$+C=2CO) at temperatures higher than 1000° C., and a CO-rich atmosphere would prevail at least in the vicinity of the reducible materials.

While the presence of CO in the furnace atmosphere accelerated the fusion process somewhat as compared to a $N_2$ only atmosphere, the presence of $CO_2$ in furnace atmospheres slowed the fusion behaviors of iron nuggets. There was a pronounced effect of $CO_2$ in furnace atmospheres on iron nugget formation at 1325° C. (2417° F.), wherein temperature was on the verge of forming fused iron nuggets. The effect of $CO_2$ became less pronounced at higher temperatures and, in fact, the effect became virtually absent over 1400° C. (2552° F.). In the examples given herein, unless otherwise indicated, salient features of findings are provided as observed mainly in the $N_2$ and CO atmosphere.

Two reducing furnaces used to arrive at one or more of the techniques and/or concepts used herein include laboratory test furnaces including, for example, a laboratory tube furnace, as shown in FIG. 2B, and a laboratory box furnace, as shown in FIG. 2C. Detail regarding such furnaces shall be provided as supplemental information to the one or more exemplary tests described herein. Unless otherwise indicated, such laboratory test furnaces were used to carry out the various examples provided herein.

The laboratory tube furnace 500 (FIG. 2B) as used in multiple testing situations described herein, includes a 2-inch diameter horizontal tube furnace, 16 inch high×20 inch wide× 41 inch long, with four silicon carbide heating elements, rated at 8 kW, and West 2070 temperature controller, fitted with a 2 inch diameter×48 inch long mullite tube. A schematic diagram thereof is shown in FIG. 2B. At one end of the combustion tube 501, a Type R thermocouple 503 and a gas inlet tube 505 is placed, and at the other end, a water-cooled chamber 507 is attached, to which a gas exit port and a sampling port 509 are connected. The effluent gas is flared, if CO is used, and removed to an exhaust duct system. $N_2$, CO, and $CO_2$ were supplied through the combustion tube in different combinations via respective rotameters to control the furnace atmosphere. Initially, an Alundum boat, 5 inch long×¾ inch wide×7/16 inch high, was used.

A typical temperature profile of the tube furnace when the temperature was set at 1300° C. (2372° F.) is shown as follows.

Temperature profile of tube furnace, set at 1300° C. (2372° F.)

| Distance from center inch | Temperature reading ° C. |
|---|---|
| −5* | 1292 |
| −4 | 1296 |
| −3 | 1299 |
| −2 | 1300 |
| −1 | 1301 |
| 0 | 1300 |

-continued

| Temperature profile of tube furnace, set at 1300° C. (2372° F.) | |
|---|---|
| Distance from center inch | Temperature reading ° C. |
| +1 | 1298 |
| +2 | 1295 |
| +3 | 1291 |
| +4 | 1286 |
| +5 | 1279 |

*Direction of gas flow from − to +

The constant temperature zone of 1 inch upstream from the middle of the furnace was sufficient to extend over a 4 inch long graphite boat 511.

Reduction tests were conducted by heating to a temperature in the range of 1325° C. (2417° F.) to 1450° C. (2642° F.) and holding for different periods of time with a gas flow rate, in many of the tests, of 2 L/min $N_2$ and 1 L/min CO for atmosphere control. In certain tests, the atmosphere was changed to contain different concentrations of $CO_2$. The furnace temperature was checked with two different calibration thermocouples and the readings were found to agree within 5° C.

For reduction tests, a graphite boat 511 was introduced in the water-cooled chamber 507, the gas was switched to either a $N_2$—CO or $N_2$—CO—$CO_2$ mixture and purged for 10 minutes. The boat 511 was moved into and removed from the constant temperature zone. Then, iron nuggets and slag were picked out and the remainder separated on a 20 mesh screen, and the oversize and the undersize were magnetically separated. The magnetic fraction of the oversize included mainly metallic iron micro-nuggets, while the magnetic fraction of the undersize in most cases were observed to include mainly of coke particles with some magnetic materials attached, whether from iron ores or from iron-bearing impurities of added coal.

Further, a laboratory electrically heated box furnace 600 (FIG. 2C), 39 inch high×33 inch wide×52 inch long, had four helical silicon carbide heating elements on both sides in each chamber thereof. A total of sixteen (16) heating elements in the two chambers was rated at 18 kW. The box furnace schematic diagram is shown in FIG. 2C. The furnace 600 included two 12 inch×12 inch×12 inch heating chambers 602, 604, with the two chambers capable of controlling temperatures up to 1450° C. independently, using two Chromalox 2104 controllers. A Type S thermocouple was suspended from the top into the middle of each cavity 4½ inch above the bottom floor in each chamber. A typical temperature profile in the second chamber 604 is given as follows:

| Temperature profile of box furnace, set at 1400° C. (2552° F.) | |
|---|---|
| Distance from center inch | Temperature reading ° C. |
| −4* | 1392 |
| −3 | 1394 |
| −2 | 1396 |
| −1 | 1397 |
| 0 | 1397 |
| +1 | 1396 |
| +2 | 1395 |
| +3 | 1393 |
| +4 | 1392 |

*Direction of gas flow from − to +

The temperature variation over a 6 inch long tray 606 was within a few degrees. The furnace 600 was preceded by a cooling chamber 608, 16 inch high×13 inch wide×24 inch long, with a side door 620 through which a graphite tray 606, 5 inch wide×6 inch long×1½ inch high with a thickness of ⅛ inch, was introduced, and a view window 610 at the top. A gas inlet port 614, another small view window 612, and a port 616 for a push rod to move a sample tray 606 into the furnace 600 were located on the outside wall of the chamber. On the side attached to the furnace, a flip-up door 622 was installed to shield the radiant heat from coming through. A ½ inch hole in the flip-up door 622 allowed the gas to pass through, and the push rod to move the tray 606 inside the furnace 600. At the opposite end of the furnace, a furnace gas exhaust port 630, a gas sampling port 632, and a port for a push rod 634 to move a tray 606 out of the furnace 600, were located.

To control the furnace atmosphere, $N_2$, CO, and $CO_2$ were supplied to the furnace 600 in different combinations via respective rotameters. Total gas flow could be adjusted in the range of 10 to 50 L/min. In most tests, graphite trays 606 were used, but in some tests, trays made of high-temperature fiberboards with a thickness of ½ inch were used. After introducing a tray 606 into the cooling chamber 608, the furnace was purged with $N_2$ for 30 minutes to replace the air, followed by another 30 minutes with a gas mixture used in a test of either a $N_2$—CO or a $N_2$—CO—$CO_2$ mixture before the sample tray 606 was pushed into the furnace.

Initially, the tray was pushed just inside of the flip-up door 622, held there for 3 minutes, then into the first chamber 602 for preheating, typically at 1200° C., for 5 minutes, and into the second chamber for iron nugget formation, typically at 1400° C. to 1450° C. for 10 to 15 minutes. After the test, the gas was switched to $N_2$ and the tray 606 was pushed to the back of the door 622 and held there for 3 minutes, and then into the cooling chamber 608. After cooling for 10 minutes, the tray 606 was removed from the cooling chamber 608 for observation.

Then, iron nuggets and slag were picked out and the remainder separated on a 20 mesh screen, and the oversize and the undersize were magnetically separated. The magnetic fraction of the oversize included mainly metallic iron micro-nuggets, while the magnetic fraction of the undersize in most cases included mainly coke particles with some magnetic materials, whether from iron ores or from iron-bearing impurities of added coal. The magnetic fraction of +20 mesh was labeled and is referred to herein as "micro-nuggets," and the −20 mesh was labeled and is referred to herein as "−20 mesh mag.". As such, as used herein, micro-nuggets refers to nuggets that are smaller than the parent nugget formed during the process but too large to pass through the 20 mesh screen, or in other words the +20 mesh material.

Yet further, as previously described herein, a linear hearth furnace such as that described in U.S. Provisional Patent Application No. 60/558,197, entitled "Linear hearth furnace system and methods," filed 31 Mar. 2004, published as US 20050229748A1, may also be used. A summary of the linear hearth furnace described therein is as follows. One exemplary embodiment of such a linear hearth furnace is shown generally in FIG. 2D and, may be, a forty-foot long walking beam iron reduction furnace 712 including three heating zones 728, 730, 731 separated by internal baffle walls 746, and also including a final cooling section 734. The baffle walls 746 are cooled, for example, by water-cooled lintels to sustain the refractory in these environments. As described herein, various tests were also run using this linear hearth furnace and results thereof are described with reference to FIGS. 35A through 41.

Zone 728 is described as an initial heating and reduction zone. This zone may operate on two natural gas-fired 450,000

BTU burners 738 capable of achieving temperatures of 1093° C. Its walls and roof are lined with six (6) inches of ceramic fiber refractory rated to 1316° C. Its purpose is to bring samples to sufficient temperature for drying, de-volatilizing hydrocarbons and initiating the reduction stages. The burners are operated sub-stoichiometrically to minimize oxygen levels.

Zone 730 is described as the reduction zone. This zone may operate on two natural gas-fired 450,000 BTU burners 738 capable to achieve 1316° C. Its walls and roof are lined with 12 inches of ceramic fiber refractory rated to sustain constant operating temperatures of 1316° C. The reduction of the feed mixture occurs in this zone 730.

Zone 731 is described as the melting or fusion zone. This zone may operate on two natural gas-fired 1,000,000 BTU burners 738 capable to sustain this zone at 1426° C. The walls and roof are lined with 12" of ceramic fiber refractory rated to sustain constant operating temperatures of 1426° C. The function of this zone is to complete the reduction, fusing the iron into metallic iron nodules or "nuggets". In the event that this furnace is being used to make direct reduced iron or sponge iron, the temperatures in this zone would be reduced where complete reduction would be promoted without melting or fusion.

The final zone 734, or cooling zone, is a water-jacketed section of the furnace approximately eleven (11) feet long. A series of ports have been installed between the third zone and the cooling section so that nitrogen can be used to create a blanket. The purpose of this zone is to cool the sample trays 715 so that they can be safely handled and solidify the metallic iron nuggets for removal from the furnace.

Zones 728, 730, and 731 are controlled individually according to temperature, pressure and feed rate, making this furnace 712 capable of simulating several iron reduction processes and operating conditions. An Allen Bradley PLC micro logic controller 718 coupled to an Automation-Direct PLC for a walking beam mechanism 724 controls the furnace through a user-friendly PC interface.

The operation of the furnace under positive pressure allows the control of atmosphere in each of the zones to reduced oxygen levels (e.g., to 0.0%). Sample trays 715 are also filled with coke breeze or other carbonaceous hearth material layers to further enhance the furnace atmosphere. High temperature caulking was used to seal seams on all exposed surfaces to minimize air infiltration.

Feed rate is controlled by an Automation-Direct PLC controlled hydraulic walking beam mechanism 724 that advances the trays 715 through the furnace 712. This device monitors time in each zone and advances trays 715 accordingly with the walking beam mechanism 724 while regulating feed rate. Furnace feed rate and position of the trays is displayed on an operating screen through communication with the PLC. A pair of side-by-side, castable refractory walking beams extends the length of the furnace 712. They are driven forward and back with a pair of hydraulic cylinders operated through the PLC. The beams are raised and lowered through a second pair of hydraulic cylinders that push the beam assemblies up and down a series of inclines (wedges) on rollers. Activation of the beam mechanism moves them through a total of 5 revolutions or 30 inches per cycle, the equivalent of one tray.

Sample trays 715 are manually prepared prior to starting the test. Additional trays may be also used, covered with coke or a carbonaceous reductant to regulate the furnace atmosphere. A roll plate platform elevator 52, raised and lowered with a pneumatic cylinder, is designed to align sample trays 715 at the feed 720 of the furnace for tray insertion. Raising the elevator 752 pushes open a spring-loaded feed door, exposing the feed section of the furnace to the atmosphere to insert trays. Trays are inserted into the furnace once the proper height and alignment is achieved. An automated tray feeding system is used to feed sample trays with a pneumatic cylinder.

The walking beam 724 transports trays 715 to the opposite end 722 of the furnace where they are discharged onto a similar platform (roller ball plate) elevator 754. A safety mechanism has been installed to monitor the position of the hot trays at the discharge of the furnace. Discharge rollers drive the trays onto the platform elevator where they can be removed or re-inserted back into the furnace. The discharge rollers will not function unless trays are in position for discharge, platform elevator is in the "up" position, and the walking beams have been lowered to prevent hot trays from accidental discharge. Tiered conveyor rollers are located at the discharge of the furnace to remove and store sample pallets until cool. To re-enter trays back into the furnace, a return cart has been designed that transports hot trays, underneath the furnace, back to the platform elevator at the feed end.

The exhaust gas system 747 is connected to an exhaust fan 753 with a VFD controlled by the furnace PLC. Because the exhaust fan 753 is oversized for this application, a manually controlled in-line damper or pressure control 753 is used to reduce the capacity of the exhaust fan 753 to improve zone pressure control. As a safety precaution, a barometric leg into a level controlled water tank is installed between the common header and exhaust fan to absorb any sudden pressure changes. Exhaust gases are discharged from the fan 753 to a forty-foot exhaust stack 757. The exhaust ducts are refractory lined to the exterior walls of the furnace where they transition to high temperature stainless steel (RA602CA), fitted with water spray nozzles 749, used to cool the waste gases. The temperature of the water gases from each zone is controlled with an in-line thermocouple and a manually controlled water flow meter attached to each set of water sprays. The stainless ducts are followed by standard carbon steel once the gases are sufficiently cooled. A thermocouple in the common header is used to monitor the temperature of the exhaust gas and minimize heat to the exhaust fan bearings.

The sample trays or pallets 715 (as shown in FIG. 35A) have 30 inch square refractory lined pans with a flat bottom to be conveyed through the furnace by the walking beam mechanism 724. The trays framework may be made from a 303 stainless steel alloy or carbon steel. They may be lined with high temperature refractory brick or ceramic fiberboard with sidewalls to contain the feed mixture.

The above described furnace systems are given for exemplary purposes only to further illustrate the nugget formation process 10 and provide certain details on testing and results reported herein. It will be recognized that any suitable furnace system capable of carrying out one or more embodiments of a metallic iron nugget formation process described herein may be used according to the present invention.

As generally described with reference to FIG. 1 and FIG. 3B, the channel openings 50 may be of multiple configurations and depths. As shown in FIG. 3B, the channel openings 50 form mounds 52 of reducible mixture in each of the nugget forming reducible material regions 59 (FIG. 3D). With the channel openings 50 extending a depth 56 into the layer of reducible mixture 46, the mounds 52, for example, may have a dome or spherical shape. Multiple alternate embodiments for alternate channel opening configurations are shown in FIGS. 5A through 7B, as well as in FIGS. 8A through 11E. Further, in FIGS. 8A through 10E, alternate types of channel definition tools 35 are shown which can be used to form such channel openings (e.g., channel openings that are associated with the formation of mounds in each of a plurality of nugget forming reducible material regions).

Figure 5A:
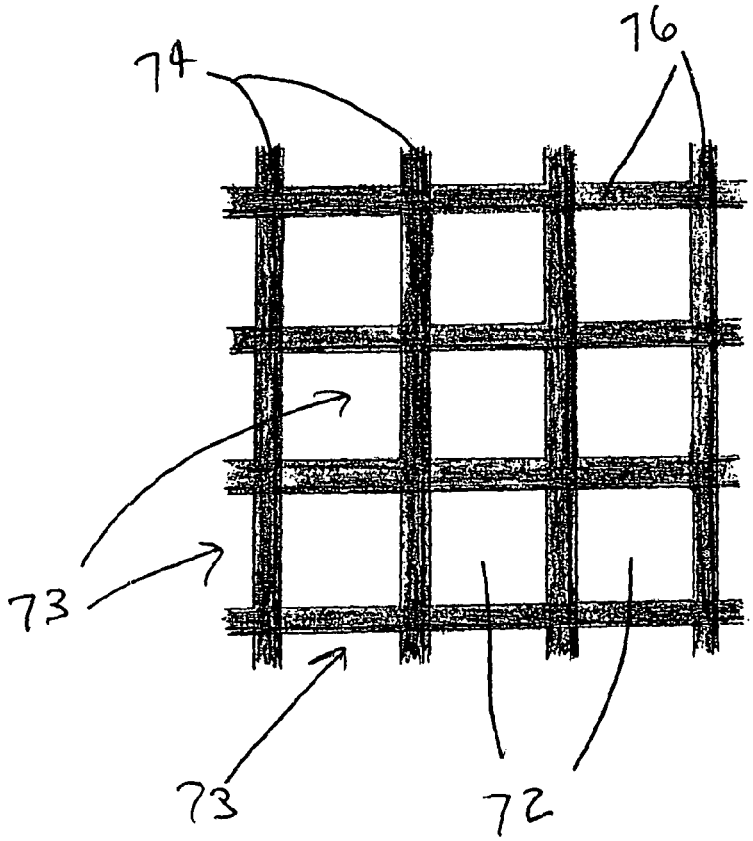
FIGS. 5A-5B show a top view and cross-section side view, respectively, of one embodiment of channel openings in a layer of reducible mixture for a metallic iron nugget process such as that shown generally in FIG. 1.
Figure 5B:
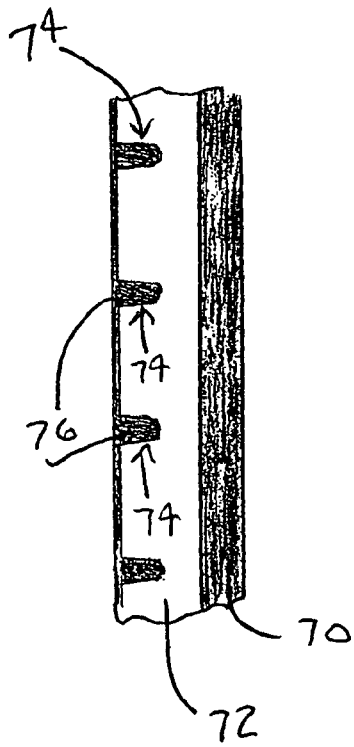

FIGS. 5A-5B show a top view and a cross-section side view of one alternate channel opening embodiment. As shown therein, a matrix of channel openings 74 are created in the layer of reducible mixture 72. Each channel opening 74 extends partially through the layer of reducible mixture 72 and does not extend completely to hearth material layer 70. The grid of channel openings 74 (e.g., channel openings of substantially the same size running both horizontally and vertically) form rectangular-shaped or square nugget forming reducible material regions 73. As shown in FIG. 5B, the channel openings 74 are basically a slight indentation into the layer of reducible mixture 72 (e.g., an elongated dimple). Each of the channel openings 74 are filled entirely with nugget separation fill material 76. Also as shown in FIG. 5B, the channel openings 74 extend to a depth that is about half of the thickness of the reducible mixture 72.

Figure 6A:
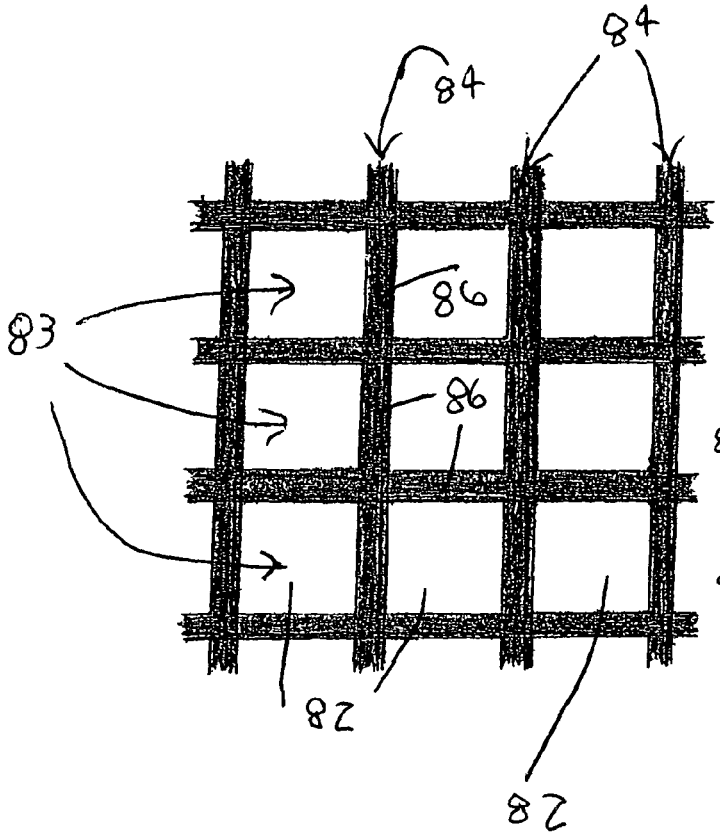
FIGS. 6A-6B show a top view and a cross-section side view, respectively, of an alternate embodiment of channel openings in a layer of reducible mixture for use in a metallic iron nugget process such as that shown generally in FIG. 1.
Figure 6B:
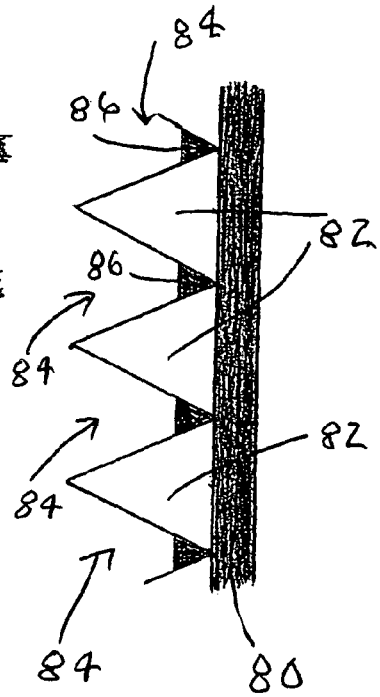

FIGS. 6A-6B show a top view and a cross-section side view of yet another alternate embodiment of a channel opening configuration. As shown therein, a first set of channel openings 84 run in a first direction and an additional set of channel openings 84 run in a second direction orthogonal to the first direction. As such, rectangular-shaped nugget forming reducible material regions 83 are formed. The mounds of reducible mixture 82 are of substantially a pyramidal shape due to the channel openings being V-shaped grooves 84. As shown in FIG. 6B, the V-shaped grooves 84 extend to hearth material layer 80 and the channel openings 84 are filled with nugget separation fill material 86. The nugget separation fill material 86 is filled to less than one-half of the depth of the V-shaped groove channels 84.

Figure 7A:
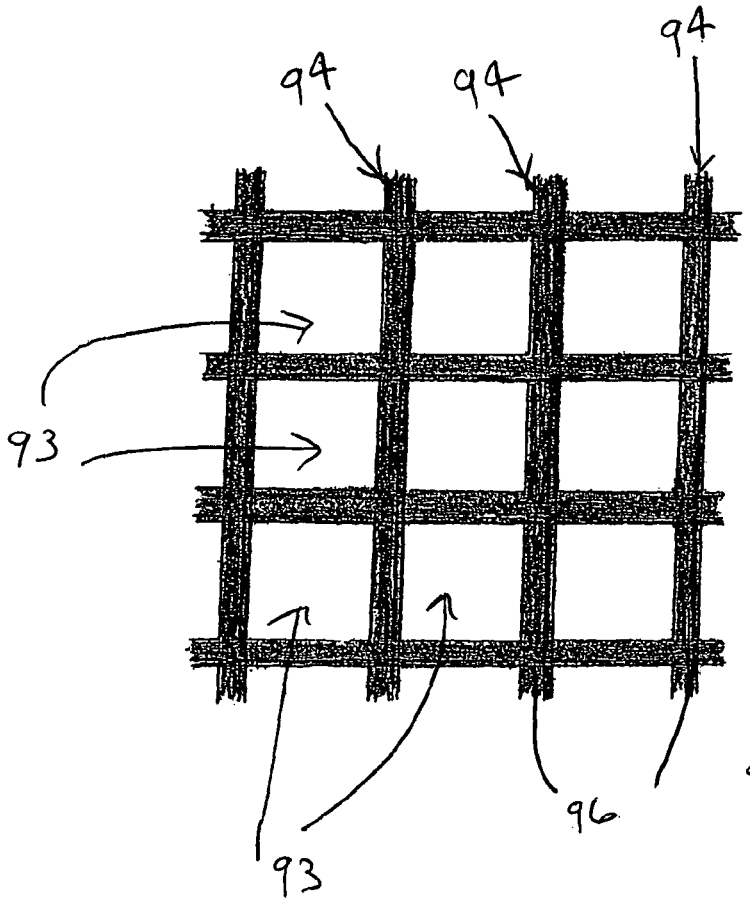
FIGS. 7A-7B show a top view and a cross-section side view, respectively, of yet another alternate embodiment of channel openings in a layer of reducible mixture for use in a metallic iron nugget process such as that shown generally in FIG. 1.
Figure 7B:
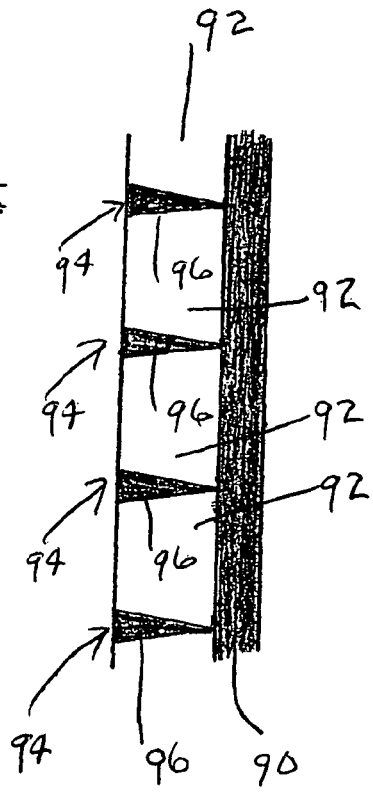

FIGS. 7A-7B show a top view and a cross-section side view of yet another alternate embodiment of a channel opening configuration wherein a grid of V-shaped grooves form rectangular-shaped nugget forming reducible material regions 93. The V-shaped channel openings 94 generally form a truncated pyramidal mound of reducible mixture 92 in each of the nugget forming reducible material regions 93. Nugget separation fill material 96 entirely fills each of the V-shaped grooves 94. The V-shaped channel openings 94 extend to the hearth material layer 90.

As shown in the multiple embodiments, one will recognize that the channel openings may be formed to extend through the entire reducible mixture layer to the hearth material layer or only partially therethrough. Further, one will recognize that the nugget separation fill material may entirely fill each of the channel openings or may only partially fill such openings.

Figure 8B:
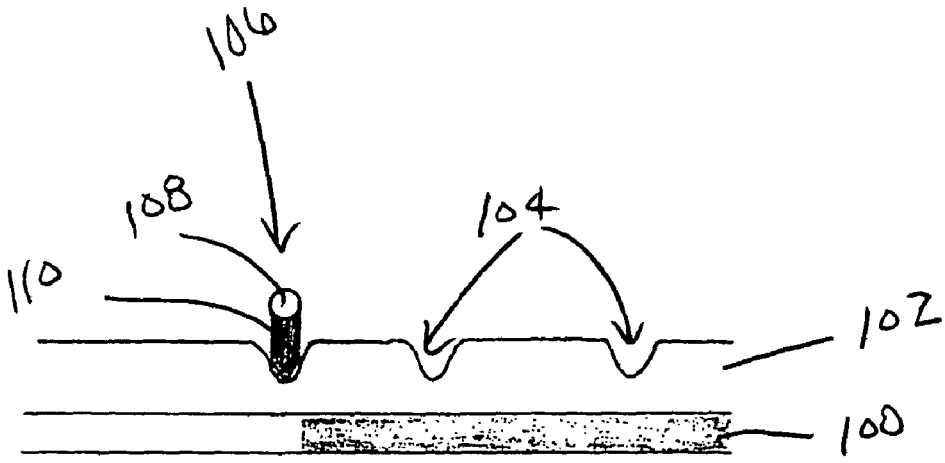
FIGS. 8A-8B show a top view and a cross-section side view, respectively, of one embodiment of a channel formation tool for use in a metallic iron nugget process such as that shown generally in FIG. 1.
Figure 8A:
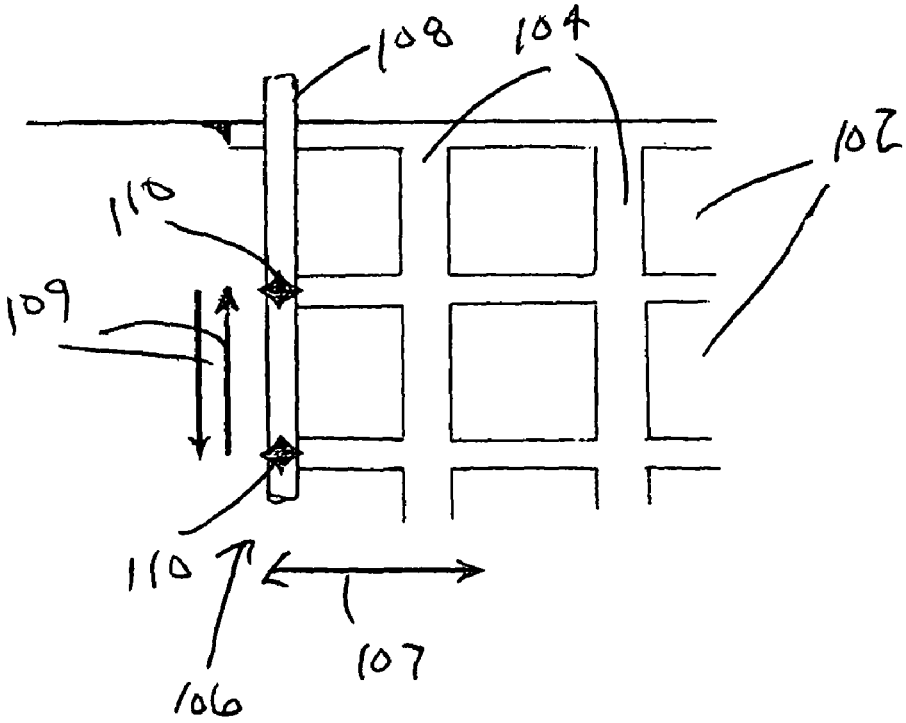

FIGS. 8A-8B show a top view and a cross-section side view, respectively, of yet another alternate embodiment of a channel opening configuration. In addition, FIGS. 8A-8B show a definition tool 106 for use in forming channel openings 104 in a layer of reducible mixture 102 that has been provided on hearth material layer 100. The channel openings 104 are generally elongated grooves created in the layer of reducible mixture 102 by the channel definition tool 106.

The channel definition tool 106 includes a first elongated element 108 and one or more extension elements 110 extending orthogonally from the elongated element 108. As shown by direction arrows 107, 109, the channel definition tool 106 and/or the reducible mixture 102 may be moved along both x and y axes to move sufficient material of the reducible mixture to create the channel openings 104. For example, when element 108 and/or the reducible mixture 102 is moved in the direction represented by arrow 107, channels are created which are orthogonal to those created when the tool 106 is moved in the direction 109. In one embodiment, the elongated element 108 need not move in the direction represented by arrow 107, as the layer of reducible mixture 102 is moving, for example, to the right at a constant speed such as in a continuous forming process shown in FIG. 10A.

Figure 9B:
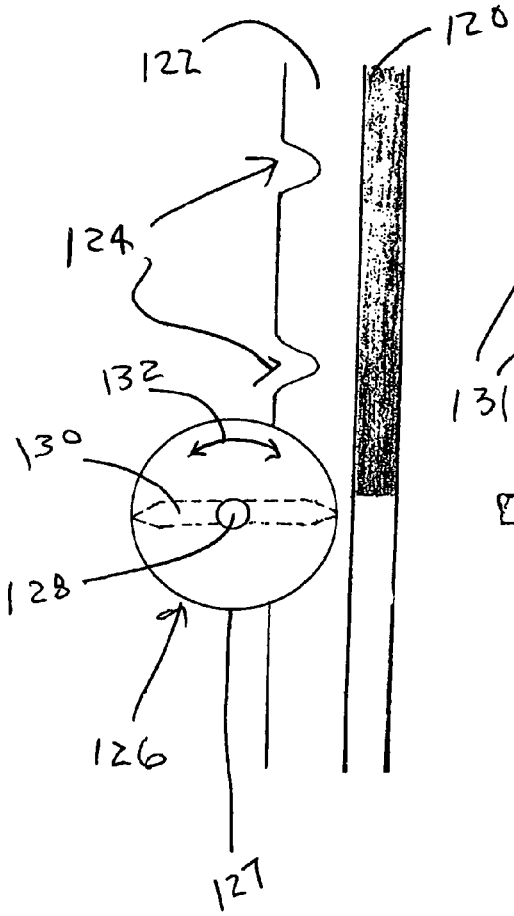
FIGS. 9A-9B show a top view and a cross-section side view, respectively, of another embodiment of a channel formation tool for use in a metallic iron nugget process such as that shown generally in FIG. 1.
Figure 9A:
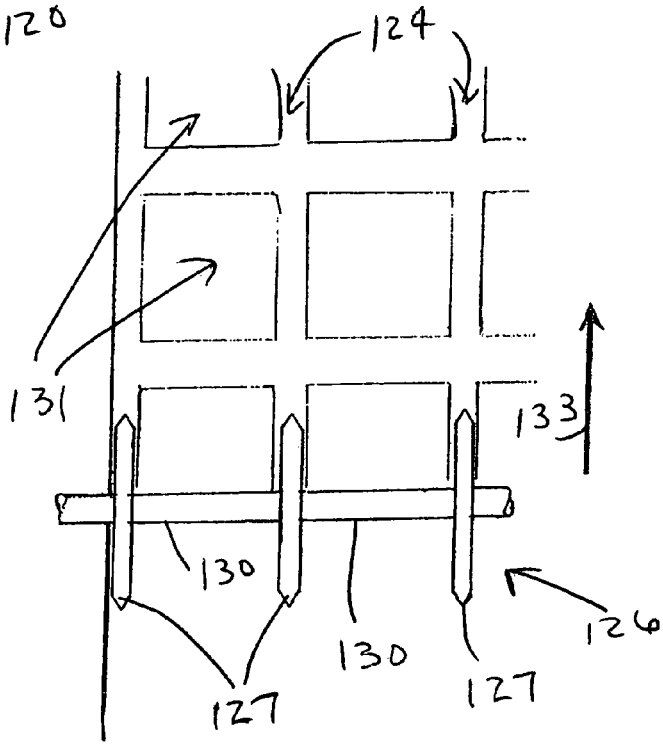

FIGS. 9A-9B show a top view and a cross-section view, respectively, of yet another alternate channel opening configuration along with a channel definition tool 126 for forming channel openings 124 in a layer of reducible mixture 122 provided on hearth material layer 120. The channel openings 124 include a matrix of elongated grooves in a first and second direction that are orthogonal to one another and which form generally a matrix of rectangular nugget forming reducible material regions 131.

The channel definition tool 126 includes a first elongated rotating shaft element 128 that includes a plurality of spaced-part disc elements 127 mounted orthogonally relative to the elongated shaft element 128. In one exemplary embodiment, the disc elements 127 rotate in place to create grooves when the reducible feed mixture 122 moves in direction 133. In other words, bidirectional arrow 132 indicates rotation of the shaft element 128 and, as such the one or more disc elements 127 such that rotation of disc elements 127 (when the layer of reducible mixture 122 is moved in the direction 133) produces groove-shaped channels 124 in a first direction (i.e., in the direction of arrow 133). In one embodiment, the channel definition tool 126 further includes one or more flat blades 130 connected to the rotating shaft element 128 between the disc elements 127. The flat blades 130 (e.g., two blades mounted 180 degrees apart as shown in FIG. 9B, three blades mounted 120 degrees apart, etc.) plough the reducible mixture 122 in the cross-wise direction (i.e., orthogonal to the direction of arrow 133) as the layer of reducible mixture 122 is moving, for example, at a constant speed such as in a continuous forming process shown in FIG. 10A.

One will recognize that channel openings 124 extending in direction 133 may be created by the same or a different channel definition tool as those created orthogonal thereto. For example, channel definition tool 126 may be used to create channels 124 along direction 133, whereas the channel tool 106, as shown with reference to FIGS. 8A-8B, may be used to form the channels 124 that extend orthogonal thereto. In other words, the same or multiple types of channel definition tools may be used to create the channel openings in one or more different alternate channel opening configurations described herein, and the present invention is not limited to any particular channel definition tool or combination of devices.

Figure 10A:
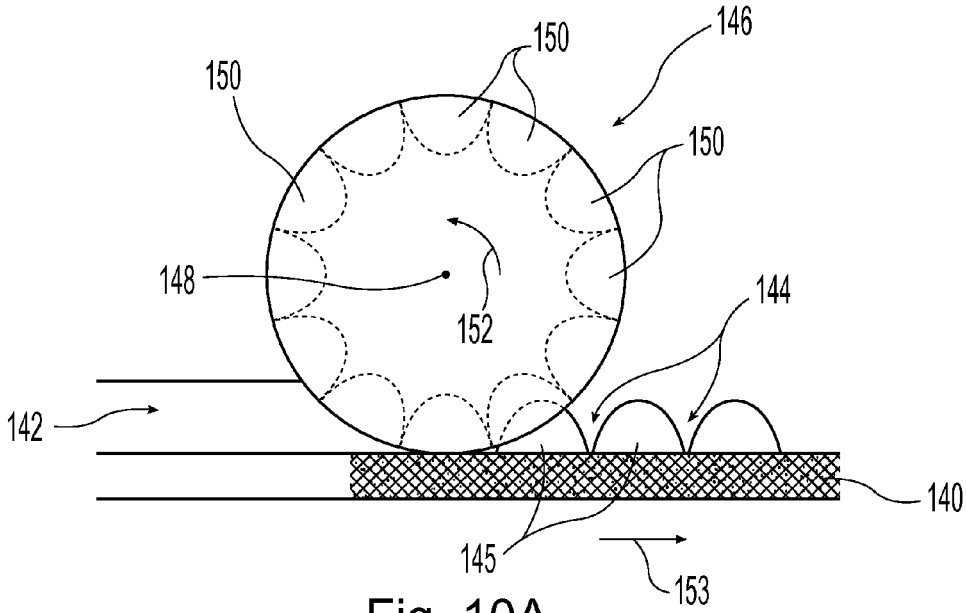
FIGS. 10A-10B show cross-section side views of yet other embodiments of a channel formation tool for use in a metallic iron nugget process such as that shown generally in FIG. 1.

FIG. 10A is an illustrative side cross-section view of yet another alternate channel opening configuration in combination with a channel definition tool 146. As shown in FIG. 10A, channel definition tool 146 creates mounds 145 in a layer of reducible mixture 142, similar to those shown generally in FIGS. 3B-3C. The channel definition tool 146 is rotated, for example, in the direction of arrow 152 and across the layer of reducible mixture 142 to form mounds 145 in a shape corresponding to mold surface 150 as the layer of reducible mixture 142 is moved in the direction of arrow 153.

In other words, the channel definition tool 146 includes an elongated element 148 extending along an axis about which the tool 146 rotates. One or more mold surfaces 150 are formed at a location radial from axis 148. As shown in FIG. 10A, such mold surfaces 150 extend along the entire perimeter at a radial distance from axis 148 and also along axis 148 (although not shown). The mold surfaces 150 may be formed in any particular configuration to form the shape of channel openings 144 which correspond directly to the shape of mounds 145 formed in the layer of reducible mixture 142 that is provided on the hearth material layer 140. One will recognize that the mounds need not be spherically-shaped, have curved surfaces, but may be of any other shape such as a pyramidal molded mound, a truncated pyramidal mound, etc.

Figure 10B:
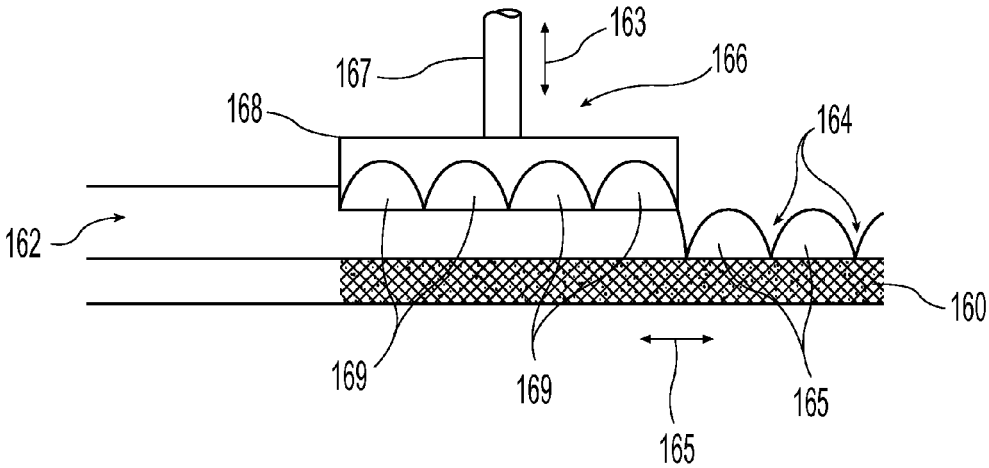

FIG. 10B shows yet another alternate embodiment of a channel definition tool 166 for forming channel openings 164 and mounds 165 in the layer of reducible mixture 162 that are substantially similar to those formed as described with reference to FIG. 10A. As shown in FIG. 10B, the channel definition tool 166 is in the form of a stamping apparatus having a plurality of mold surfaces 169 at a lower region of a stamping body member 168. The mold surfaces 169 correspond to the shape of the channel openings 164 and the mounds 165 which are to be formed thereby. As represented generally by elongated element 167 extending from the stamping body member 168 and arrow 163, a force is applied to the stamping apparatus to form the mounds 165 by lowering the molded surfaces 169 onto the reducible mixture 162. Upon lifting the stamping apparatus and movement of the reducible mixture for the stamping apparatus in a direction represented generally by arrow 165, the channel definition tool may be moved to another region of reducible mixture 162 and then once again lowered to form additional mounds 165 and channel openings 164.

As described herein, various channel definition tools may be used to form the mounds and associated channel openings according to the present invention. However, in one embodiment, dome-shaped or substantially spherical mounds, such as those shown in FIGS. 10A-10B and FIGS. 3B-3C, are provided. As shown in such figures, the openings extending to a depth within the layer of reducible mixture may extend to the hearth material layer or only partially through the reducible mixture. Further, as shown in such figures, the channels forming such dome-shaped mounds may be partially or entirely filled with the nugget separation fill material. In one particular embodiment, the nugget separation fill material is provided in less than about three-quarters of the channel depth for the channel openings forming such dome or spherically-shaped mounds.

Figure 10C:
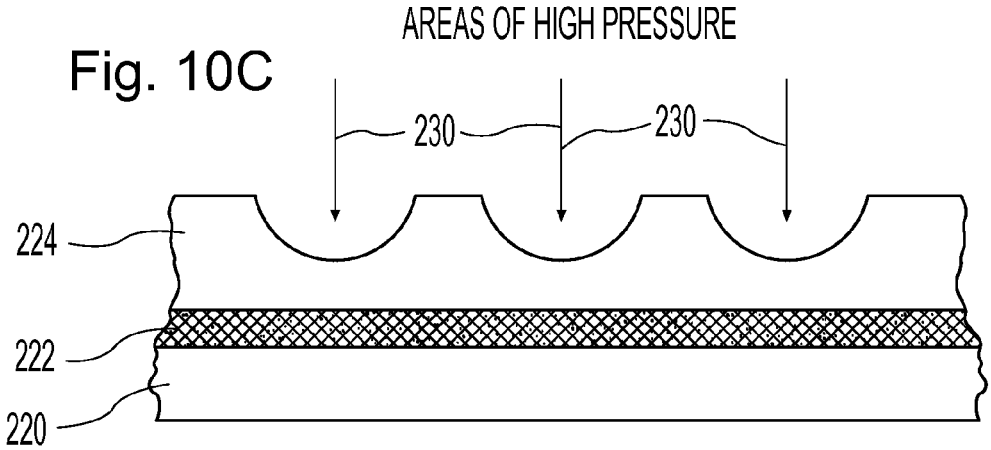
FIGS. 10C-10E show cross-section side views of yet other embodiments of reducible mixture formation techniques for use in one or more embodiments of a metallic iron nugget process.
Figure 10D:
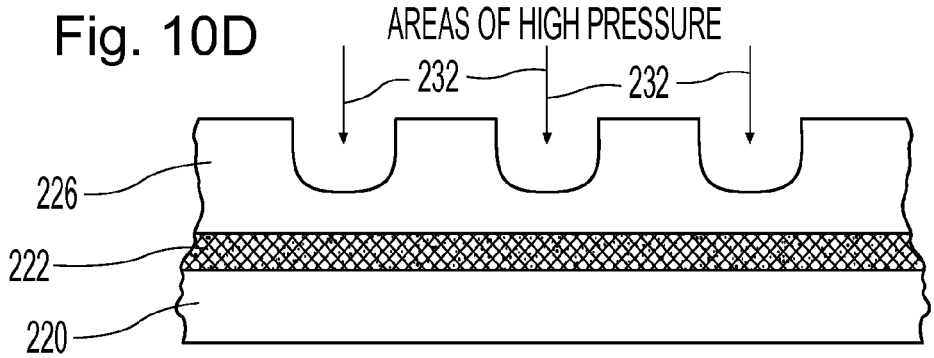
Figure 10E:
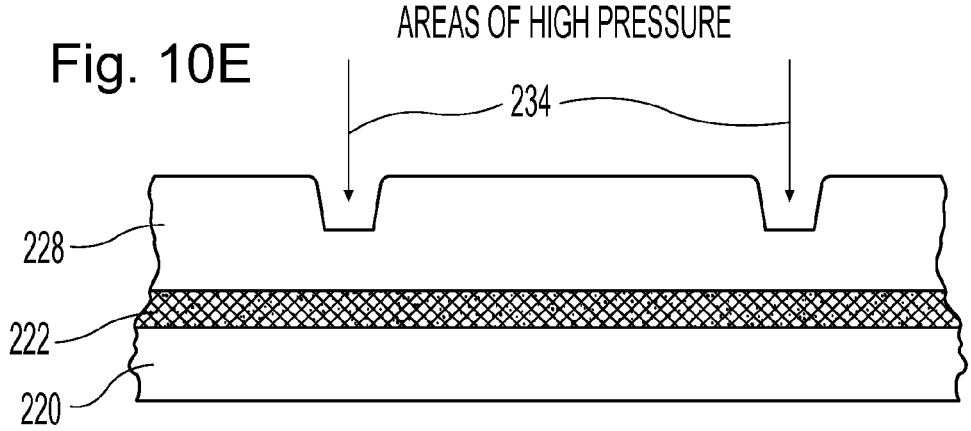

FIGS. 10C-10E are provided to illustrate the use of pressure or compaction as a control parameter in one or more embodiments of a metallic iron nugget formation process. One or more illustrative embodiments of reducible mixture formation techniques apply pressure or compaction to the reducible mixture on the hearth to provide an added control parameter to the nucleation and growth process of the metallic nuggets. For example, use of pressure or compaction as a control parameter makes it possible to nucleate, locate, and grow larger nodules on the hearth. For a given temperature, the nodule resulting in a metallic nugget will nucleate and grow at the point of highest compaction or pressure.

The use of pressure or compaction may be combined with any of the described embodiments herein or as an alternative thereto. For example, and as described herein, in the formation of the channels or formation of the reducible mixture on the hearth material, compaction or pressure (e.g., pressing using one or more of the channel definition tools) may be used to alter the nugget formation process. Such compacted reducible mixture may be used alone or in combination with nugget separation fill material being provided in openings formed by compaction or pressure.

Further, for example, a compaction apparatus (e.g., a briquetting cylinder or roll or a briquetting press) may be used to optimize the size and/or shape of the nuggets formed. The compaction apparatus may, for example, be configured to imprint a pattern into a layer of reducible mixture (e.g., iron-bearing fines and a reducing material). The deeper the imprint, the greater would be the compaction in a particular area. Such compaction may result in greater throughput for the nugget formation process. Further, it may be possible to increase the size of nuggets to a point where solidification rates and other physical parameters restrict formation of metallic nuggets and slag separation.

In a uniform temperature environment, the areas of greater compaction should enhance heating and diffusion, thereby acting as the nucleation and collection site for metallic nuggets, providing a manner to locate where a nugget will form on the hearth. Further, it may be possible to use the added degree of freedom brought about by the compaction or pressure as a control parameter to counteract the negative effects of a non-uniform temperature profile across the hearth that may result as a consequence of furnace geometry (e.g., edge effects) and heat source location in the furnace. Yet further, in addition to use of pressure to control reaction rates (i.e., in the formation of metallic nuggets), diffusion rates of reducing gases can be varied by using pressure in combination with particle size, to control the pathways for gases entering the formed material. Likewise, solid state reaction rates of particulates, as governed by heat transfer and metallurgical diffusion mechanisms, can also be varied.

Various compaction profiles are shown in FIGS. 10C-10E. However, such profiles are only illustrative of the many different compacts that could be formed using pressure and compaction. Compacts refer to any compacted reducible mixture or other feed material that has pressure applied thereto when formed to a desired shape (e.g., compaction or pressure used to form mounds on a hearth, used to provide one or more compaction profiles in a layer of reducible material, or used to form compacted balls or compacted rectangular-shaped objects, such as dried balls or briquettes that are preformed using compaction or pressure and provided to the hearth for processing). It will be recognized that different pressurization during formation of the compacts may result in different processing characteristics.

FIG. 10C-10E show a hearth 220 upon which is provided a hearth material layer 222. A compacted reducible mixture layer 224, 226, and 228 are shown in the respective FIGS. 10C-10E. FIG. 10C includes arc-shaped compacted depressions 230 in the reducible mixture layer 224, FIG. 10D includes arc-shaped compacted depressions 232 in the reducible mixture layer 226 where higher pressure is applied than in FIG. 10C, and FIG. 10E includes more tapered straight wall configured compacted depressions 234 in the reducible mixture layer 228. However, one will recognize that any compacted pattern may be provided in the reducible mixture layers for use in a nugget formation process and the FIGS. 10C-10E are provided for illustration only.

Figure 11A:
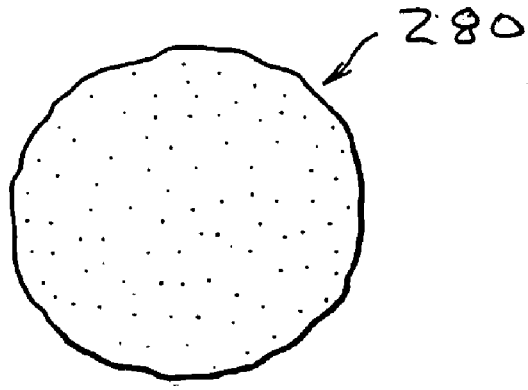
Figure 11B:
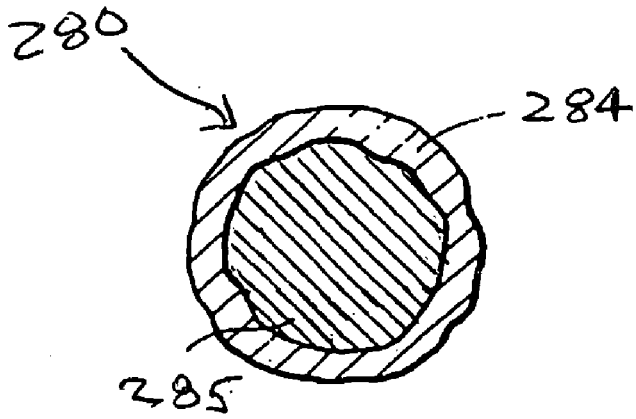
Figure 11C:
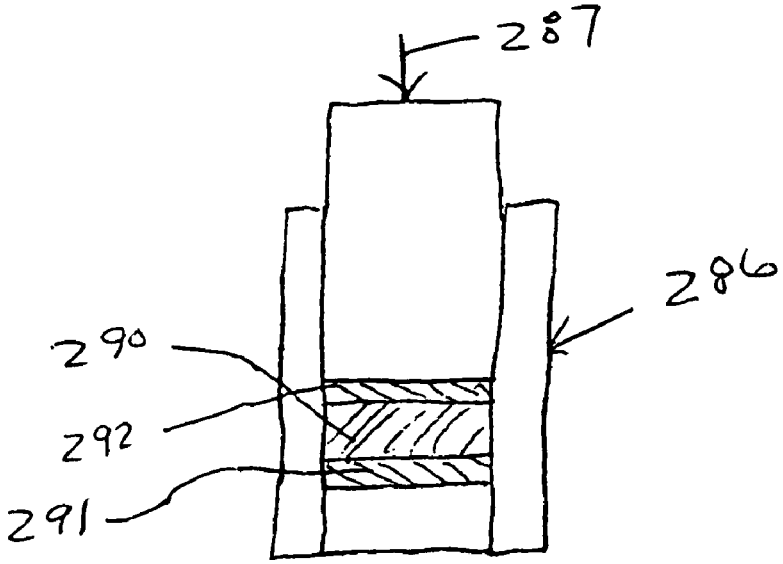
Figure 11D:
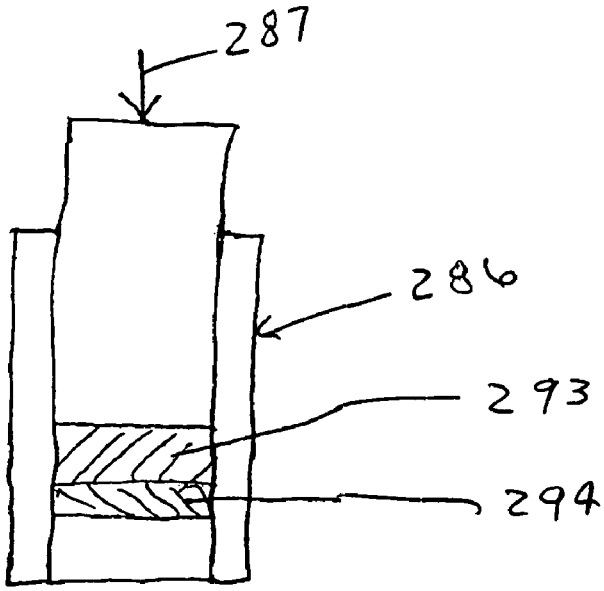
Figure 11E:
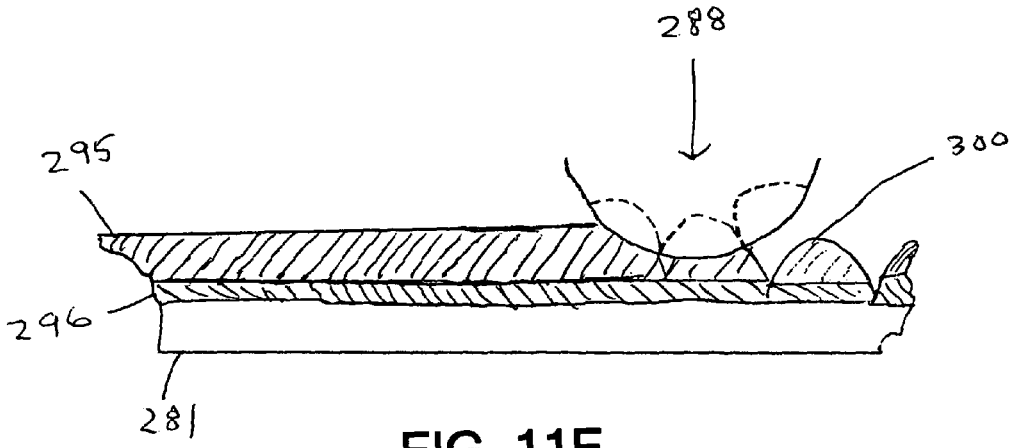
Figure 11F:
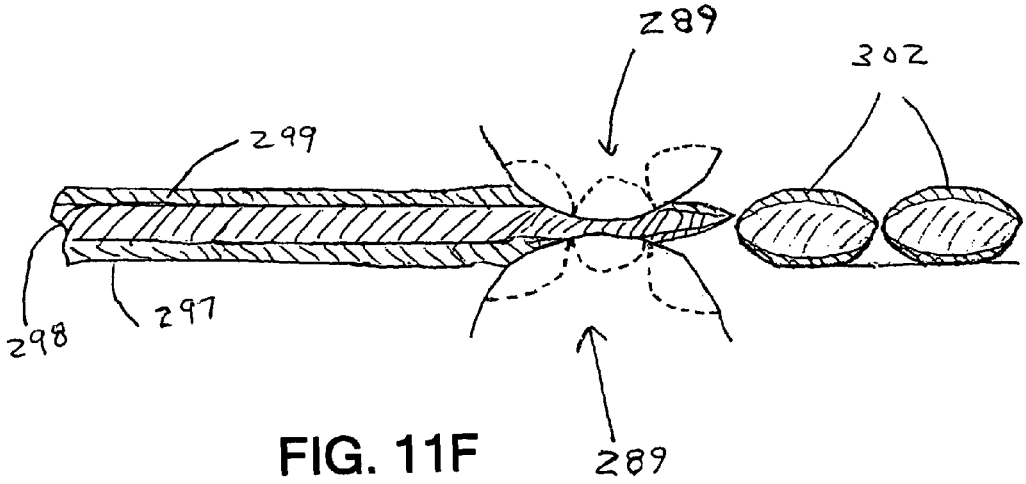

Further, FIGS. 11A-11E show various other illustrations of that may use compaction to form the reducible mixture having one or more compositions as described herein. For example, FIGS. 11A-11B show preformed balls (e.g., compacted or, otherwise formed without compaction or pressure, such as with use of a binder material) of reducible mixture for use in one or more embodiments of a metallic iron nugget process, wherein FIG. 11A shows a multiple layered ball of reducible mixture and further wherein FIG. 11B shows a multiple layered ball having layers of different compositions. FIGS. 11C-11D show compaction used to provide compacts (e.g., briquettes) of reducible mixture for use in one or more embodiments of a metallic iron nugget process, wherein FIG. 11C shows formation of three layer compacts, and further wherein FIG. 11D shows formation of two layer compacts. Further, FIGS. 11E-11F show use of compaction (e.g., through the molding process) for use in providing compacts (e.g., briquettes) of reducible mixture for use in one or more embodiments of a metallic iron nugget process, wherein FIG. 11E shows formation of two layer compacts, and further wherein FIG. 11F shows formation of three layer compacts. FIGS. 11A-11E are described further herein with reference to using different % levels of reducing material (e.g., carbonaceous material) or other constituents thereof (e.g., additives) in different layers of the formed reducible mixture.

FIGS. 12A through 15D shall be used to illustrate one or more exemplary embodiments of the present invention and the effect of the amount of nugget separation fill material used in the channel openings. To increase the exposed surface area of the layer of reducible mixture to the furnace atmosphere, forming the mixture into a simple shape assists in separation of the layer of reducible mixture into individual nuggets, and also minimizes the time required to form fully-fused iron nuggets.

Figures 12A, 12B, 12C:
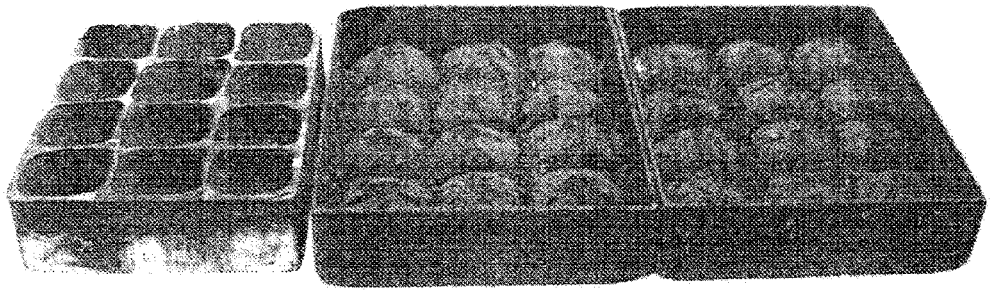
FIGS. 12A-12C show a 12-segment, equi-dimensional dome-shaped mold, and also reducible mixtures in graphite trays according to one or more exemplary embodiments of a metallic iron nugget process according to the present invention.

As shown in one example according to FIG. 12A, a 12-segment, equi-dimensional, dome-shaped wooden mold of 1⅜ inch×1⅜ inch×1 inch deep at the apex in each hollow was fabricated and used to shape a layer of reducible mixture in graphite trays (i.e., having a size of 5 inches by 6 inches) that included a 5.7 percent $SiO_2$ magnetic concentrate and medium-volatile bituminous coal at 80 percent of the stoichiometric requirement for metallization at Slag composition (A). The reducible mixture was placed in a uniform thickness over a pulverized coke layer, and the wooden mold was pressed against the reducible mixture to form the simple dome-shaped islands of the reducible mixture, as shown in FIG. 12B. When the channel openings or grooves between the dome-shaped islands of reducible feed mixture are left without any nugget separation fill material or coke, and after processing in the box furnace at 1450° C. for 6 minutes in an 80% $N_2$-20% CO atmosphere, nuggets were formed. However, the resulting nugget product after processing included uncontrollable coalescence of molten iron (e.g., the nuggets did not separate effectively and were not uniform in size).

As shown in the example of FIG. 12C, a molded 12-segment pattern of reducible feed mixture including a 5.7% $SiO_2$ magnetic concentrate, medium volatile bituminous coal at 80% of the stoichiometric amount at slag composition (A) was provided. The 12-segment pattern has the grooves thereof fully filled with pulverized coke and was processed in the box furnace at 1450° C. for 6 minutes in an 80% $N_2$-20% CO atmosphere. The results of such processing is shown in FIGS. 13A and 14A as will be described below.

FIGS. 13A-13D and FIGS. 14A-14D show the effect of coke levels in grooves or channel openings of the 12-segment, dome-shaped feed mixture. FIG. 13A shows the effect of coke levels in grooves of the 12-segment, dome-shaped feed mixture, filled with pulverized coke to the full level (e.g., the entire channel opening depth as described above), FIG. 13B shows the effect when such grooves or channel openings are filled to a half level, FIG. 13C shows the effect when such groove or channel openings are filled to a quarter level, and FIG. 13D shows the effect when no coke or nugget separation fill material is provided in the channel openings such as described above with reference to FIG. 12B.

As shown therein, and also in corresponding FIGS. 14A-14D, when the grooves were not filled or were quarter-filled with coke, some of the iron nuggets were combined into larger sizes and their sizes could not be controlled. When the grooves were filled to a half-level, each segment retained its size to form fully fused iron nuggets.

The thermal processing to form the iron nuggets was performed in the electric box furnace at a temperature of 1450° C. for 6 minutes. At 5.5 minutes, an iron nugget at center showed a sign of being on the verge of full fusion. Accordingly, it could be concluded that 5.5 minutes was the minimum time required for full fusion with the molded pattern.

The example shown in FIGS. 15A-15D further shows the effect of using hearth nugget separation fill material in the channel openings of reducible mixture layer. Providing such hearth nugget separation fill material in the grooves or channel openings is believed to cause a reducible mixture in each region (e.g., a rectangle region of reducible mixture) to shrink away from each other and separate into individual iron nuggets. The size of the rectangles and the thickness of the layer of reducible mixture controls the resulting nugget size.

Figures 15A, 15B, 15C, 15D:
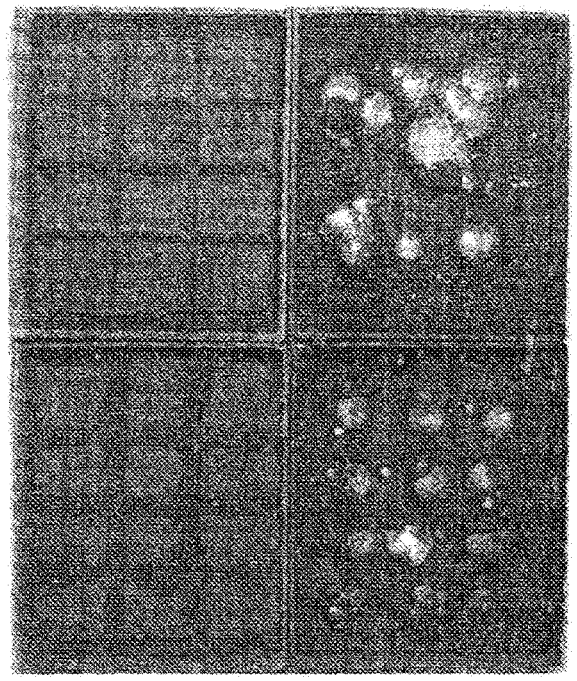

As shown in FIG. 15A, controlling iron nugget sizes may be accomplished by cutting a rectangular pattern of grooves in a layer of reducible mixture. In this case, a mixture including a 5.7% $SiO_2$ magnetic concentrate and medium volatile bituminous coal at 80% of the stoichiometric amount at slag composition (A) is provided. The degree to which the grooves forming the nugget forming reducible mixture regions need to be filled with carbonaceous material is exemplified by pressing a layer of reducible mixture 16 millimeters thick with 13 millimeter deep grooves to form a 12 square pattern, as shown in FIGS. 15A-15D.

The grooves in the reducible mixture of FIG. 15A were left empty and, in another test embodiment, the grooves were filled with 20/65 mesh coke, as shown in FIG. 15C. The trays were heated in the box furnace at 1450° C. for 13 minutes in an 80% $N_2$-20% CO atmosphere. The results are shown in FIGS. 15B and 15D, respectively. Without pulverized coke or carbonaceous material in the grooves, some squares shrank to form individual iron nuggets, while others combined to form larger iron nuggets. There was little control over the size of iron nuggets when nugget separation fill material (e.g., carbonaceous material) is not used in the channel openings or grooves. As the individual squares of molten iron spread by its own weight, they touched each other and coalesced into larger sizes. The molten iron of larger sizes eventually approaches a constant thickness, as determined by a balance between a spreading force due to its own weight and the restraining force due to its surface tension.

As shown in FIG. 15D, when nugget separation fill material (e.g., carbonaceous material, such as pulverized coke) was placed in the grooves or channel openings, individual iron nuggets were kept separated and uniform-sized iron nuggets could be obtained. Filling of the grooves with coke particles helped assist each mound of reducible material to form individual molten iron nuggets separately and uniformly.

The above exemplary illustrations provide support for the provision of channel openings in the layer of reducible mixture to define metallic iron nugget forming regions (block 22), as described with reference to FIG. 1. Thermal treatment of such shaped regions of reducible material results in one or more metallic iron nuggets.

Further, at least in one or more embodiments according to the present invention, the channel openings are filled at least partially with nugget separation fill material (e.g., carbonaceous material) (block 26) as described in the examples herein. With use of such channel openings 50 and nugget separation fill material 58 therein, as shown, for example, in FIGS. 3B-3C, substantially uniformly-sized metallic iron nuggets 63 are formed in each nugget forming reducible material region 59 defined by the channel openings 50.

In one embodiment, and as shown in FIGS. 4A-4C, each of the one or more metallic iron nuggets includes a maximum cross-section. One or more of the metallic iron nuggets includes a maximum length across the maximum cross-section that is greater than about 0.25 inch and less than about 4.0 inch. In yet another embodiment, a maximum length across the maximum cross-section is greater than about 0.5 inch and less than about 1.5 inch.

Further, as shown and described with reference to FIG. 1, the carbonaceous material of the hearth material layer 44, generally provided according to block 14, may be modified in one or more different manners. As previously described, the carbonaceous material is generally fine enough so slag does not penetrate the hearth material layer 44 so as to react undesirably with the refractory material of hearth 42.

The hearth material layer 44 (e.g., the size distribution thereof) may influence the amount of mini-nuggets and micro-nuggets generated during the reduction processing of the layer of reducible mixture 46. For example, at least in one embodiment, the hearth material layer 44 includes a pulverized coke layer having a size distribution of +65 mesh fraction of the "as ground" coke. In another embodiment, +28 mesh fraction of "as ground" coke is used as the hearth material layer. With the use of mounds 52, such as shown in FIG. 3B (e.g., dome-shaped patterns of reducible mixture) on such a hearth material layer 44, as an island of the reducible mixture shrinks to form a nugget through thermal processing, some magnetic concentrate is trapped in the interstices of the hearth material layer 44 (e.g., pulverized coke layer) and forms micro-nuggets as previously defined herein.

Due to the presence of excess carbon, the micro-nuggets do not coalesce with the parent nugget in the nugget forming reducible material region 59 or among themselves. Such formation of micro-nuggets is undesirable and ways of reducing micro-nugget formation in processes such as those described according to the present invention are desirable.

While the hearth material layer 44 which may include pulverized coke may generate a large quantity of micro-nuggets when dome-shaped mound patterns are used, a pulverized alumina layer has been found to minimize their amount. Although the use of alumina demonstrates the role played by a carbonaceous hearth material layer 44 in generating micro-nuggets, pulverized alumina cannot be used as a hearth material layer 44 because of its reactiveness with slag.

In order to minimize the generation of micro-nuggets when channel opening defined mounds are processed according to the present invention, the effect of different types of hearth material layers 44 have been compared indicating that the hearth material layer, or carbonaceous material thereof, may be optionally modified (block 16 of FIG. 1) for use in the metallic iron nugget process 10 according to the present invention. The amount of micro-nuggets formed can be estimated by:

$$\%\ \text{micro nuggets} = Wt_{micro\ nuggets}/(Wt_{nuggets} + Wt_{micro\ nuggets}) \times 100$$

The results of one or more exemplary illustrative test embodiments are shown in the table of FIG. 16. In the table, it is noted that a mixture of coke and alumina, or $Al(OH)_3$-coated coke, may be used according to the present invention to decrease the percentage of micro-nuggets formed in the metallic iron nugget process 10. The results shown in the table of FIG. 16 were a result of illustrative test embodiments as follows.

For the "12 elongated domes" data shown in FIG. 16, a 12-segment, elongated dome-shaped pattern of feed mixture with grooves filled with pulverized coke to a half level was heated at 1450° C. (2642° F.) in the box furnace for 5.5 minutes in a $N_2$—CO atmosphere to produce individual fully fused iron nuggets. Only the hearth material layer was modified as shown in the table of FIG. 16.

For the "12 and 16 balls" data of FIG. 16, an equal weight of a feed mixture at Slag Composition (A), was used to form equal sized balls, and such balls were processed by heating at 1450° C. (2642° F.) in the box furnace for 5.5 minutes in a $N_2$—CO atmosphere to produce individual fully fused iron nuggets. The processing of the balls resulted in very little micro-nugget formation (e.g., 0.4% and 0.8%).

Two extremes of the effect of hearth layer materials are contrasted in the table of FIG. 16. While the hearth material layer of pulverized coke generated a large amount of micro nuggets (13.9%), a pulverized alumina layer minimized the amount (3.7%) of micro-nuggets. However, as indicated above, pulverized alumina may not be used as a hearth layer material in practice.

The results when only coke and an equal weight (50:50) mixture of coke and alumina were used as the hearth layer, are compared. The amount of micro-nuggets was reduced to less than a half by the presence of alumina in the hearth material layer.

Further, pulverized coke was coated with $Al(OH)_3$ by mixing 40 g of coke in an aqueous slurry of $Al(OH)_3$, dried and screened at 65 mesh to remove excess $Al(OH)_3$. The coke acquired 6% by weight of $Al(OH)_3$. The $Al(OH)_3$-coated coke was used as the hearth material layer. The amount of micro-nuggets notably decreased (3.9%).

Yet further, pulverized coke was coated with $Ca(OH)_2$ by mixing 40 g of coke in an aqueous slurry of $Ca(OH)_2$, dried and screened at 65 mesh to remove excess $Ca(OH)_2$. The coke acquired 12% by weight of $Ca(OH)_2$. The $Ca(OH)_2$-coated coke was used as the hearth material layer. Apparently, the coating of $Ca(OH)_2$ had essentially no effect on the generation of micro-nuggets (14.2%). It may be speculated that an addition of $CaF_2$ to $Ca(OH)_2$ in the coating would minimize the amount of micro-nuggets by lowering the fusion of high lime slag as in the case of Slag Composition $L_{1.5}FS_{1.5\sim2}$, see FIGS. 21A and 23.

As described previously with reference to FIG. 1, the layer of reducible mixture 46 for use in the metallic iron nugget process 10 according to the present invention may include one or more additives in combination with the reducing material and the reducible iron-bearing material (e.g., reducible iron oxide material). One method 200 for providing the reducible mixture 46 (with optional additives) is shown in the block diagram of FIG. 17. The method includes providing a mixture of at least reducing material (e.g., carbonaceous material such as coke or charcoal) and reducible iron oxide material (e.g., iron-bearing material such as shown in FIG. 33) (block 202). Optionally, for example, calcium oxide or one or more compounds capable of producing calcium oxide upon thermal decomposition thereof (block 204) may be added to the reducible mixture. Further, optionally, sodium oxide or one or more compounds of producing sodium oxide upon thermal decomposition thereof may be provided (block 206) in combination with the other components of the reducible mixture. Yet further, one or more fluxing agents may optionally be provided for use in the reducible mixture (block 208).

The one or more fluxing agents that may be provided for use with the reducible mixture (block 208) may include any suitable fluxing agent, for example, an agent that assists in the fusion process by lowering the fusion temperature of the reducible mixture or increases the fluidity of the reducible mixture. In one embodiment, calcium fluoride ($CaF_2$) or fluorspar (e.g., a mineral form of $CaF_2$) may be used as the fluxing agent. Further, for example, borax, NaF, or aluminum smelting industry slag, may be used as the fluxing agent. With respect to the use of fluorspar as the fluxing agent, an amount of about 0.5% to about 4% by weight of the reducible mixture may be used.

Use of fluorspar, for example, as well as one or more other fluxing agents, lowers the fusion temperature of the iron nuggets being formed and minimizes the generation of micro-nuggets. Fluorspar was found to lower not only the nugget formation temperature, but also to be uniquely effective in decreasing the amount of micro-nuggets generated.

In an attempt to improve sulfur removal capacity of slag, as shall be described further herein, the level of lime or one or more other compounds capable of producing calcium oxide is typically increased beyond a composition (L), as shown on the $CaO—SiO_2—Al_2O_3$ phase diagram of FIG. 21A which indicates the slag compositions of (A), (L), ($L_1$), and ($L_2$). As previously noted, composition (L) is located in the low fusion temperature trough in the $CaO—SiO_2—Al_2O_3$ phase diagram. Further, as previously indicated, the slag compositions are abbreviated by indicating the amounts of additional lime used in percent as a suffix, for example, ($L_1$) and ($L_2$) indicate lime addition of 1% and 2%, respectively, over that of Composition (L) (see the table of FIG. 22). The amount of chemical $CaF_2$ (abbreviated to CF) added in percent was also indicated as a suffix, for example, ($L_{0.5}CF_{0.25}$), which represents that 0.25% by weight of $CaF_2$ was added to a feed mixture with Slag Composition of ($L_{0.5}$).

Generally, FIG. 22 shows the effect of $CaF_2$ addition to feed mixtures, which include a 5.7% $SiO_2$ magnetic concentrate, medium-volatile bituminous coal at 80% of the stoichiometric requirement for metallization, and slag composition ($L_{0.5}$) on weight distributions of products in a 2-segment pattern in boats, heated at 1400° C. for 7 minutes in a $N_2$—CO atmosphere. An addition of 0.25% by weight of $CaF_2$ to a feed mixture with Slag Composition ($L_{0.5}$) decreased the amount of micro-nuggets from 11% to 2%, and the amount remained minimal at about 1% with the addition of $CaF_2$ in the amount of about 2% by weight.

Generally, FIG. 23 shows the effect of $CaF_2$ and/or fluorspar (abbreviated FS) addition to feed mixtures that include a 5.7% $SiO_2$ magnetic concentrate, medium-volatile bituminous coal at 80% of the stoichiometric requirement for metallization, and slag composition of increasing lime composition, on the amount of micro-nuggets generated. The samples in a 2-segment pattern in boats were heated at different temperatures for 7 minutes in a $N_2$—CO atmosphere (e.g., 1400° C., 1350° C., and 1325° C.). It is shown that fluorspar and $CaF_2$ behaved essentially identical in lowering the temperature of forming fully fused iron nuggets and in minimizing the formation of micro-nuggets. In the table, it is noted that an addition of fluorspar lowered the operating temperature by 75° C. Minimum temperature for forming fully fused iron nuggets decreased to as low as 1325° C. by fluorspar addition of about 1% to about 4% by weight. Fluorspar addition also minimized the generation of micro-nuggets to about 1%.

Generally, FIG. 24 shows the effect of fluorspar addition on analytical results of iron nuggets formed from feed mixtures that included a 5.7% $SiO_2$ magnetic concentrate, medium-volatile bituminous coal at 80% of the stoichiometric requirement for metallization and slag composition ($L_1$), ($L_{1.5}$), and ($L_2$). The samples in a 2-segment pattern in boats were heated at 1400° C. for 7 minutes in a $N_2$—CO atmosphere.

Although fluorspar is reported to be not particularly an effective desulfurizer in steelmaking slag, FIG. 24 shows that with increasing fluorspar addition, sulfur in iron nuggets was lowered more effectively at Slag Compositions ($L_{1.5}$) and ($L_2$) than at ($L_1$). At Slag Compositions ($L_{1.5}$) and ($L_2$), iron nuggets analyzed including 0.058% by weight sulfur and 0.050% by weight sulfur, respectively, while sulfur decreased steadily to as low as 0.013% and 0.009% by weight, respectively, at fluorspar addition of 4%. Therefore, the use of fluorspar not only lowered the operating temperature and the sulfur in iron nuggets, but also showed an unexpected benefit of minimizing the generation of micro-nuggets.

Further with reference to FIG. 17, calcium oxide, and/or one or more compounds capable of producing calcium oxide upon thermal decomposition, as shown in block 204, may be used. For example, calcium oxide and/or lime may be used as an additive to the reducible mixture. Generally, increased basicity of slag by addition of lime is a conventional approach for controlling sulfur in the direct reduction of iron ores. Increased use of lime from slag compositions $L_2$ decrease sulfur in iron nuggets from 0.084% to 0.05%. Further decreases in sulfur content may become desirable for certain applications. Increased use of lime, however, requires increasingly higher temperatures and longer time at temperature for forming fully fused iron nuggets. As such, a substantial amount of lime is not desirable, as higher temperatures also result in less economical production of metallic iron nuggets.

As further shown in FIG. 17, sodium oxide, and/or one or more compounds capable of producing sodium oxide upon thermal decomposition may be used in addition to lime (block 206), such as, for example, to minimize sulfur in the formed metallic iron nuggets. For example, soda ash, $Na_2CO_3$, $NaHCO_3$, NaOH, borax, NaF and/or aluminum smelting industry slag, may be used for minimizing sulfur in the metallic iron nuggets (e.g., used in the reducible mixture).

Soda ash is used as a desulfurizer in the external desulfurization of hot metal. Sodium in blast furnace feed materials recirculates and accumulates within a blast furnace, leading to operational problems and attack on furnace and auxiliary equipment lining. In rotary hearth furnaces, recirculation and accumulation of sodium is less likely to occur, and, as such, larger amounts of sodium may be tolerated in feed materials than in blast furnaces.

Figure 25A:
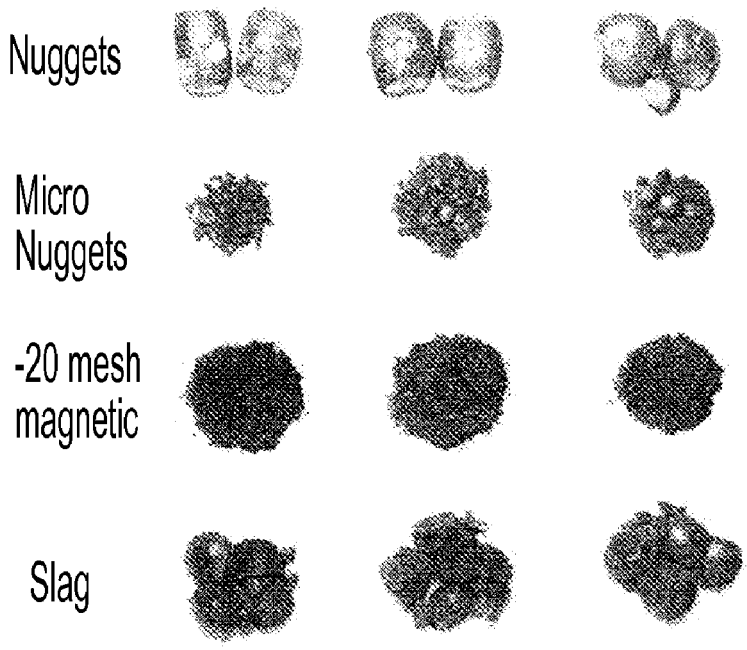

FIGS. 25A-25C show the effect of adding soda ash to a feed mixture that includes a 5.7% $SiO_2$ magnetic concentrate, medium-volatile bituminous coal at 80% of the stoichiometric requirement for metallization, and slag composition ($L_{0.5}$), on products formed in a 2-segment pattern in boats, heated in the tube furnace at 1400° C. for 7 minutes in a $N_2$—CO atmosphere. FIG. 25A corresponds to composition ($L_{0.5}$), FIG. 25B corresponds to composition ($L_{0.5}SC_1$), and FIG. 25C corresponds to composition ($L_{0.5}SC_2$).

The table of FIG. 26 shows the effect of $Na_2CO_3$ and $CaF_2$ additions on sulfur analysis of iron nuggets at different levels of lime addition, the iron nuggets formed from feed mixtures that included a 5.7% $SiO_2$ magnetic concentrate, medium-volatile bituminous coal at 80% of the stoichiometric requirement for metallization, and slag composition ($L_mCS_1$ or $L_mFS_1$). The feed mixtures were heated in the tube furnace at 1400° C. for 7 minutes in a $N_2$—CO atmosphere.

An addition of $Na_2CO_3$ without $CaF_2$ decreased sulfur in iron nuggets as effectively as, or even more effectively than the $CaF_2$, but the amount of micro-nuggets generated increased, as shown in FIGS. 25A-25C. When $CaF_2$ was used along with $Na_2CO_3$, the sulfur content in iron nuggets decreased even further and the amount of micro-nuggets remained minimal at about 1%. Another point of note was that the effect of $CaF_2$ in lowering the fusion temperature of iron nuggets was more pronounced at Slag Compositions ($L_1$), ($L_{1.5}$), and ($L_2$) than at Slag Compositions L and $L_{0.5}$. This analytical data shows that at least in this embodiment decrease in sulfur was more pronounced with soda ash than with increased addition of lime.

The table of FIG. 27 shows the effect of temperature on analytical results of iron nuggets formed from feed mixtures. The feed mixture included a 5.7% $SiO_2$ magnetic concentrate, medium-volatile bituminous coal at 80% of the stoichiometric requirement for metallization, and slag composition ($L_{1.5}FS_1SC_1$). The feed mixture was heated in the tube furnace at the indicated temperatures for 7 minutes in a $N_2$—CO atmosphere. As shown in the table of FIG. 27, sulfur in the iron nuggets decreased markedly with decreasing temperature from 0.029% S at 1400° C. to 0.013% S at 1325° C. An addition of $Na_2CO_3$ together with 1-2% $CaF_2$ not only lowers sulfur in iron nuggets to well below 0.05%, but also lowers the operating temperature and minimizes the generation of micro-nuggets. Lowering the process temperature, therefore, appears to have an additional advantage of lowering sulfur, in addition to lowering energy cost and maintenance.

In previous and various metallic iron reduction processes, such as those using formed and/or dried balls as presented in the Background of the Invention section herein, carbonaceous reductants are typically added in an amount greater than the theoretical amount required to reduce the iron oxides for promoting carburizing of metallic iron in order to lower the melting point. The amount of carbonaceous reductant in the balls is thus claimed to include an amount required for reducing iron oxide plus an amount required for carburizing metallic iron and an amount of loss associated with oxidation.

In many of the processes described herein, the stoichiometric amount of reducing material is also theoretically necessary for complete metallization and formation of metallic iron nuggets from a predetermined quantity of reducible iron bearing material. For example, in one or more embodiments, the reducible mixture may include the predetermined quantity of reducible iron bearing material and between about 70 percent and about 125 percent of the stoichiometric amount of reducing material (e.g., carbonaceous reductant) necessary for complete metallization thereof (e.g., where the reducible feed mixture has a uniform coal content throughout the reducible mixture, such as when formed in mounds).

However, in one or more embodiments according to the present invention, use of the amount of carbonaceous reductant in the amount of the stoichiometric amount theoretically needed for complete metallization may lead to the break-up of the reducible mixture into mini-nuggets and the generation of a large amount of micro-nuggets, as shown in FIGS. 18-19. FIGS. 18-19 show the effect of stoichiometric coal levels on nugget formation where feed mixture including 5.7% $SiO_2$ concentrate, medium volatile bituminous coal, and at slag composition (A), is used. The feed mixture is heated in a tube furnace at 1400° C. for 10 minutes in a $N_2$—CO atmosphere. As shown therein, a 100% level and/or excess addition of carbonaceous reductants beyond the stoichiometric requirements may result in the formation of mini- and micro-nuggets.

FIGS. 20A-20B also show the effect of stoichiometric coal levels on nugget formation where feed mixture including 5.7% $SiO_2$ concentrate, sub-bituminous coal, and at slag compositions (A) and (L), is used. The feed mixture is heated in a tube furnace at 1400° C. for 10 minutes in a $N_2$—CO atmosphere.

As seen in FIGS. 18 through 20B, the addition of about 70% to about 90% of the theoretical amount minimized the formation of micro-nuggets. Carbon needed for further reduction and carbonizing molten metal would then come from, for example, CO in the furnace atmosphere and/or from the underlying carbonaceous hearth material layer 44.

The control of the amount of reducing material in the reducible mixture based on the stoichiometric amount theoretically necessary to complete the metallization process (as well as the use of various additives described herein), may be applied to other nugget formation processes as well as the methods described with reference to FIG. 1. For example, preformed ball methods (compacted or uncompacted, but otherwise formed), or formation of compacts (e.g., mounds formed by pressure or compaction or briquettes) may use such reductant control techniques and/or additives techniques described herein.

For example, compacts that employ 70% to 90% of carbonaceous reductant theoretically needed for complete metallization in a suitable reducible mixture may be used. For example, such compacts may have the appropriate additions of flux and limestone, and/or may further include auxiliary reducing agent on the hearth or partially covering the compacts to effectively provide nugget metallization and size control. In other words, the stoichiometric control described herein along with the variation in compositions (e.g., additives, lime, etc.) provided herein may be used with compacts (e.g., briquettes, half briquettes, compacted mounds, etc.). Use of compacts may alleviate any need to use nugget separation material as described with reference to FIG. 1. For example, control of pressure, temperature and gas diffusion in a briquette or other type of compact may provide such benefits.

However, as described above, such data shown in FIGS. 18 through 20A result from thermal treatment using the electric tube furnace in a $N_2$—CO atmosphere described herein and generally does not take into consideration the atmosphere in a natural gas-fired furnace (e.g., a linear hearth furnace such as described herein). In such a linear hearth furnace atmosphere, the atmosphere may include 8-10% carbon dioxide and 3-4% carbon monoxide and highly turbulent gas flow in the highest temperature zone thereof. This is different than the electrical tube and box furnace where the atmosphere is being controlled with introduction of components. As such, various tests were run in a linear hearth furnace such as that described herein with reference to FIG. 2D and also as provided below. The tests and results therefrom are summarized herein with reference to FIGS. 35-41.

Linear Hearth Furnace Tests

The tests were run using a 40-ft. long, natural gas-fired linear hearth furnace including three heating zones and a cooling section like that described generally with reference to FIG. 2D. Sample trays 223 or pallets (as illustrated in FIG. 35A) used in the tests were made from a 30 inch square carbon steel framework and were lined with high temperature fiber board 225 with sidewalls to contain samples (e.g., the reducible mixture 228 and products resulting therefrom after completion of processing). The trays 223 were conveyed through the furnace by a hydraulically driven walking beam system as described with reference to FIG. 2D. The arrow 229 in FIG. 35A indicates the direction of pallet movement through the furnace.

The reducible feed mixture 228 on the tray 223 was formed in the shape of 6-segment domes for the laboratory box furnace tests, placed on a −10 mesh coke layer in each of the four quadrants of the tray 223 labeled as (1) through (4). Each of the domes in the 6×6 segment quadrant had the dimensions of substantially 1¾ inches wide by 2 inches long and were 11/16 inches high, and contained medium-volatile bituminous coal in indicated percentages (see various test examples below) of the stoichiometric amount and at the indicated (see various test examples below) Slag Composition.

Two areas of consideration with regard to the products resulting from the linear hearth furnace tests were the amount of sulfur in the metallic iron nuggets formed by the process and the amount of micro-nugget formation. The laboratory tube and box furnace tests described herein indicated that Slag Composition ($L_{1.5}FS_1$) and the use of medium-volatile bituminous coal at 80% of the stoichiometric amount minimized sulfur in iron nuggets and minimized micro-nugget formation. However, linear hearth furnace tests revealed that unexpectedly high $CO_2$ levels and highly turbulent furnace gas next to the feed being processed consumed much of the added coal (e.g., added reducing material which was added to the reducible iron bearing material) in Zones 1 and 2, and not enough reductant (e.g., reducing material) was left for carburizing and melting the metallic iron in the high temperature zone (Zone 3). Use of coal in the amount of 105 to 125 percent of the stoichiometric amount was necessary for forming fully fused metallic iron nuggets as shown by the Tests 14 and 17 provided below.

In linear hearth furnace Test 14, a pallet having an arrangement of different feed mixtures in 6-segment domes was used, such as generally shown in FIG. 35A. The feed mixture included medium-volatile bituminous coal in the quadrant indicated percentages of the stoichiometric amount and at Slag Composition ($L_{1.5}FS_1$), placed on a −10 mesh coke layer. The quadrant indicated percentages were quadrant (1) 110% coal; quadrant (2) 115% coal; quadrant (3) 120% coal; and quadrant (4) 125% coal.

In linear hearth furnace Test 17, a pallet having an arrangement of different feed mixtures in 6-segment domes was used, such as generally shown in FIG. 35A. The feed mixture included medium-volatile bituminous coal in the quadrant indicated percentages of the stoichiometric amount and at Slag Compositions ($L_{1.5}FS_2$) and ($L_{1.5}FS_3$), placed on a −10 mesh coke layer. The quadrant indicated percentages were quadrant (1) 115% coal, 2% fluorspar; quadrant (2) 110% coal, 2% fluorspar; quadrant (3) 105% coal, 2% fluorspar; quadrant (4) 115% coal, 3% fluorspar.

Iron nuggets formed in Tests 14 and 17 using coal additions of 105% to 125% of the stoichiometric amount and Slag Compositions of ($L_{1.5}FS_{1\sim3}$). FIG. 35B shows the resulting products from Test 17. Typical gas compositions showed that when $O_2$ was low, $CO_2$ was about 10% and CO gradually increased from 2% to 4%. Such data is provided in FIG. 36 which shows analytical results of furnace gases provided for the zones in the linear hearth furnace along with the temperature of such zones for Test 17. The same temperatures were used in the zones during Test 14.

Concentrations of CO, expressed as percentages of $CO+CO_2$, were plotted in the equilibrium concentration diagrams of iron oxide reduction and carbon solution (Boudouard) reactions as shown in FIG. 37. The CO concentration in Zone 1 (1750° F.) was in the stability region of $Fe_3O_4$, and those in Zones 2 (2100° F.) and Zone 3 (2600° F.) were in the low range of the stability region of FeO. All the points were well below the carbon solution reaction, supporting a view that added coal was rapidly lost in the linear hearth furnace. The gas sampling ports of the linear hearth furnace were located on the furnace wall at about 8 inches above pallet surfaces. Because of the high turbulence of furnace gases, the CO concentrations of 4% would represent a well mixed value. The arrow at 2600° F. in FIG. 37 indicates the increase in CO with time in Zone 3.

Analytical results of iron nuggets and slags of linear hearth furnace Tests 14 and 17 are given in FIG. 38, along with such results for another Test 15. In linear hearth furnace Test 15, a pallet having an arrangement of feed mixtures in domes was used, such as generally shown in FIG. 35A. The feed mixture of Test 15 included medium-volatile bituminous coal at 115% and 110% of the stoichiometric amount and at Slag Compositions ($L_{1.5}FS_1$), placed on a −10 mesh coke layer.

As shown in FIG. 38, sulfur in the iron nuggets ranged 0.152 to 0.266%, or several times to even an order of magnitude higher than those in iron nuggets formed in the laboratory tube and box furnaces with the same feed mixtures as shown and described previously with reference to FIG. 24. The slags were analyzed to confirm that they were indeed high in lime. Though the $CaO/SiO_2$ ratios ranged from 1.48 to 1.71, it was noted that the slags were high in FeO ranging from 6.0 to 6.7%. The FeO analyses of slags in the laboratory tube and box furnaces under identical slag compositions analyzed less than 1% FeO. The high $CO_2$ and highly turbulent furnace gas in the linear hearth furnace (e.g., resulting from the use of gas burners) caused the formation of high FeO slags, which apparently was responsible for higher sulfur in iron nuggets by interfering with de-sulfurizing. The use of an increased percentage of coal as well as the use of high sulfur coke (0.65% S) as a hearth layer as compared to low sulfur coke (0.40% S) in the laboratory tests might also have contributed to high sulfur in the iron nuggets.

In FIG. 39, analytical results of iron nuggets and slag of linear hearth furnace Tests 14, 15, and 17, along with additional Tests 21 and 22 are shown. Carbon and sulfur in iron nuggets and iron, FeO and sulfur in slags for such Tests are summarized. In linear hearth furnace Tests 21 and 22, a pallet having an arrangement of different feed mixtures in 6-segment domes was used, such as generally shown in FIG. 35A. The feed mixture included medium-volatile bituminous coal in the indicated percentages of the stoichiometric amount as shown in FIG. 39 and at the indicated Slag Compositions as shown in FIG. 39, placed on a −10 mesh coke layer. The temperature in Zone 3 was set of 25° F. higher at 2625° F. in Tests 21 and 22.

As shown in FIG. 39, the FeO in slags was halved when a fluorspar addition was increased to 2% with attendant decrease in sulfur in iron nuggets. In view of the results of Test 17 with a fluorspar addition of 2%, the lower FeO might have been the results of a higher temperature of 2625° F. (1441° C.).

FIG. 40 is a table showing the effect of temperature in Zone 3 on CO concentrations for Tests 16-22. The feed mixtures used in Tests 14-15, 17, and 21-22 have been previously noted. In linear hearth furnace Test 16, a pallet having an arrangement of feed mixtures in 3½ inches wide by 5 inches long (and 11/16 inches high) trapezoidal mounds was used. The feed mixture of Test 15 included medium-volatile bituminous coal at 100% to 115% of the stoichiometric amount and at Slag Compositions ($L_{1.5}FS_1$), placed on a −10 mesh coke layer. In linear hearth furnace Test 18, the feed mixture included medium-volatile bituminous coal at 100% to 115% of the stoichiometric amount and at Slag Compositions ($L_{1.5}FS_{0.5}$), placed on a −10 mesh coke layer. In linear hearth furnace Test 19, the feed mixture included medium-volatile bituminous coal at 115% and 120% of the stoichiometric amount and at Slag Compositions ($L_{1.5}FS_1$), placed on a −10 mesh coke layer. In linear hearth furnace Test 20, the feed mixture included medium-volatile bituminous coal at 115% and 120% of the stoichiometric amount and at Slag Compositions ($L_{1.5}FS_1$), placed on a −10 mesh coke layer.

As shown in FIG. 40, there is a difference between the CO concentrations at 2600° F. (2427° C.) and 2625° F. (1441° C.). The initial numbers are the CO readings when the temperature of the furnace recovered to 2600° F. The CO concentrations increased asymptotically with time and approached the final numbers towards the end of the tests. It is apparent that both the initial and final numbers are higher at 2600° F. than at 2625° F. With an increase in 25° F. in temperature, the burners were putting out more combustion gas to maintain the temperature and hence diluted the CO generated by the carbon solution reaction, thereby hindering the carburizing of metallic iron. In fact, the products at 2625° F. appeared to form less fully fused iron nuggets than at 2600° F. Thus, suppressing the movement of furnace gas may be necessary.

The amounts of micro nuggets in the linear hearth furnace tests were also large, e.g., in the range of 10 to 15%, as summarized in FIG. 41. The table of FIG. 41 shows the effects of the levels of fluorspar and coal additions as well as of temperature. There were no noticeable parameters that correlated with micro-nugget formation. In the laboratory tube and box furnace tests, the amounts of micro-nuggets at Slag Composition ($L_{1.5}FS_{0.5\sim4}$) were less than a few percent as shown and described with reference to FIG. 23. High $CO_2$ and highly turbulent furnace gas may require use of coal in excess of the stoichiometric amount, and coal in the feed mixtures near the hearth layer of coke may have remained high during processing, thereby causing large amounts of micro-nuggets to form.

In view of the above, in one embodiment of the present invention, use of a feed mixture with a sub-stoichiometric amount of coal next to the hearth layer to minimize micro-nugget formation, which is overlaid by a feed mixture containing coal in excess of the stoichiometric amount to allow for the loss by the carbon solution reaction, is used. In other words, a stoichiometric amount of reducing material (e.g., coal) is necessary for complete metallization and formation of metallic iron nuggets from a predetermined quantity of reducible iron bearing material, the reducing material (e.g., coal) and the iron bearing material providing a reducible feed mixture for processing according to one or more embodiments described herein. For certain applications of a feed mixture with a sub-stoichiometric amount of carbonaceous material, the hearth layer might not be used, or the hearth layer might not contain any carbonaceous material.

One embodiment according to the present invention may include using reducible feed mixture that includes a first layer of reducible mixture on the hearth material layer that has a predetermined quantity of reducible iron bearing material but only between about 70 percent and about 90 percent of the stoichiometric amount of reducing material necessary for complete metallization thereof so as to reduce the potential for formation of micro-nuggets (e.g., such as suggested when the processing was accomplished using the box and tube furnaces). The predetermined quantity of reducible iron bearing material may be determined and varied dynamically at the time the reducible iron bearing material is placed on the hearth layer. Subsequently, one or more additional layers of reducible mixture that include a predetermined quantity of reducible iron bearing material and between about 105 percent and about 140 percent of the stoichiometric amount of reducing material necessary for complete metallization thereof would be used. As such, the reducible feed mixture would include layers of mixture having different stoichiometric amounts of reducing material (e.g., the stoichiometric percentage increasing as one moves away from the hearth layer).

As discussed above, in certain furnaces (e.g., such as natural gas fired furnaces with high $CO_2$ and highly turbulent gas atmospheres), added carbonaceous material (e.g., coal) in feed mixtures (e.g., such as those reducible mixtures described herein) is lost by the carbon solution (Boudouard) reaction in certain zones of the furnace (e.g., pre-heating and reduction zones). To compensate for the loss, it may be necessary to add reducing material (e.g., carbonaceous material) in excess of the stoichiometric amount theoretically necessary for complete metallization thereof. However, also as described herein, such an addition of reducing material (e.g., coal) in excess of the stoichiometric amount may lead to formation of large amounts of micro-nuggets. Such micro-nugget formation appears to be related to the amount of reducing material in an area near the hearth layer that remains high during processing.

As indicated herein, an addition of the reducing material somewhat below the stoichiometric amount minimizes the formation of such micro-nuggets. As such, a feed mixture (e.g., a reducible mixture) with a sub-stoichiometric amount of reducing material (e.g., coal) next to the hearth layer overlaid with reducible mixture containing reducing material in excess of the stoichiometric amount theoretically necessary for complete metallization to minimize micro-nugget formation is described herein. Further, the loss of added reducing material (e.g., coal) during processing by the carbon solution reaction may be minimized by compaction of the reducible mixture in various ways (e.g., formation of compacts or briquettes from the reducible mixture). FIGS. 11A-11F show various ways to form feed mixture (e.g., reducible mixture) by compaction while also incorporating the idea of using a sub-stoichiometric amount reducing material in an area near the hearth layer. For example, such formed reducible mixture may include any composition described herein or may include other feed mixture compositions that meet the requirements of at least one sub-stoichiometric portion of material and at least one portion of material that includes an amount of reducing material in excess of the stoichiometric amount of reducing material theoretically necessary for complete metallization of the reducible mixture.

FIGS. 11A-11B show a preformed multiple layer dried ball 280 of reducible mixture for use in one or more embodiments of a metallic iron nugget process. FIG. 11A shows a plan view of the multi-layered ball 280 of reducible mixture and FIG. 11B shows a cross-section of the multiple layered ball 280. As shown in FIG. 11B, the ball 280 includes a plurality of layers 284-285 of reducible material. Although only two layers are shown, more than two layers are possible. Layer 284 of ball 280 is formed of reducible mixture with a sub-stoichiometric amount of reducing material (e.g., between 70% and 90% of the stoichiometric amount theoretically necessary for complete metallization), while layer 285 of ball 280 (e.g., the interior of the ball 280) is formed of reducible mixture containing reducing material in excess of the stoichiometric amount theoretically necessary for complete metallization (e.g., greater than 100%, such as greater than 100% but less than about 140%). With the ball 280 formed in such a manner, use of a feed mixture with a sub-stoichiometric amount of reducing material (e.g., coal) next to the hearth layer to minimize micro-nugget formation is accomplished while maintaining adequate reducing material to accomplish complete metallization. One will recognize that the ball 280 may be formed without compaction or pressure at room or low temperature (e.g., room to 300° C.) but with utilization of a binding material.

In one embodiment, two layer balls having a size that is ¾ inch or less in diameter are made. With respect to ¾ inch or less diameter balls, for example, an outer layer having a thickness of, for example, 1/16 inch amounts to about 40 percent or more of the total weight of the ball in the outer layer, while a thickness of ⅛ inch amounts to about 60 percent or more of the total weight. As such, with this amount of the outer layer having a sub-stoichiometric amount of reducing material (e.g., between 70% and 90% of the stoichiometric amount theoretically necessary for complete metallization), the central core (i.e., inner portion) would need to be appreciably higher in reducing material (e.g., coal) content than, for example, when mounds including multiple layers are used (e.g., the central core may need to be higher than 125 percent of the stoichiometric amount theoretically necessary for complete metallization). In one embodiment, the interior of the ball is formed of reducible mixture containing reducing material in excess of 105 percent of the stoichiometric amount theoretically necessary for complete metallization but less than about 140 percent).

FIGS. 11C-11D show exemplary embodiments of formation tools 286-287 for use in providing compacts (e.g., briquettes) of reducible mixture for use in one or more embodiments of a metallic iron nugget process. Briquettes with two relatively flat surfaces are formed. As shown in FIG. 11C, the briquette includes three layers 290-292. The two outside (or top and bottom layers) 291-292 are formed of reducible mixture with a sub-stoichiometric amount of reducing material (e.g., between 70% and 90% of the stoichiometric amount theoretically necessary for complete metallization), while the middle layer 290 (e.g., the interior layer) is formed of reducible mixture containing reducing material in excess of the stoichiometric amount theoretically necessary for complete metallization (e.g., greater than 100%, such as greater than 100% but less than about 140%). With the briquette formed in such a manner, a face (e.g., outside layer) including a feed mixture with a sub-stoichiometric amount of reducing material (e.g., coal) will be next to the hearth layer to minimize micro-nugget formation. One will recognize that the briquette may be formed with pressure being applied via element 287 at room or low temperature (e.g., room to 300° C.).

FIG. 11D shows formation of a two layer briquette that may be formed. The briquette includes layers 293-294. One of the layers 293 is formed of reducible mixture with a sub-stoichiometric amount of reducing material (e.g., between 70% and 90% of the stoichiometric amount theoretically necessary for complete metallization), while the other layer 294 is formed of reducible mixture containing reducing material in excess of the stoichiometric amount theoretically necessary for complete metallization (e.g., greater than 100%, such as greater than 100% but less than about 140%). With the briquette formed in such a manner, with proper loading onto the hearth, the layer including a feed mixture with a sub-stoichiometric amount of reducing material (e.g., coal) can be positioned will be next to the hearth layer to minimize micro-nugget formation.

FIGS. 11E-11F show exemplary embodiments of formation tools 288 and 289 for use in providing compacts (e.g., dome-shaped mixtures and dome-shaped briquettes) of reducible mixture for use in one or more embodiments of a metallic iron nugget process. As shown in FIG. 11E, the dome-shaped compact 300 include portions formed from layers 295-296. One of the layers 296 is formed of reducible mixture with a sub-stoichiometric amount of reducing material (e.g., between 70% and 90% of the stoichiometric amount theoretically necessary for complete metallization), while the other layer 295 is formed of reducible mixture containing reducing material in excess of the stoichiometric amount theoretically necessary for complete metallization (e.g., greater than 100%, such as greater than 100% but less than about 140%). With the dome-shaped compact 300 formed in such a manner, the layer including a feed mixture with a sub-stoichiometric amount of reducing material (e.g., coal) is positioned next to the hearth layer 281 to minimize micro-nugget formation. The tool 288 shown as forming the compacts 300 may be similar to that described with reference to FIG. 10A. Further, in one embodiment, the compacts 302 are formed by pressing in situ in the preheat zone of the furnace (e.g., 700° C. to 1000° C.).

As shown in FIG. 11F, the domed-shaped compacts 302 include portions formed from three layers 297-299 (e.g., briquettes formed at room temperature). The two outside (or top and bottom layers) 297-299 are formed of reducible mixture with a sub-stoichiometric amount of reducing material (e.g., between 70% and 90% of the stoichiometric amount theoretically necessary for complete metallization), while the middle layer 298 (e.g., the interior layer) is formed of reducible mixture containing reducing material in excess of the stoichiometric amount theoretically necessary for complete metallization (e.g., greater than 100%, such as greater than 100% but less than about 140%). With the compact formed in such a manner, a face (e.g., outside layer) including a feed mixture with a sub-stoichiometric amount of reducing material (e.g., coal) will be next to the hearth layer to minimize micro-nugget formation. In one embodiment, each portion of the tool 289 shown for use in forming the compacts 302 may be similar to that described with reference to FIG. 10A.

In one embodiment, the compacts 302 are formed using a press such as that shown in FIGS. 11C-11D, but with different shaped molding surfaces. For example, in one embodiment, the compacts as shown in FIG. 11E are formed by high temperature (e.g., 700° C. to 1000° C.) pressing of the reducible mixture. Certain types of reducing material (e.g., coal) may soften at some temperature and act as a binder, or use of some low melting point additives may assist in developing less permeable compacts. For example, one or more of the following low melting point additives may be used: borax (melting point 741° C.); sodium carbonate (melting point 851° C.); sodium disilicate (melting point 874° C.); sodium fluoride (melting point 980-997° C.); and sodium hydroxide (melting point 318.4° C.).

One will recognize that various shapes of the compacts may be used while still maintaining the benefit of having feed mixture with a sub-stoichiometric amount of reducing material (e.g., coal) next to the hearth layer to minimize micro-nugget formation. The configurations described herein are given for illustration only.

With further reference to FIG. 1, the layer of reducible mixture provided, as generally shown by block 18, may be provided in one or more various manners (e.g., pulverized coal mixed with iron ore). As shown in FIG. 28, the reducible mixture may be provided by forming micro-agglomerates (block 252) according to the micro-agglomerate formation process 250. At least in one embodiment according to the present invention, the reducible mixture is a layer of reducible micro-agglomerates. Further, at least in one embodiment, at least 50% of the layer of reducible micro-agglomerates includes micro-agglomerates having a average size of about 2 millimeters or less.

The micro-agglomerates are formed (block 252) with provision of reducible iron-bearing material (e.g., iron oxide material, such as iron ores) (block 260) and with the use of reducing material (block 256). Optionally, one or more additives (block 258) may be additionally mixed with the reducible iron-bearing material and the reducing material as described herein with regard to other embodiments (e.g., lime, soda ash, fluorspar, etc.). Water is then added (block 254) in the formation of the micro-agglomerates. For example, in one embodiment, a mixer (e.g., like that of a commercial kitchen stand mixer) may be used to mix all the components until they are formed into small micro-agglomerate structures.

Direct feeding of fine dried particles, such as taconite concentrates and pulverized coal, in gas-fired furnaces would result in a large quantity of the particles being blown out as dust by the movement of furnace gases. Therefore, micro-agglomeration of the feed mixture is desirable. For example, direct mixing of wet filter cakes of taconite concentrates and dry ground coal with optimum addition of water can generate micro-agglomerates by a suitable mixing technique such as Pekay mixers, paddle mixers, or ribbon mixers. Typical size distributions of micro-agglomerates as a function of different levels of moisture are shown in FIG. 29.

Feeding of micro-agglomerates to hearth surfaces has several advantages. Micro-agglomerates can be fed to hearth surfaces without breakage, with minimal dust losses, and with uniform spreading over hearth surfaces. Then, micro-agglomerates, once placed on the hearth, may be compacted into mound-shaped structures as described herein (e.g., pyramidal shapes, rounded mounds, dome shaped structures, etc.)

The table of FIG. 30 shows the terminal velocities of micro-agglomerates as functions of size and air velocity, calculated by assuming that the apparent density of micro-agglomerates is 2.8 and air temperature is 1371° C. (2500° F.). Particle sizes with terminal velocities less than air velocities would be blown out as dust in gas-fired furnaces. To prevent dust losses, in at least one embodiment, it is desirable to have at least 50% of the layer of reducible micro-agglomerates include micro-agglomerates having a average size of about 2 millimeters or less. Referring to FIG. 29, it is noted that in such a case, the micro-agglomerates should be formed with about 12% moisture to achieve such a distribution of micro-agglomerates.

The moisture content to provide desired properties for the micro-agglomerates will depend on various factors. For example, the moisture content of the micro-agglomerates will depend at least on the fineness (or coarseness) and water absorption behavior of the feed mixture. Depending on such fineness of the feed mixture, the moisture content may be within a range of about 10 percent to about 20 percent.

FIG. 31 shows that fully fused iron nuggets are formed with micro-agglomerate feed, but had little effect on the generation of micro-nuggets, as compared to the products from a dry powder feed mixture under the same condition. The micro-agglomerated feed was made from a 5.7% $SiO_2$ magnetic concentrate, medium-volatile bituminous coal at 80% of the stoichiometric requirement for metallization, and slag composition (A). Moisture content was about 12% for the micro-agglomerated feed. The same feed mixture was used for the dry feed (but without the addition of moisture). The resulting products were formed in a 2-segment pattern in boats, heated in the tube furnace at 1400° C. for 7 minutes in a $N_2$—CO atmosphere.

FIG. 31A shows the results of the use of the dry feed reducible mixture, whereas FIG. 31B shows the results of a micro-agglomerated feed mixture. As shown therein, no significant additional micro-nuggets were formed and the metallic iron nuggets formed were substantially the same for both the dry feed mixture and the micro-agglomerated feed. However, with use of the micro-agglomeration, dust control is provided.

Any type of layering of the micro-agglomerate may be used. For example, the reducible micro-agglomerates may be provided by providing a first layer of reducible micro-agglomerates on the hearth material layer. Subsequently, one or more additional layers of reducible micro-agglomerates may be provided on a first layer. The average size of the reducible micro-agglomerates of at least one of the provided additional layers could be different relative to the size of the micro-agglomerates previously provided. For example, the size may be larger or smaller than the previously-provided layers. In one embodiment, feeding of micro-agglomerates in layers with coarser agglomerates at the bottom and with decreasing size to the top may minimize the mixing of iron ore/coal mixtures with the underlying heath material layer (e.g., pulverized coke layer), thereby minimizing the generation of micro-nuggets.

The use of reducible feed mixture layers having different stoichiometric amounts of reducing material may be advantageously used in combination with the use of micro-agglomerates as described herein. (e.g., the stoichiometric percentage increasing as one moves away from the hearth layer). For example, larger size micro-agglomerates (e.g., coarser agglomerates) along with lower stoichiometric percentages of reducing material may be used for material adjacent the hearth layer. Additional layers having higher stoichiometric percentages and micro-agglomerates of decreasing size (e.g., finer agglomerates) may then be provided to the coarser and lower percentage micro-agglomerates provided on the hearth layer.

All patents, patent documents, and references cited herein are incorporated in their entirety as if each were incorporated separately. This invention has been described with reference to illustrative embodiments and is not meant to be construed in a limiting sense. As described previously, one skilled in the art will recognize that other various illustrative applications may use the techniques as described herein to take advantage of the beneficial characteristics of the particles generated hereby. Various modifications of the illustrative embodiments, as well as additional embodiments to the invention, will be apparent to persons skilled in the art upon reference to this description.

The invention claimed is:

1. A system for use in production of metallic iron nuggets comprising:

a hearth comprising refractory material for receiving a hearth material layer thereon, the hearth material layer comprising at least carbonaceous material;

a charging apparatus providing a layer of a reducible mixture on at least a portion of the hearth material layer, at least a portion of the reducible mixture comprising at least reducing material and reducible iron bearing material;

a channel definition device creating a plurality of channel openings in the reducible mixture that extend at least partially into the layer of the reducible mixture to define a plurality of nugget forming reducible material regions separated by the plurality channel openings;

a channel fill apparatus at least partially filling the plurality of channel openings with nugget separation fill material comprising at least carbonaceous material; and a furnace thermally treating the layer of reducible mixture to form one or more metallic iron nuggets in one or more of the plurality of the nugget forming reducible material regions separated by the nugget separation fill material.

2. The system claimed in claim 1 where the channel definition device creates mounds of the reducible mixture comprising at least one curved or sloped portion.

3. The system claimed in claim 2 where the channel definition device creates dome-shaped mounds of the reducible mixture.

4. The system claimed in claim 2 where the channel definition device creates pyramid-shaped mounds of the reducible mixture.

5. The system claimed in claim 1 where the plurality of channel openings extend into the layer of the reducible mixture to a channel depth, and the channel fill apparatus sufficiently fills the plurality of channel openings with nugget separation fill material to at least about one quarter of the channel depth.

6. The system claimed in claim 1 where the plurality of channel openings extend into the layer of the reducible mixture to a channel depth, and the channel fill apparatus sufficiently fills the plurality of channel openings with nugget separation fill material to less than about three quarters of the channel depth.

7. The system claimed in claim 1 where the charging apparatus provides a layer of reducible micro-agglomerates, with at least 50 percent of the layer of reducible mixture comprises micro-agglomerates having an average size of about 2 millimeters or less.

8. The system claimed in claim 1 where the furnace thermally treats the layer of reducible mixture at a temperature less than 1450 degrees centigrade causing the reducible mixture in at least some of the nugget forming reducible material regions to shrink and separate from other adjacent nugget forming reducible material regions.

* * * * *

UNITED STATES PATENT AND TRADEMARK OFFICE

CERTIFICATE OF CORRECTION

PATENT NO. : 8,158,054 B2
APPLICATION NO. : 12/639584
DATED : April 17, 2012
INVENTOR(S) : Iwao Iwasaki et al.

It is certified that error appears in the above-identified patent and that said Letters Patent is hereby corrected as shown below:

IN THE SPECIFICATION:

Column 37, line 13, “1-2%” should read --1~2%--.

Signed and Sealed this
Thirtieth Day of October, 2012

David J. Kappos

David J. Kappos
*Director of the United States Patent and Trademark Office*